US010074297B2

(12) United States Patent
Henshue et al.

(10) Patent No.: US 10,074,297 B2
(45) **Date of Patent: *Sep. 11, 2018**

(54) DECORATIVE DETECTABLE WARNING PANEL HAVING IMPROVED GRIP

(71) Applicant: Brandbumps, LLC, Middleton, WI (US)

(72) Inventors: Christopher Gary Henshue, Verona, WI (US); Gary LaVerne Henshue, Madison, WI (US); Kent Sherman Barta, Fitchburg, WI (US); Edward James Robb, Amherst, NY (US); Alexander Frederick Robb, Gasport, NY (US); David Matthew Riggs, Apex, NC (US)

(73) Assignee: Brandbumps, LLC, Middleton, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/172,327

(22) Filed: Jun. 3, 2016

(65) Prior Publication Data

US 2016/0284255 A1 Sep. 29, 2016

Related U.S. Application Data

(63) Continuation of application No. 14/967,630, filed on Dec. 14, 2015, now Pat. No. 9,361,816, which is a (Continued)

(51) Int. Cl.
*G09F 7/04* (2006.01)
*G09F 19/22* (2006.01)
(Continued)

(52) U.S. Cl.
CPC ..... *G09F 19/228* (2013.01); *A61H 3/066* (2013.01); *B44C 1/17* (2013.01); *B44C 3/025* (2013.01);
(Continued)

(58) Field of Classification Search
CPC .... A61H 3/066; A61H 2003/063; E01C 5/20; E01C 11/22; E01C 11/24; E01C 5/00;
(Continued)

(56) References Cited

U.S. PATENT DOCUMENTS 3,967,400 A * 7/1976 Otto ..... B42D 25/00 283/110
4,055,550 A 10/1977 Panandiker
(Continued)

FOREIGN PATENT DOCUMENTS

CA 2560422 A1 9/2005
EP 426896 A1 9/1989
(Continued)

OTHER PUBLICATIONS

International Search Report and Written Opinion dated Jun. 25, 2013, PCT/US13/25574.
(Continued)

*Primary Examiner* — Shin H Kim
(74) *Attorney, Agent, or Firm* — Casimir Jones, S.C.; J. Mitchell Jones

(57) ABSTRACT

The present invention relates to detectable warning panels, and in particular to detectable warning panels that display text and/or other graphic information such as commercial messages, trademarks, logos, directions, slogans, pictures, names, product illustrations, emblems, promotional information related to a product or service, Quick Response Codes, matrix code, two-dimensional bar code, optical machine-readable labels, and combinations thereof.

16 Claims, 27 Drawing Sheets

Related U.S. Application Data continuation of application No. 13/764,327, filed on Feb. 11, 2013, now Pat. No. 9,311,831.

(60) Provisional application No. 61/596,940, filed on Feb. 9, 2012.

(51) Int. Cl.

| | |
|---|---|
| ***G09F 7/00*** | (2006.01) |
| ***A61H 3/06*** | (2006.01) |
| ***B44C 1/17*** | (2006.01) |
| ***E01C 5/00*** | (2006.01) |
| ***E01C 11/22*** | (2006.01) |
| ***B44C 3/02*** | (2006.01) |
| ***B44C 5/04*** | (2006.01) |

(52) U.S. Cl.

CPC ..... *B44C 5/0446* (2013.01); *E01C 5/00* (2013.01); *E01C 11/222* (2013.01); *G09F 7/00* (2013.01); *G09F 2019/223* (2013.01); *Y10T 428/24479* (2015.01)

(58) Field of Classification Search

CPC ..... E01C 5/22; E01C 5/16; E01C 23/0993; G09F 19/22; G09F 15/00; G09F 19/228; G09F 2019/223; E04F 15/02; E04F 15/02172

USPC ..... 116/205; 156/230; 40/600; 404/19

See application file for complete search history.

(56) References Cited

U.S. PATENT DOCUMENTS 4,080,087 A 3/1978 Phillips
4,109,439 A 8/1978 Feasel
4,275,189 A 6/1981 Danick et al.
4,353,949 A * 10/1982 Kyminas ..... B05D 3/12 156/209
4,395,529 A 7/1983 Panandiker et al.
4,404,764 A * 9/1983 Wills ..... B42D 15/02 229/92.8
4,715,743 A 12/1987 Schmanski
4,740,426 A 4/1988 Tremper
4,818,589 A 4/1989 Johnson
5,006,612 A 4/1991 Danick et al.
5,034,275 A 7/1991 Pearson
5,086,287 A 2/1992 Nutzel
5,217,319 A 6/1993 Klohn
5,271,690 A 12/1993 Fennessy, Sr.
5,302,049 A 4/1994 Schmanski
5,303,493 A 4/1994 Plumly
5,303,669 A 4/1994 Szekely
5,320,790 A 6/1994 Lowe
5,363,579 A 11/1994 Plumly
5,468,532 A 11/1995 Ho et al.
5,536,545 A * 7/1996 Condon ..... B44C 1/162 156/240
5,775,835 A 7/1998 Szekely
5,779,482 A * 7/1998 Fukumoto ..... B41M 3/16 206/459.5
5,795,122 A 8/1998 Bowers
5,827,009 A 10/1998 Kokoletsos
5,992,888 A 11/1999 North
6,001,919 A 12/1999 Yen
6,015,469 A 1/2000 Fenzi
6,041,533 A 3/2000 Lemmond
6,103,003 A 8/2000 Burgess
6,136,126 A 10/2000 Fenzi
6,233,857 B1 * 5/2001 Wyckoff ..... B44C 1/227 40/596
6,270,853 B1 8/2001 Brown et al.
6,335,749 B1 1/2002 Carizzoni et al.
6,387,504 B1 5/2002 Mushovic
6,450,728 B1 9/2002 Grahmbeek
6,481,921 B1 11/2002 Fenimore
6,490,773 B1 12/2002 Estes et al.
6,507,413 B1 * 1/2003 Mueller ..... B41J 3/407 358/1.9
6,576,074 B1 6/2003 Cabrera et al.
6,676,792 B1 1/2004 Fenzi
6,685,388 B2 2/2004 Webster
6,692,182 B1 2/2004 Fenimore
6,709,191 B1 3/2004 McCuskey
6,718,714 B1 4/2004 Montgomery
6,746,986 B1 6/2004 Sato et al.
6,769,530 B2 8/2004 Molinaro
6,775,937 B2 8/2004 Ruana
6,783,829 B2 8/2004 Arena
6,843,945 B1 1/2005 Lee et al.
6,883,430 B2 4/2005 Hollander
6,939,078 B1 9/2005 Anderson et al.
6,960,989 B1 11/2005 Grayson
6,964,244 B2 11/2005 Stockton
6,971,818 B1 12/2005 Schabacker
6,987,081 B2 1/2006 Sato et al.
6,998,005 B2 2/2006 Magee
7,001,103 B2 2/2006 Sippola
7,022,202 B2 4/2006 Goertzen
7,033,973 B2 4/2006 Fenzi
7,045,193 B2 5/2006 Tanel et al.
7,051,465 B2 5/2006 Slesinski
7,077,926 B2 7/2006 Gothfenzi
7,124,526 B2 10/2006 Keach
7,142,095 B1 11/2006 Grayson
7,189,025 B1 3/2007 Greer
7,215,300 B1 5/2007 Reid
7,223,048 B1 5/2007 Greer
7,246,749 B2 * 7/2007 Rumble ..... G07F 19/20 235/487
7,249,911 B2 7/2007 Hyams
7,267,281 B2 9/2007 Hopkins
7,302,981 B2 12/2007 Benetton
7,339,547 B2 3/2008 Reid
7,351,003 B1 4/2008 Fenimore
7,390,057 B2 6/2008 Autterson
7,631,450 B2 12/2009 Popowich
7,674,066 B2 3/2010 Wehmeyer
7,681,346 B2 3/2010 Bruce
7,740,413 B1 6/2010 Grayson
7,753,616 B2 7/2010 Greer
7,758,279 B2 7/2010 Driscoll
7,779,581 B2 8/2010 Flaherty
7,799,379 B2 9/2010 Julnes
7,810,538 B2 10/2010 Magee
7,827,928 B2 11/2010 Shaw
7,845,122 B2 12/2010 Sippola
7,866,104 B2 1/2011 Babinsky et al.
7,955,024 B2 6/2011 Driscoll
8,002,938 B2 8/2011 Elwakil
8,010,408 B2 8/2011 Rubinstein
8,017,297 B1 9/2011 Davis
8,028,491 B2 10/2011 Flaherty
D648,238 S 11/2011 Niver Freier
8,082,872 B2 12/2011 Cook
8,088,306 B2 1/2012 Kim
8,146,302 B2 4/2012 Sippola
8,241,739 B2 8/2012 Schonfeld
8,261,497 B2 9/2012 Sippola
8,266,876 B1 9/2012 Thuesen
8,308,891 B2 11/2012 Drake
8,317,956 B2 11/2012 Greer
8,534,009 B2 9/2013 Kay
8,573,882 B2 * 11/2013 Greer ..... G09F 7/12 40/594
8,870,367 B2 * 10/2014 Delmerico ..... B41J 2/0057 347/107
2002/0019312 A1 2/2002 Ramsden
2003/0015274 A1 8/2003 Arena et al.
2004/0032601 A1 * 2/2004 Ishii ..... H04N 1/62 358/1.9
2004/0151899 A1 8/2004 Sato et al.
2004/0253373 A1 12/2004 Langlois

(56) References Cited

U.S. PATENT DOCUMENTS

| | | | | |
|---|---|---|---|---|
| 2005/0013662 | A1 | 1/2005 | Provenzano | |
| 2005/0031415 | A1 | 2/2005 | Sippola | |
| 2005/0066623 | A1 | 3/2005 | Sippola | |
| 2005/0079330 | A1 | 4/2005 | Tanel | |
| 2005/0098086 | A1 | 5/2005 | Moore | |
| 2005/0265782 | A1 | 12/2005 | Everett | |
| 2006/0024132 | A1 | 2/2006 | Seman | |
| 2006/0039752 | A1 | 2/2006 | Hyams | |
| 2006/0157370 | A1 | 7/2006 | Thuesen | |
| 2006/0174567 | A1 | 8/2006 | Sippola | |
| 2006/0245827 | A1 | 11/2006 | Rydin | |
| 2006/0248762 | A1* | 11/2006 | Moore | G09B 21/003 40/584 |
| 2007/0201949 | A1 | 8/2007 | Veldboom et al. | |
| 2007/0224343 | A1 | 9/2007 | Langlois | |
| 2007/0258255 | A1 | 11/2007 | Kessler et al. | |
| 2007/0269264 | A1 | 11/2007 | Boghossian | |
| 2008/0008526 | A1 | 1/2008 | Boghossian | |
| 2008/0107481 | A1 | 5/2008 | Donald | |
| 2008/0132865 | A1 | 6/2008 | Li et al. | |
| 2008/0230941 | A1 | 9/2008 | Williamson | |
| 2008/0236064 | A1 | 10/2008 | Sippola | |
| 2008/0280097 | A1 | 11/2008 | Flaherty | |
| 2010/0129150 | A1 | 5/2010 | Sippola | |
| 2010/0186311 | A1 | 7/2010 | Jun | |
| 2010/0229783 | A1 | 9/2010 | Szekely | |
| 2010/0266782 | A1 | 10/2010 | Langlois | |
| 2010/0286644 | A1 | 11/2010 | Li et al. | |
| 2010/0313502 | A1 | 12/2010 | Flaherty | |
| 2011/0123769 | A1* | 5/2011 | Greer | G09F 7/12 428/143 |
| 2011/0179728 | A1 | 7/2011 | Cerny et al. | |
| 2011/0185961 | A1 | 8/2011 | Flaherty | |
| 2011/0311721 | A1 | 12/2011 | Langlois | |
| 2012/0076579 | A1 | 3/2012 | Flaherty et al. | |
| 2012/0207543 | A1 | 8/2012 | Sippola | |
| 2012/0272597 | A1 | 11/2012 | Hilburn, Jr. | |
| 2012/0275858 | A1 | 11/2012 | Szekely | |
| 2013/0212046 | A1 | 8/2013 | Henshue et al. | |
| 2013/0318844 | A1 | 12/2013 | Duhaime Ohnstad | |

FOREIGN PATENT DOCUMENTS

| | | |
|---|---|---|
| JP | 58-86205 | 5/1983 |
| JP | 62-276109 | 12/1987 |
| JP | 3102796 | 4/2004 |
| JP | 2007-126927 | 5/2007 |
| JP | 2007-262657 | 10/2007 |
| JP | 2008-299075 | 12/2008 |
| WO | 03/12767 A1 | 2/2003 |
| WO | 2013/050883 | 4/2013 |

OTHER PUBLICATIONS

Supplementary Partial European Search Report, EP Patent Application No. 13747308.8, dated Sep. 11, 2015, six pages.

International Search Report and Written Opinion, International Patent Application No. PCT/US2015/021281, dated Jun. 23, 2015.

Supplementary European Search Report, EP Patent Application No. 13747308.8, dated Jan. 28, 2016.

Chinese Search Report, Chinese Patent Application No. 201380008558.8, dated Mar. 3, 2016.

Request for Ex Parte Reexamination of U.S. Pat. No. 9,361,816, filed Dec. 22, 2016.

Order Granting Request for Ex Parte Reexamination of U.S. Pat. No. 9,361,816, mailed Feb. 8, 2017.

Office Action in Ex Parte Reexamination, U.S. Pat. No. 9,361,816, dated Aug. 1, 2017.

Response to Office Action in Ex Parte Reexamination, U.S. Pat. No. 9,361,816, filed Sep. 29, 2017.

Ex Parte Reexamination Certificate, U.S. Pat. No. 9,361,816, issued Dec. 22, 2017.

* cited by examiner

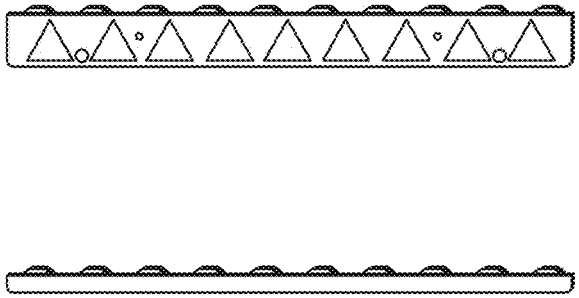
FIG. 6C
FIG. 6B
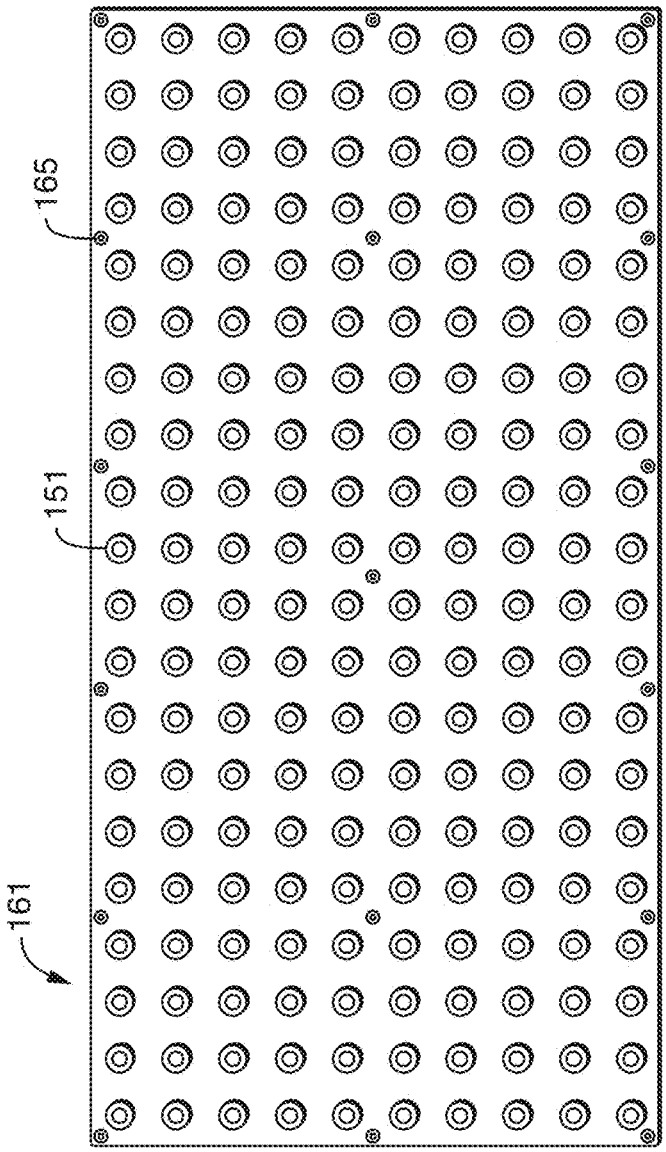
FIG. 6A
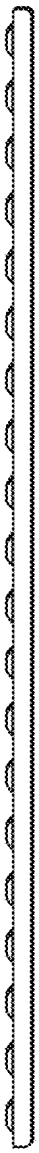
FIG. 6D
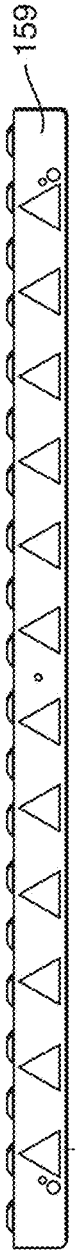
FIG. 6E

DECORATIVE DETECTABLE WARNING PANEL HAVING IMPROVED GRIP

CROSS REFERENCE TO RELATED APPLICATIONS

The present invention is a continuation of U.S. patent application Ser. No. 14/967,630, which is a continuation of U.S. patent application Ser. No. 13/764,327, filed Feb. 11, 2013, now U.S. Pat. No. 9,311,831, which claims the benefit of the U.S. Provisional Application 61/596,940, filed Feb. 9, 2012, each of which are herein incorporated by reference in its entirety.

FIELD OF THE INVENTION

The present invention relates to detectable warning panels, and in particular to detectable warning panels that display text and/or other graphic information such as commercial messages, trademarks, logos, directions, slogans, pictures, names, product illustrations, emblems, promotional information related to a product or service, Quick Response Codes, matrix code, two-dimensional bar code, optical machine-readable labels, and combinations thereof.

BACKGROUND OF THE INVENTION

In the field of outdoor advertising, it is an ongoing challenge to expand existing and identify new venues of advertising, especially utilizing advanced media technology. The subject of such advertising may range from purely commercial messages, trademarks, logos, and the like to public service messages, directions, and warnings. Virtually any surface in the public environment may become a backdrop for affixing or decorating an advertising display. The backdrop may be natural such as trees, or rock formations; or artificial such as the exterior walls of buildings or bridges, the familiar billboard, free-standing signs, and postings in store windows. There are companies that specialize in advertising at points where people congregate such as outdoor bus shelters, train shelters and other street "furniture", but also serve a public comfort and safety purpose.

One interesting and novel illustration of such dual purpose structures is disclosed in U.S. Pat. Nos. 6,481,921 and 6,692182, and relates to an ordinary concrete parking curb barrier. The invention is a curb cover that fits over and conforms to the shape of the barrier. The surface of the cover is decorated with advertising, so the structure provides both alignment control of vehicles in a parking area, and also a message visible to the driver when the vehicle pulls into the parking space. U.S. Pat. No. 7,215,300 discloses a satellite dish cover having the dual function of protecting the inner surface of the dish from damage by the elements; and a design element that has enumerated images having functional or ornamental value. A third example of such dual purpose devices is a railing cover disclosed in U.S. Pat. No. 6,775,937. The rail cover is made of a releasably attachable wrap-around skin bearing advertising on the outer surface, thus providing both hand support and product or service information.

Some advertising vehicles are characterized as a "system" and usually have multiple components organized according to a common theme, pattern, or methodology. U.S. Pat. No. 6,769,530 discloses a series of advertising elements printed on conveyor belting. Belts can be fabricated shorter than the entire belt and adapted for exchange of individual advertising panels without replacing the entire belt. U.S. Pat. No. 7,051,465 discloses a dual panel set attached essentially in parallel orientation to two doors that comprise the entry of the cargo bay at the rear of a truck. The invention provides a plurality of spacers that align the advertising display in parallel configuration. In U.S. Pat. No. 7,631,450, special frame assemblies are disclosed which enable attachment of a plurality of advertising panels that are adapted to the round cornered of movable enclosures such as portable toilets, waste bins, trailers and other portable accommodations used by a substantial number of persons on a temporary basis.

Another type of outdoor or indoor fixture in common public use are detectable warning panels mandated in the U.S. under 42 USC 12101 et seq., as amended, and regulations promulgated thereunder; or tactile walking surface indicators ("TWSI"), ISO 23599 international. The purpose of these fixtures is to safeguard individuals with impaired vision against hazards in public places and pedestrian walkways. In the United States fixtures are characterized as square or rectangular panels mounted on walkways at points of hazard like street intersections and passenger access zones to public transportation. These are generically referred to as detectable warning panels or detectable warning surfaces. Another type of panel, prevalent outside the United States, in Europe and elsewhere, is a guiding panel comprising elongated raised bars oriented parallel to the direction of travel along a pathway to guide a person from one point on a walking surface to another. One variation of such guide panel is described in U.S. Pat. No. 8,082,872 and U.S. Pat. No. 6,964,244.

Typically, the panels are made of metal or other materials affixed to a concrete or paved surface, and bear a plurality of raised features detectable by tactile sensation such as contact with shoes or a cane. Within the scope of applicable regulations, there is considerable latitude in the shape, size, and spacing of such raised features. US Patent application 2006/0039752 discloses a warning panel having raised features containing an array of circular truncated hemispheres. Most variations of raised features are truncated domes in configuration, as illustrated in U.S. Pat. No. 6,960,989. Another variation is the use of set pins inserted into a pre-drilled hole in a concrete walkway, and then bonded to the holes, as disclosed in U.S. Pat. No. 6,971,818. U.S. Pat. No. 4,715,743 discloses rounded domes on multiple tiles with expansion joints between contiguous tiles. U.S. Pat. No. 5,271,690 and U.S. Pat. No. 7,189,025 show six sided elevated domes with dimples in the centers thereof.

While most detectable warning and guide panels are constructed sturdily, over time they can be expected to show wear and tear and to incur surface damage requiring replacement. Snowplows are particularly destructive. Several examples exist of lower frame panels forming a base that is embedded in the concrete or paving walkway when it is laid. The walking surface is a top removable panel positioned over and is attachably fit into or on the base panel. Examples are shown in US Patent application 2010/0129150. Another embodiment of a replaceable panel is disclosed in U.S. Pat. No. 7,779,581 that has anchor means for fast removal and replacement of the panel.

The rules governing the coloring of panels specify only that they provide a discernible contrast to the color of the surrounding walkway. In the case of cast iron, the panel may be left bare because cast iron rusts and thus provides a natural reddish brown hue. For stainless steel and other materials, solid colors are typically chosen. Most common are solid red and yellow; yellow selected because it is the last wavelength of color to fade for persons with impaired vision.

SUMMARY OF THE INVENTION

The present invention provides a new advertising venue by utilizing a warning or guidance panel in a public setting heretofore having only a single dedicated purpose. In the United States and many other countries, detectable warning and guide panels are employed to provide a warning or directional signal to persons with impaired vision. These panels of a few square feet are placed in or on a walkway at predetermined locations to apprise persons of nearby impending hazards such as intersections, curbs, the edge of transportation platforms, and the like. Typically, such panels are attached to the walkway surface or embedded in it. The upper substantially planar surface of a panel has on its upper surface spatially raised features arranged in an attention pattern or array as to be detectable by tactile sensation through a cane, shoes, or a wheeled vehicle. In preferred embodiments, the panel further comprises a graphic design displaying at least two, three, four or more colors on the upper surface, which in preferred embodiments is a substrate for acceptance of two, three, four or more dyes or pigments. Thus, the article of the invention now has a dual purpose, to provide warning or guidance to the vision impaired as with conventional panels, and a graphic message for those who are visually competent. Accordingly, in preferred embodiments, the present invention provides detectable guidance panels that display text and/or other graphic information such as commercial messages, trademarks, logos, directions, slogans, pictures, names, product illustrations, emblems, promotional information related to a product or service, Quick Response Codes, matrix code, two-dimensional bar code, optical machine-readable labels, and combinations thereof.

The panels of the present invention may be formed from a metal, polymeric materials, concrete, brick, natural stone, ceramic, tiles or composites. The surface of the substrate can be made slip resistant and more durable by inclusion in or by coating of various polymeric or inorganic particles to increase frictional resistance between pedestrian feet and the walking surface of the panel. In construction of the panel, a metal substrate may be cast iron, ductile iron, stainless steel, aluminum, and alloys. Suitable polymeric materials may be a plastic, thermoset plastic, thermoplastic, a plastic composite, fiber composite or fiber entrained plastic impregnated with carbon nanotubes, carbon black, graphite, or combinations thereof. To hold it in place, the panel is preferably removably attached to the ground undersurface by a fastener, or it may be embedded directly into the undersurface itself. Optionally, the graphic design includes a Quick Response Code, or other readable code.

In preferred embodiments, the panel article has spatially raised features. Warning type panels (attention pattern) generally are rounded dome structures protruding upward from the surface of the substrate panel as dictated by the laws, rules, and regulations of local jurisdiction, which will specify their size, shape, height, and spacing. They are usually some variation of truncated round dome or cone arranged in an attention pattern or array.

Another category of spatially raised features is guiding indicators (guiding pattern), generally comprising three-dimensional parallel flat-topped elongated bars or sinusoidal ribs. These bars or ribs are installed in an array at right angles to the direction of travel at either the sides of a walkway or along its center. A person with impaired vision carrying a cane detects the guidance bars or ribs by a sweeping action across the bars or ribs with the cane. Guidance indicators are more commonly used outside the United States.

The article for display on a pedestrian walkway can be an electrically conductive substrate (e.g., panel) having a substrate body having the above characteristic raised features, which is powder coated with a plastic powder coat layer. The plastic is preferably of the type penetrable by dyes and is sufficiently porous to dyes absorbed at the surface. A conductive substrate is needed in powder coating processes, because a positively charged uncured plastics precursors are attracted and adhere to an electrically grounded metallic substrate. The substrate so prepared is then suffused with dyes forming a graphic design comprising at least two colors. Such graphic design may be a logo, slogan, lettering, pictures, names, product illustrations, emblems, promotional information related to a product or service, directions, and symbols; in fact, any image that imparts at least one meaning separate and distinct from the information obtained by tactile sensation, and, may not relate to safety issues at all. The article so decorated may also have additional properties such as slip resistance circularity of the truncated domes and cones arranged in an array, etc.

Articles intended for display and functional warning or guidance on a walkway may further have a succession of powder coat layers on an electrically conductive substrate. The first layer may already contain dye, pigment, or paint particles dispersed uniformly throughout the powder coat layer to provide a base color extending across the entire upper surface of the panel article. Additional permeable powder coat layers may be successively applied onto the first powder coat layer, each such layer being successively suffused with dyes to impart a composite graphic design. The panel may be optionally be imbued with slip resistance, Quick Response Code, and the like.

Nevertheless, it is possible to render a non-conductive substrate sufficiently conductible to support a powder coating process. The matrix of the substrate may incorporate a conductive substance. This has been demonstrated for carbon black, carbon nanotubes, graphite, or combinations thereof. A conductive primer may also be painted onto the surface of the substrate. One such primer that is available commercially is Spraylat's conductive coating technology.

Notwithstanding the foregoing, present inventors have discovered that sublimation dyes may be directly heat transferred into a thermoset polyester-based composite not first utilizing a powder coat layer. The composite is Sheet Molding Compound. There are polyester-based polymers containing about 20-55% glass fiber or shards. In the present invention, a molded substrate composed of having an array of a plurality of spatially raised features arranged in an attention pattern or array is sublimation dye permeable. The dye is heat transferred to the substrate to display a graphic design. However, it is apparent that this Sheet Molding Compound can readily be molded into a great variety of articles of widely varying shapes and sizes, which then can be decorated directly by dye sublimation.

Accordingly, in some embodiments the present invention provides an article for display on a pedestrian walkway comprising a panel having a substantially planar upper and lower surface, the upper surface having thereon a plurality of spatially raised features arranged in a pattern so as to be detectable by tactile sensation the planar upper surface further comprising a graphic design displaying or comprising at least two, three, four, five, six, seven, eight, nine or ten colors, and preferably from 2 to 10, 3 to 10, 4 to 10, 5 to 10, 2 to 20, 3 to 20, 4 to 20, or 5 to 20 colors. In some embodiments, the colors are different primary colors. In some embodiments, the colors are different shades of the same color. In some embodiments, the colors are different shades of the same color. In some embodiments, the graphic design has a resolution of 300×300 dots per inch (DPI), and preferably has a resolution of at least about or equal to 720×720 DPI, and up to about 1440×720 DPI or 1440×1440 DPI. In some embodiments, the graphic design is a high resolution sublimated graphic design comprising sublimation dyes, preferably at least two, three, four, five, six, seven, eight, nine or ten sublimation dyes, and preferably from 2 to 10, 3 to 10, 4 to 10, 5 to 10, 2 to 20, 3 to 20, 4 to 20, or 5 to 20 sublimation dyes. In some embodiments, the sublimation dyes penetrate the upper surface to about 10 to 200 micrometers, preferably to about 20 to 100 micrometers, and most preferably to about 40-80 micrometers, preferably providing a high resolution graphic design that is scratch and/or scuff-resistant. In some embodiments, the graphic design conveys information about a product, business, or service. In some embodiments, the upper planar surface is textured to provide slip resistance and durability. In some embodiments, the panel comprises a material selected from the group consisting of metal, polymeric materials, concrete, bricks, natural stone, ceramic, tiles, and combinations thereof. In some embodiments, the metal is selected from the group consisting of cast iron, ductile iron, steel, aluminum, and alloys thereof. In some embodiments, the polymeric material is selected from the group consisting of a plastic, thermoset plastic, thermoplastic, plastic composite, and fiber entrained plastic impregnated with carbon nanotubes, carbon black, or combinations thereof. In some embodiments, the article is removably attachable to a ground surface at a predetermined position in or in substantially viewable proximity to a pedestrian walkway. In some embodiments, the article is securely anchored by a fastener or embedded directly into an undersurface. In some embodiments, the graphic design includes a Quick Response Code, matrix code, two-dimensional bar code, optical machine-readable labels, or other readable code. In some embodiments, the spatially raised features comprise an attention pattern with a plurality of raised truncated domes or cones. In some embodiments, the raised truncated domes or cones are circular. In some embodiments, the truncated domes or cones are arranged in an array. In some embodiments, the spatially raised features comprise a guiding pattern with a plurality of raised bars. In some embodiments, the raised bars are parallel flat-topped elongated bars or sinusoidal ribs. In some embodiments, the raised bars are arranged in an array. In some embodiments, the graphic design is selected from the group consisting of a logo, slogan, lettering, pictures, names, product illustrations, emblems, promotional information related to a product or service, directions and symbols.

In further embodiments, the present invention provides an article for display on a pedestrian walkway compliant with the regulations of local jurisdiction, comprising an electrically conductive substrate having a substrate body having spatially raised features arranged in a pattern so as to be detectable by tactile sensation; and a dye permeable powder coated layer deposited on the upper surface of the substrate. In some embodiments, the dye permeable powder coated layer comprises one or more texturizing components. In some embodiments, the powder coated layer is suffused with dye forming a graphic design comprising at least two colors. In some embodiments, the graphic design displays or comprises at least two, three, four, five, six, seven, eight, nine or ten colors, and preferably from 2 to 10, 3 to 10, 4 to 10, 5 to 10, 2 to 20, 3 to 20, 4 to 20, or 5 to 20 colors. In some embodiments, the colors are different primary colors. In some embodiments, the colors are different shades of the same color. In some embodiments, the graphic design has a resolution of 300×300 dots per inch (DPI), and preferably has a resolution of at least about or equal to 720×720 DPI, and up to about 1440×720 DPI or 1440×1440 DPI. In some embodiments, the graphic design is a high resolution sublimated graphic design comprising sublimation dyes, preferably at least two, three, four, five, six, seven, eight, nine or ten sublimation dyes, and preferably from 2 to 10, 3 to 10, 4 to 10, 5 to 10, 2 to 20, 3 to 20, 4 to 20, or 5 to 20 sublimation dyes. In some embodiments, the sublimation dyes penetrate the upper surface to about 10 to 200 micrometers, preferably to about 20 to 100 micrometers, and most preferably to about 40-80 micrometers, preferably providing a high resolution graphic design that is scratch and/or scuff-resistant. In some embodiments, the graphic design conveys information about a product, business, or service. In some embodiments, the upper planar surface is textured to provide slip resistance and durability. In some embodiments, the graphic design includes a Quick Response Code, matrix code, two-dimensional bar code, optical machine-readable labels, or other readable code. In some embodiments, the spatially raised features comprise an attention pattern with a plurality of raised truncated domes or cones. In some embodiments, the raised truncated domes or cones are circular. In some embodiments, the truncated domes or cones are arranged in an array. In some embodiments, the spatially raised features comprise a guiding pattern with a plurality of raised bars. In some embodiments, the raised bars are parallel flat-topped elongated bars or sinusoidal ribs. In some embodiments, the raised bars are arranged in an array. In some embodiments, the graphic design is selected from the group consisting of a logo, slogan, lettering, pictures, names, product illustrations, emblems, promotional information related to a product or service, directions and symbols.

In some embodiments, the present invention provides an article for display on a pedestrian walkway compliant with the regulations of local jurisdiction, comprising an electrically conductive substrate having a substrate body with an upper and lower surface having spatially raised features arranged in a pattern so as to be detectable by tactile sensation, a first powder coat layer containing particles of a pigment or a dye providing a base color to the entire upper surface of the substrate body; and at least one additional dye permeable powder coat layers deposited successively onto the first powder coat layer, each such layer being successively suffused with one or dyes in a pattern to impart a graphic design. In some embodiments, each or any of the layers contains texturizing components to provide slip resistance and durability. In some embodiments, the graphic design displays or comprises at least two, three, four, five, six, seven, eight, nine or ten colors, and preferably from 2 to 10, 3 to 10, 4 to 10, 5 to 10, 2 to 20, 3 to 20, 4 to 20, or 5 to 20 colors. In some embodiments, the colors are different primary colors. In some embodiments, the colors are different shades of the same color. In some embodiments, the graphic design is a high resolution sublimated graphic design comprising sublimation dyes, preferably at least two, three, four, five, six, seven, eight, nine or ten sublimation dyes, and preferably from 2 to 10, 3 to 10, 4 to 10, 5 to 10, 2 to 20, 3 to 20, 4 to 20, or 5 to 20 sublimation dyes. In some embodiments, the sublimation dyes penetrate the upper surface to about 10 to 200 micrometers, preferably to about 20 to 100 micrometers, and most preferably to about 40-80 micrometers, preferably providing a high resolution graphic design that is scratch and/or scuff-resistant. In some embodiments, the graphic design has a resolution of 300×300 dots per inch (DPI), and preferably has a resolution of at least about or equal to 720×720 DPI, and up to about 1440×720 DPI or 1440×1440 DPI. In some embodiments, the graphic design conveys information about a product, business, or service. In some embodiments, the graphic design includes a Quick Response Code, matrix code, two-dimensional bar code, optical machine-readable labels, or other readable code. In some embodiments, the spatially raised features comprise an attention pattern with a plurality of raised truncated domes or cones. In some embodiments, the raised truncated domes or cones are circular. In some embodiments, the truncated domes or cones are arranged in an array. In some embodiments, the spatially raised features comprise a guiding pattern with a plurality of raised bars. In some embodiments, the raised bars are parallel flat-topped elongated bars or sinusoidal ribs. In some embodiments, the raised bars are arranged in an array. In some embodiments, the graphic design is selected from the group consisting of a logo, slogan, lettering, pictures, names, product illustrations, emblems, promotional information related to a product or service, directions and symbols.

In some embodiments, the present invention provides an electrically non-conductive polyester-based article for use as a detectable warning or guide panel for display on a pedestrian walkway comprising a compression molded substrate having a substantially planar upper and lower surface, containing on the upper surface a plurality of spatially raised features and arranged in a pattern compliant with the regulations of local jurisdiction for such panels; and further comprising a non-conductive thermoset polyester-based polymer, known in the Art as Sheet Molding Compound, which is dye permeable, and decoratable by a graphic design sublimated directly into the upper surface of the molded Sheet Molding Compound; and a graphic design displaying colors on the upper surface of the molded substrate. In some embodiments, the non-conductive polyester polymer is further characterized in having a glass content of 15-60 percent by weight. In some embodiments, the graphic design displays or comprises at least two, three, four, five, six, seven, eight, nine or ten colors, and preferably from 2 to 10, 3 to 10, 4 to 10, 5 to 10, 2 to 20, 3 to 20, 4 to 20, or 5 to 20 colors. In some embodiments, the colors are different primary colors. In some embodiments, the colors are different shades of the same color. In some embodiments, the graphic design has a resolution of 300×300 dots per inch (DPI), and preferably has a resolution of at least about or equal to 720×720 DPI, and up to about 1440×720 DPI or 1440×1440 DPI. In some embodiments, the graphic design is a high resolution sublimated graphic design comprising sublimation dyes, preferably at least two, three, four, five, six, seven, eight, nine or ten sublimation dyes, and preferably from 2 to 10, 3 to 10, 4 to 10, 5 to 10, 2 to 20, 3 to 20, 4 to 20, or 5 to 20 sublimation dyes. In some embodiments, the sublimation dyes penetrate the upper surface to about 10 to 200 micrometers, preferably to about 20 to 100 micrometers, and most preferably to about 40-80 micrometers, preferably providing a high resolution graphic design that is scratch and/or scuff-resistant. In some embodiments, the graphic design conveys information about a product, business, or service. In some embodiments, the graphic design includes a Quick Response Code, matrix code, two-dimensional bar code, optical machine-readable labels, or other readable code. In some embodiments, the spatially raised features comprise an attention pattern with a plurality of raised truncated domes or cones. In some embodiments, the raised truncated domes or cones are circular. In some embodiments, the truncated domes or cones are arranged in an array. In some embodiments, the spatially raised features comprise a guiding pattern with a plurality of raised bars. In some embodiments, the raised bars are parallel flat-topped elongated bars or sinusoidal ribs. In some embodiments, the raised bars are arranged in an array. In some embodiments, the graphic design is selected from the group consisting of a logo, slogan, lettering, pictures, names, product illustrations, emblems, promotional information related to a product or service, directions and symbols. In some embodiments, the molded substrate further comprises a powder coat layer on at least the upper surface, the powder coat layer is preferably applied by in-mold powder coating.

In some embodiments, the present invention provides an electrically non-conductive article for use as a detectable warning or guide panel for display on a pedestrian walkway made conductive by inclusion therein or thereon of a conductive substance. In some embodiments, the conductive substance is a carbon nanotube, carbon black, a graphite, or combinations thereof. In some embodiments, the conductive substance is a primer liquid paint.

The present invention also provides an advertising system which comprises one or more detectable warning or guide panels having raised features arranged in a pattern or array and positioned in a pedestrian walkway in compliance with regulations of local jurisdiction. In addition, the systems comprise one or more decorated satellite panels (in preferred embodiments flat and without raised features), arranged on the walkway contiguous to or in viewable proximity to the warning or guide panel. "Viewable" means that the motif is taken into view as a grouping or cluster often following a theme. An example is a group of flat panels depicting categories of goods or services available from a nearby or adjacent store. The focal point of the motif is the attention panel, which itself may be decorated.

The present invention further provides methods comprising placing one or more detectable warning panels at a pre-determined position on a pedestrian walkway in compliance with the regulations of local jurisdiction, and causing a graphic design to be displayed thereon. As an advertising method, the graphic content of the attention panel is coordinated with information displayed on one or a plurality of flat satellite panels to provide an advertising campaign for a business, service, or product. The instant method also includes displaying different advertising relating to a business service or product after a time period of, say, one week, two weeks, one month, and other intervals of time. The advertising method further provides for leasing the space for one or more flat panels to be displayed on a pedestrian walkway.

A further advertising method comprises displaying one or more flat satellite panels with graphic designs arranged spatially contiguous to or in viewable proximity to a warning or guide panel having raised features and positioned in a pedestrian walkway compliant with the regulations of local jurisdiction. One or more satellite panels may also be positioned on a walkway at a viewably remote location. The advertising system in which one or a plurality of satellite panels decorated with graphic designs configured to be spatially contiguous or viewably remote from a warning, directional, or guide panel. An example is a warning or guide panel bearing a graphic design advertising a product group and a reminder panel or panels at a remote site or sites repeating a word or symbol contained in the graphic design of the warning or guide panel. This configuration will be most effective if the remote panels are placed within the expected pathway of pedestrian travel.

In some embodiments, the present invention provides an advertising system comprising one or more detectable warning or guide panels having raised features and positioned in a pedestrian walkway compliant with the regulations of local jurisdiction; and one or a plurality more of satellite panels decorated with graphic designs arranged spatially contiguous to or in viewable proximity to the warning or guide panel. In some embodiments, the graphic designs display or comprises at least two, three, four, five, six, seven, eight, nine or ten colors, and preferably from 2 to 10, 3 to 10, 4 to 10, 5 to 10, 2 to 20, 3 to 20, 4 to 20, or 5 to 20 colors. In some embodiments, the colors are different primary colors. In some embodiments, the colors are different shades of the same color. In some embodiments, the graphic design has a resolution of 300×300 dots per inch (DPI), and preferably has a resolution of at least about or equal to 720×720 DPI, and up to about 1440×720 DPI or 1440×1440 DPI. In some embodiments, the graphic design is a high resolution sublimated graphic design comprising sublimation dyes, preferably at least two, three, four, five, six, seven, eight, nine or ten sublimation dyes, and preferably from 2 to 10, 3 to 10, 4 to 10, 5 to 10, 2 to 20, 3 to 20, 4 to 20, or 5 to 20 sublimation dyes. In some embodiments, the sublimation dyes penetrate the upper surface to about 10 to 200 micrometers, preferably to about 20 to 100 micrometers, and most preferably to about 40-80 micrometers, preferably providing a high resolution graphic design that is scratch and/or scuff-resistant. In some embodiments, the graphic designs convey information about a product, business, or service. In some embodiments, the satellite panels include one or more Quick Response Codes, matrix code, two-dimensional bar code, optical machine-readable labels, or other readable code. In some embodiments, the spatially raised features comprise an attention pattern with a plurality of raised truncated domes or cones. In some embodiments, the raised truncated domes or cones are circular. In some embodiments, the truncated domes or cones are arranged in an array. In some embodiments, the spatially raised features comprise a guiding pattern with a plurality of raised bars. In some embodiments, the raised bars are parallel flat-topped elongated bars or sinusoidal ribs. In some embodiments, the raised bars are arranged in an array. In some embodiments, the graphic design is selected from the group consisting of a logo, slogan, lettering, pictures, names, product illustrations, emblems, promotional information related to a product or service, and symbols.

In some embodiments, the present invention provides methods comprising: displaying one or more first articles at a predetermined position on a pedestrian walkway, the one or more first articles having a substantially planar upper and lower surface, having on the upper surface a plurality of spatially raised features arranged in a pattern so as to be detectable by tactile sensation, the planar upper surface further comprising a graphic design displaying at least two colors. In some embodiments, the graphic design displays or comprises at least two, three, four, five, six, seven, eight, nine or ten colors, and preferably from 2 to 10, 3 to 10, 4 to 10, 5 to 10, 2 to 20, 3 to 20, 4 to 20, or 5 to 20 colors. In some embodiments, the colors are different primary colors. In some embodiments, the colors are different shades of the same color. In some embodiments, the graphic design has a resolution of 300×300 dots per inch (DPI), and preferably has a resolution of at least about or equal to 720×720 DPI, and up to about 1440×720 DPI or 1440×1440 DPI. In some embodiments, the graphic design is a high resolution sublimated graphic design comprising sublimation dyes, preferably at least two, three, four, five, six, seven, eight, nine or ten sublimation dyes, and preferably from 2 to 10, 3 to 10, 4 to 10, 5 to 10, 2 to 20, 3 to 20, 4 to 20, or 5 to 20 sublimation dyes. In some embodiments, the sublimation dyes penetrate the upper surface to about 10 to 200 micrometers, preferably to about 20 to 100 micrometers, and most preferably to about 40-80 micrometers, preferably providing a high resolution graphic design that is scratch and/or scuff-resistant. In some embodiments, the graphic design conveys information about a product, business, or service. In some embodiments, the article is removably attached to the defined position. In some embodiments, the methods further comprise affixing a plurality of the articles to a plurality of predetermined positions. In some embodiments, the first article is replaced with a second article after a period of time selected from the group consisting of at least one week, two weeks, three weeks, one month, two months, three months, six months and one year. In some embodiments, the upper planar surface is textured to provide slip resistance and durability. In some embodiments, the article comprises a material selected from the group consisting of metal, polymeric materials, concrete, bricks, natural stone, ceramic, and tiles. In some embodiments, the metal is selected from the group consisting of cast iron, ductile iron, steel, aluminum, and alloys thereof. In some embodiments, the polymeric material is selected from the group consisting of a plastic, thermoset plastic, thermoplastic, plastic composite, and fiber entrained plastic impregnated with carbon nanotubes, carbon black, or combinations thereof. In some embodiments, the article is removably attachable to a ground surface at a predetermined position in or in substantially viewable proximity to a pedestrian walkway. In some embodiments, the article is securely anchored by a fastener or embedded directly into an undersurface. In some embodiments, the graphic design includes a Quick Response Code, matrix code, two-dimensional bar code, optical machine-readable labels, or other readable code. In some embodiments, the spatially raised features comprise an attention pattern with a plurality of raised truncated domes or cones. In some embodiments, the raised truncated domes or cones are circular. In some embodiments, the truncated domes or cones are arranged in an array. In some embodiments, the spatially raised features comprise a guiding pattern with a plurality of raised bars. In some embodiments, the raised bars are parallel flat-topped elongated bars or sinusoidal ribs. In some embodiments, the raised bars are arranged in an array. In some embodiments, the graphic design is selected from the group consisting of a logo, slogan, lettering, pictures, names, product illustrations, emblems, promotional information related to a product or service, directions and symbols. In some embodiments, the methods further comprise displaying the articles in conjunction with a coordinated advertisement campaign comprising providing the information on the product, business or service in a different advertising media selected from the group consisting of print media such as magazines and paper, electronic media such as the internet (world wide web), radio advertisements, televisions commercials, in-store advertising media and outdoor advertising media such as billboards, posters, kiosks, placards, street furniture such as bus shelters, newsstands, newsracks, bicycle racks, transit media such as displays in bus stations, train stations and airports, mobile billboards, bus wraps, taxicabs, bus interiors, and alternative media.

In some embodiments, the present invention provides advertising methods comprising: displaying a plurality of or one or more panels at predetermined positions on pedestrian walkways, each panel having a substantially planar upper and lower surface, the upper surface of each article panel having thereon a plurality of spatially raised features arranged in a pattern so as to be detectable by tactile sensation, the planar upper surface of each article panel further comprising a graphic design displaying at least two colors, wherein the graphic designs on the plurality of articles panels provide a coordinated advertising campaign for a business, service, or product. In some embodiments, the methods further comprise replacing a plurality of the panels with panels displaying different advertising related to the business service or product after a time period selected from the group consisting of at least one week, two weeks, three weeks, one month, two months, three months, six months and one year. In some embodiments, the graphic design displays or comprises at least two, three, four, five, six, seven, eight, nine or ten colors, and preferably from 2 to 10, 3 to 10, 4 to 10, 5 to 10, 2 to 20, 3 to 20, 4 to 20, or 5 to 20 colors. In some embodiments, the colors are different primary colors. In some embodiments, the colors are different shades of the same color. In some embodiments, the graphic design has a resolution of 300×300 dots per inch (DPI), and preferably has a resolution of at least about or equal to 720×720 DPI, and up to about 1440×720 DPI or 1440×1440 DPI. In some embodiments, the graphic design is a high resolution sublimated graphic design comprising sublimation dyes, preferably at least two, three, four, five, six, seven, eight, nine or ten sublimation dyes, and preferably from 2 to 10, 3 to 10, 4 to 10, 5 to 10, 2 to 20, 3 to 20, 4 to 20, or 5 to 20 sublimation dyes. In some embodiments, the sublimation dyes penetrate the upper surface to about 10 to 200 micrometers, preferably to about 20 to 100 micrometers, and most preferably to about 40-80 micrometers, preferably providing a high resolution graphic design that is scratch and/or scuff-resistant. In some embodiments, the graphic design conveys information about a product, business, or service. In some embodiments, the panel is removably attached to the defined position. In some embodiments, the graphic design includes a Quick Response Code, matrix code, two-dimensional bar code, optical machine-readable labels, or other readable code. In some embodiments, the raised bars are arranged in an array. In some embodiments, the graphic design is selected from the group consisting of a logo, slogan, lettering, pictures, names, product illustrations, emblems, promotional information related to a product or service, directions and symbols. In some embodiments, the methods further comprise displaying the panels in conjunction with a coordinated advertisement campaign comprising providing the information on the product, business or service in a different advertising media selected from the group consisting of print media such as magazines and paper, electronic media such as the internet (world wide web), radio advertisements, televisions commercials, in-store advertising media and outdoor advertising media such as billboards, posters, kiosks, placards, street furniture such as bus shelters, newsstands, newsracks, bicycle racks, transit media such as displays in bus stations, train stations and airports, mobile billboards, bus wraps, taxicabs, bus interiors, and alternative media.

In some embodiments, the present invention provides methods of providing advertising for a business, product or service comprising: leasing one or more spaces on one or more pedestrian walkways for display of advertisements relating to the business, product or service; displaying the advertisements on one or more panels comprising a substrate having a substantially planar upper and lower surface, the upper surface having thereon a plurality of spatially raised features arranged in a pattern so as to be detectable by tactile sensation, the planar upper surface further comprising the advertisement. In some embodiments, the panels are replaced with articles displaying advertising for the same or a different business, product or service after a time period selected from the group consisting of at least one week, two weeks, three weeks, one month, two months, three months, six months and one year. In some embodiments, the graphic design displays or comprises at least two, three, four, five, six, seven, eight, nine or ten colors, and preferably from 2 to 10, 3 to 10, 4 to 10, 5 to 10, 2 to 20, 3 to 20, 4 to 20, or 5 to 20 colors. In some embodiments, the colors are different primary colors. In some embodiments, the colors are different shades of the same color. In some embodiments, the graphic design has a resolution of 300×300 dots per inch (DPI), and preferably has a resolution of at least about or equal to 720×720 DPI, and up to about 1440×720 DPI or 1440×1440 DPI. In some embodiments, the graphic design is a high resolution sublimated graphic design comprising sublimation dyes, preferably at least two, three, four, five, six, seven, eight, nine or ten sublimation dyes, and preferably from 2 to 10, 3 to 10, 4 to 10, 5 to 10, 2 to 20, 3 to 20, 4 to 20, or 5 to 20 sublimation dyes. In some embodiments, the sublimation dyes penetrate the upper surface to about 10 to 200 micrometers, preferably to about 20 to 100 micrometers, and most preferably to about 40-80 micrometers, preferably providing a high resolution graphic design that is scratch and/or scuff-resistant. In some embodiments, the graphic design conveys information about a product, business, or service. In some embodiments, the article is removably attached to the defined position. In some embodiments, the graphic design includes a Quick Response Code, matrix code, two-dimensional bar code, optical machine-readable labels, or other readable code. In some embodiments, the raised bars are arranged in an array. In some embodiments, the graphic design is selected from the group consisting of a logo, slogan, lettering, pictures, names, product illustrations, emblems, promotional information related to a product or service, directions and symbols. In some embodiments, the methods further comprise displaying the panels in conjunction with a coordinated advertisement campaign comprising providing the information on the product, business or service in a different advertising media selected from the group consisting of print media such as magazines and paper, electronic media such as the internet (world wide web), radio advertisements, televisions commercials, in-store advertising media and outdoor advertising media such as billboards, posters, kiosks, placards, street furniture such as bus shelters, newsstands, newsracks, bicycle racks, transit media such as displays in bus stations, train stations and airports, mobile billboards, bus wraps, taxicabs, bus interiors, and alternative media.

In some embodiments, the present invention provides an advertising system comprising one or more or a plurality of panels, each panel having a substantially planar upper and lower surface, the upper surface of each article panel having thereon a plurality of spatially raised features arranged in a pattern so as to be detectable by tactile sensation, the planar upper surface of each article panel further comprising a graphic design displaying at least two colors, wherein the graphic designs on the plurality of articles panels provide a coordinated advertising campaign related to a business, service, or product. In some embodiments, the graphic design displays or comprises at least two, three, four, five, six, seven, eight, nine or ten colors, and preferably from 2 to 10, 3 to 10, 4 to 10, 5 to 10, 2 to 20, 3 to 20, 4 to 20, or 5 to 20 colors. In some embodiments, the colors are different primary colors. In some embodiments, the colors are different shades of the same color. In some embodiments, the graphic design has a resolution of 300×300 dots per inch (DPI), and preferably has a resolution of at least about or equal to 720×720 DPI, and up to about 1440×720 DPI or 1440×1440 DPI. In some embodiments, the graphic design is a high resolution sublimated graphic design comprising sublimation dyes, preferably at least two, three, four, five, six, seven, eight, nine or ten sublimation dyes, and preferably from 2 to 10, 3 to 10, 4 to 10, 5 to 10, 2 to 20, 3 to 20, 4 to 20, or 5 to 20 sublimation dyes. In some embodiments, the sublimation dyes penetrate the upper surface to about 10 to 200 micrometers, preferably to about 20 to 100 micrometers, and most preferably to about 40-80 micrometers, preferably providing a high resolution graphic design that is scratch and/or scuff-resistant. In some embodiments, the article is removably attached to the defined position. In some embodiments, the graphic design includes a Quick Response Code, matrix code, two-dimensional bar code, optical machine-readable labels, or other readable code. In some embodiments, the raised bars are arranged in an array. In some embodiments, the graphic design is selected from the group consisting of a logo, slogan, lettering, pictures, names, product illustrations, emblems, promotional information related to a product or service, directions and symbols. In some embodiments, the systems further comprise displaying the panels in conjunction with a coordinated advertisement campaign comprising providing the information on the product, business or service in a different advertising media selected from the group consisting of print media such as magazines and paper, electronic media such as the internet (world wide web), radio advertisements, televisions commercials, in-store advertising media and outdoor advertising media such as billboards, posters, kiosks, placards, street furniture such as bus shelters, newsstands, newsracks, bicycle racks, transit media such as displays in bus stations, train stations and airports, mobile billboards, bus wraps, taxicabs, bus interiors, and alternative media.

In some embodiments, the present invention provides an advertising method comprising: displaying one or a plurality of flat satellite panels decorated with graphic designs, the panels arranged spatially contiguous to or in viewable proximity to a warning or guide panel having raised features and positioned in a pedestrian walkway compliant with the regulations of local jurisdiction. In some embodiments, the method further comprises displaying one or a plurality of remote satellite panels decorated with graphic designs, the remote satellite panels being viewably remote from the panel having raised features.

In some embodiments, the present invention provides an advertising system, comprising one or a plurality of satellite panels decorated with graphic designs, the panels configured to be spatially contiguous to or in viewable proximity to a warning or guide panel having raised features and positioned in a pedestrian walkway compliant with the regulations of local jurisdiction. In some embodiments, the systems further comprise one or a plurality of remote satellite panels decorated with graphic designs, the remote satellite panels being viewably remote from the panel having raised features.

In some embodiments, the present invention provides methods for dye sublimation decorating of a sheet molding compound substrate comprising: forming an article from sheet molding compound comprising from about less than 15% to 65% glass fibers (preferably from about 5% to 65% glass fibers; and printing an image or graphic design on at least one surface of said article by application of one or more sublimation dyes. In some embodiments, the article comprises at least one surface comprising at least a layer of sheet molding compound comprising from about 5% to 15% glass fibers and said one or more sublimation dyes are applied to the at least one surface comprising at least a layer of sheet molding compound comprising from about 5% to 15% glass fibers. In some embodiments, the at least a layer of sheet molding compound comprising from about 5% to 15% glass fibers is disposed on top of an underlying layer of sheet molding compound having a higher percentage of glass, for example, 20% to 65% glass, or 30% to 50% glass. In some embodiments, the image or graphic design displays or comprises at least two, three, four, five, six, seven, eight, nine or ten colors, and preferably from 2 to 10, 3 to 10, 4 to 10, 5 to 10, 2 to 20, 3 to 20, 4 to 20, or 5 to 20 colors. In some embodiments, the colors are different primary colors. In some embodiments, the colors are different shades of the same color. In some embodiments, the graphic design has a resolution of 300×300 dots per inch (DPI), and preferably has a resolution of at least about or equal to 720×720 DPI, and up to about 1440×720 DPI or 1440×1440 DPI. In some embodiments, the graphic design is a high resolution sublimated graphic design comprising sublimation dyes, preferably at least two, three, four, five, six, seven, eight, nine or ten sublimation dyes, and preferably from 2 to 10, 3 to 10, 4 to 10, 5 to 10, 2 to 20, 3 to 20, 4 to 20, or 5 to 20 sublimation dyes. In some embodiments, the sublimation dyes penetrate the upper surface to about 10 to 200 micrometers, preferably to about 20 to 100 micrometers, and most preferably to about 40-80 micrometers, preferably providing a high resolution graphic design that is scratch and/or scuff-resistant.

BRIEF DESCRIPTION OF THE DRAWINGS

For a better understanding of the present invention, reference may be made to the accompanying drawings, in which:

FIG. 6A shows a top view of an upgradeable ADA compliant 24"×48" detectable warning panel with an inline dome attention;

FIG. 6B shows an end view of the top section of an upgradeable ADA compliant 24"×48" detectable warning panel with an inline dome attention pattern;

FIG. 6C shows an end view of the bottom section of an upgradeable ADA compliant 24"×48" detectable warning panel with an inline dome attention pattern;

FIG. 6D shows a side view of the top section of an upgradeable ADA compliant 24"×48" detectable warning panel with an inline dome attention pattern;

FIG. 6E shows a side view of the bottom section of an upgradeable ADA compliant 24"×48" detectable warning panel with an inline dome attention pattern;

Figure 1A:
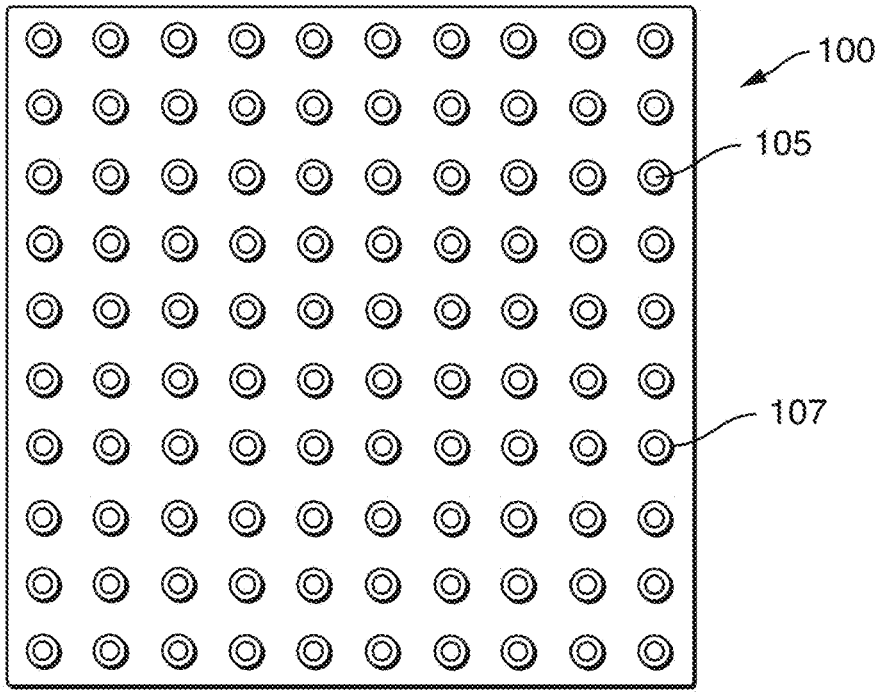
FIG. 1A shows a Tactile Warning Surface Indicators (TWSIs) "attention pattern" showing the truncated domes or cones parallel to the principal direction of travel.

To facilitate an understanding of the present technology, a number of terms and phrases are defined below. Additional definitions are set forth throughout the detailed description.

"Accessible" as used herein refers to a facility in the public or private right of way that is approachable and usable by persons with disabilities.

"Alternate pedestrian access route" as used herein refers to a temporary accessible route to be used when the pedestrian access route is blocked by construction, alteration, maintenance, or other temporary condition.

"Alternate pedestrian walkway" as used herein refers to a temporary accessible route to be used when the pedestrian walkway is blocked by construction, alteration, maintenance, or other temporary condition.

"Attention pattern" as used herein refers to a TWSI design calling attention to a hazard, or to hazards and decision points. Attention patterns can be installed in the vicinity of pedestrian crossings, at-grade curbs, railway platforms, stairs, ramps, escalators, travelators, elevators, etc.

"Decision point" as used herein refers to an intersection or change in direction along a path of travel defined by TWSIs.

"Graphic Design" as used herein refers to a product of graphic art including text and/or graphics, communicating an effective message or pleasing design, including but not limited to logos, advertising, branding, promotion, pictures, graphics, posters, signs and any other types of visual communication. The graphic design preferably comprises selected and arranged visual elements—for example, typography, images, symbols, and colors—that convey a message to an audience or create an effect.

"High resolution" as used herein in reference to a graphic design refers to a graphic design with a resolution of from about 300×300 dots per inch (DPI) to about 1440×1440 DPI, and preferably from about 720×720 DPI to about 1440×1440 DPI.

"High resolution sublimated graphic design" as used herein refers to a graphic design printed on a substrate with one or more sublimation dyes so that the sublimation dyes penetrate the surface of the substrate to about 10 to 200 micrometers, preferably to about 20 to 100 micrometers, and most preferably to about 40-80 micrometers, and have a resolution of from about 300×300 dots per inch (DPI) to about 1440×1440 DPI, and preferably from about 720×720 DPI to about 1440×1440 DPI.

"Guiding pattern" as used herein refers to a TWSI design indicating a direction of travel or a landmark.

"Hazard" as used herein refers to any area or element in, or adjacent to, a direction of travel, which may place people at risk of injury.

"Pedestrian walkway" as used herein refers to a path designed for pedestrian use, such as a passage for walking, a path set aside for walking, a passage or path connecting buildings, or a passage or path, especially one which is covered or raised above the ground. The term "pedestrian walkway" encompasses the following: sidewalks or pavement, footpath, footway, shared-use path, pathway, multi-use path, curb ramps, stairs, ramps, passageways, segregated footway, blended transitions, platform, footbridges, stiles, tunnels, walkways, pedestrian lanes, pedestrian accessible route, pedestrian street crossing, alternate pedestrian access route, alternate pedestrian walkway, temporary pedestrian walkway, pedestrian overcrossing, pedestrian undercrossing, pedestrian overpass, escalators, travelators, crosswalk, moving walkway, transit platforms, skybridge and the like.

"Pedestrian access route" as used herein refers to a continuous and unobstructed path of travel provided for pedestrians with disabilities within or coinciding with a pedestrian circulation path in the public right-of-way. Pedestrian access routes in the public right-of-way ensure that the transportation network used by pedestrians is accessible to pedestrians with disabilities.

"Temporary pedestrian walkway" as used herein refers to a temporary pedestrian walkway to be used when the pedestrian walkway is blocked by construction, alteration, maintenance, or other temporary condition.

"Tactile Walking Surface Indicator (TWSI)" as used herein refers to a standardized walking surface used for information by blind or vision-impaired persons.

"Truncated domes or cones" as used herein refers to a type of attention pattern also referred to as flat-topped domes or cones.

"Wayfinding" as used herein encompasses all the ways in which people orient themselves in physical space and navigate from place to place. In urban planning it is a consistent use and organization of definite sensory cues (tactile elements and provision for special-needs users) from the external environment.

DETAILED DESCRIPTION OF THE PREFERRED EMBODIMENT

The present invention provides a dual purpose Tactile Walking Surface Indicator (TWSI) with a graphic design, preferably for use as an advertising system. This new advertising venue in a pedestrian walkway utilizes a dual purpose TWSI which combines the safety aspects of attention and guidance for visually impaired pedestrians and a graphic design comprising an advertising/promotion/branding message for pedestrians who can see them. The invention includes both patented and patent pending TWSI panel constructions, including all conventional versions known to the public, powder coat paint processes/systems, as well as textured powder coated paints and ink/dye sublimation methods/equipment, all of which can be applied to both conductive and non-conductive substrates.

A. Tactile Walking Surface Indicators

Tactile walking surface indicators (TWSIs) are widely used in many developed and some developing countries to provide wayfinding information to pedestrians who are visually impaired. TWSIs are also used to alert people with visual impairments when they are approaching a hazard such as the edge of a platform, a flight of stairs, an escalator or the end of the pavement and the beginning of the street. TWSIs should be readily detectable and distinguishable from the surrounding or adjacent surfaces by visually impaired people. They are used for both indoor, as well as, outdoor locations. By providing tactile information for safety and wayfinding, TWSIs improve the confidence, independence and quality of life for people who are visually impaired. This is achieved by enabling them to participate in employment, social, recreational, educational, cultural and religious activities.

There are other systems and devices for providing wayfinding and safety information to people who are visually impaired. These include accessible signals that use sound and/or vibration to provide information for crossing at pedestrian traffic lights. It is now possible for people who are visually impaired to use of both GPS-based, real-time wayfinding information and some electronic information systems for public buildings. Such electronic systems can complement, but do not replace, the requirement for tactual information.

Among their advantages, TWSIs can lead users precisely to a destination, can be used to provide information both indoors and outdoors, do not require electric power and do not require users to purchase or maintain any special equipment. TWSIs were originally developed in 1965 by Seiichi Miyake who lived in Japan. Two generic texture patterns are used for TWSIs ("attention patterns" and "guiding patterns"). The usage of these TWSI patterns differs somewhat from country to country. Over the years, extensive research in various countries has established that both "attention patterns" (truncated domes or cones) and "guiding patterns" (raised bars) are highly detectable when used in association with typical walking surfaces, and that they are distinguishable from each other. Since 1965, TWSI surface textures have been modified, and systems of installation vary worldwide, not only amongst countries, but also within countries. Multiple patterns, sizes, colors and specifications of materials and systems for installations can now be found. However, consistency is important when providing tactile information for people who are visually impaired. Each country may have some unique aspects but in general terms the TWSIs do have many similar characteristics. International Standards have evolved (ISO 23599, Mar. 1, 2012). The scope of this standard says that "it is not intended to replace requirements and recommendations contained in . . . national standards, regulations and guidelines" However, "national design standards provide for high-quality products taking into account different physical, climatic and social situations of each country, as well as, provide consistent TWSI systems within a country". The ISO standard permits differences in parameters such as shapes, dimensions, arrangements, formula of the luminance and method of installation. This is to give flexibility when considering different national circumstances.

Figure 1B:
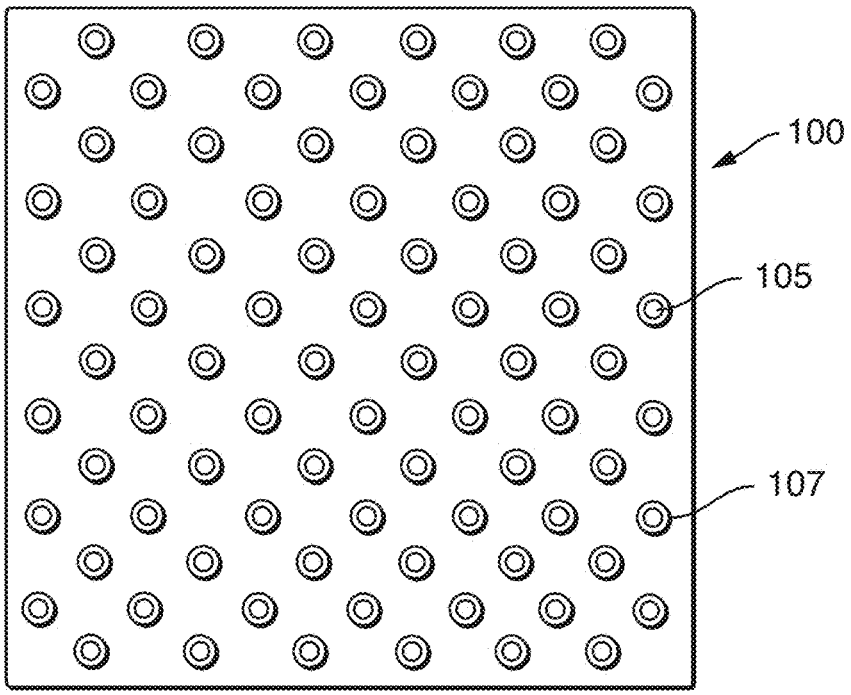
FIG. 1B shows a TWSIs "attention pattern" showing the truncated domes or cones diagonal at 45° to the principal direction of travel.

The "attention pattern" comprises truncated domes or cones (also commonly referred to as: detectable warning system, detectable warnings, detectable warning surface, detectable warning panel, tactile warning surfaces, raised tactile profiles, tactile tile, tactile detectable warnings, tactile warning surface, tactile, truncated domes, truncated dome surface, embedment tile device, Braille blocks, blister paver, attention pattern), and is used primarily to indicate hazards, decision points or destination facilities. A decision point may be at an intersection or at a change in direction along a guided path. The "attention pattern" is arranged in a square grid, parallel or diagonal at 45 degrees to the principal direction of travel. FIG. 1A shows an "attention pattern" panel 100 with a square or inline grid. The "attention pattern" panel 100 is preferably parallel to principal direction of pedestrian travel. The truncated domes or cones are rounded/conical dome structures 107 protruding upward from the surface of the substrate panel. The top area 105 of the truncated domes or cones is a flat surface. FIG. 1B shows an "attention pattern" panel 100 with truncated domes or cones diagonal at 45 degrees to principal direction of pedestrian travel. The truncated domes or cones are rounded/conical dome structures 107 protruding upward from the surface of the substrate panel. The top area 105 of the truncated domes or cones is a flat surface. The spacing and size of the domes varies depending on specific country, government or local municipality specifications. As an example, although not all inclusive, the International Standards (ISO 23599) state that the height of the truncated domes or cones is preferably 4 mm to 5 mm. The top diameter of truncated domes or cones preferably range from 12 mm to 25 mm, and the bottom diameter of truncated domes or cones is preferably (10±1) mm greater than the top diameter. The spacing refers to the shortest distance between the centers of two adjacent truncated domes or cones which may be parallel or diagonal at 45 degrees to the direction of travel. The spacing is preferably within the ranges shown in relation to the top diameter in Table 1—Top diameter and corresponding spacing of truncated domes or cones. The tolerance of the top diameter is preferably ±1 mm.

TABLE 1

| Top Diameter of Truncated Domes or Cones Mm | Spacing mm |
|---|---|
| 12 | 42 to 61 |
| 15 | 45 to 63 |
| 18 | 48 to 65 |
| 20 | 50 to 68 |
| 25 | 55 to 70 |

These truncated dome panels can be any color as long as the color contrasts to the surrounding concrete or pavement.

Common colors are red, yellow, black, brown, patina, grey, and white. "Attention patterns" may be installed in the vicinity of pedestrian crossings, at-grade curbs, railway platforms, stairs, ramps, escalators, travelators, elevators, etc.

Figure 2A:
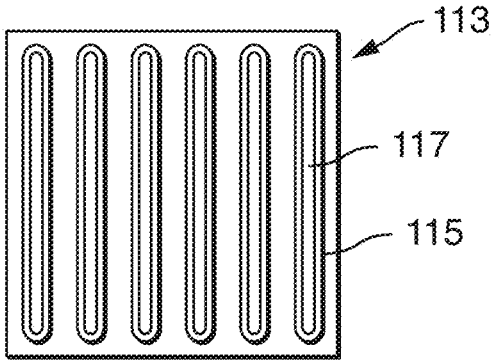
FIG. 2A shows TWSIs "guiding pattern" with a flat-topped elongated oval bars pattern.
Figure 2B:
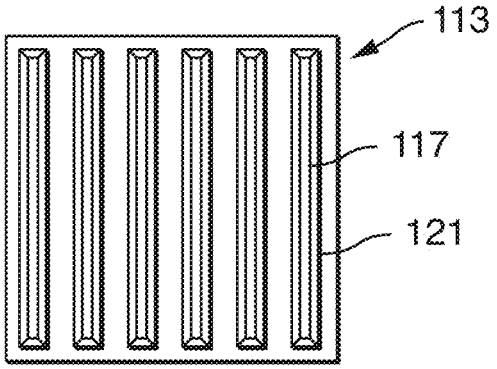
FIG. 2B shows a TWSIs "guiding pattern" with a flat-topped elongated rectangle bars pattern.
Figure 2C:
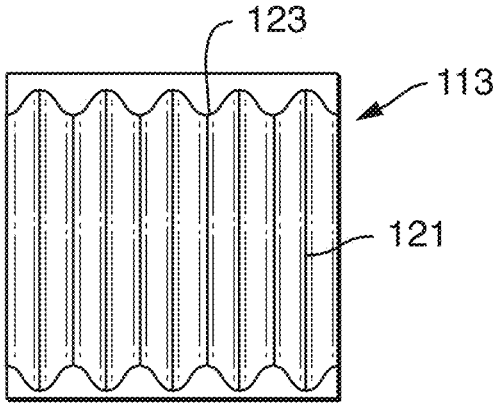
FIG. 2C shows a TWSIs "guiding pattern" with a sinusoidal ribs pattern.
Figure 2D:
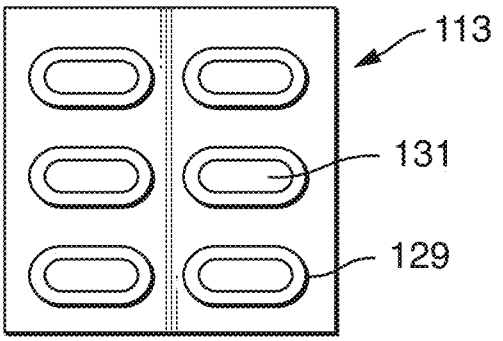
FIG. 2D shows a TWSIs "guiding pattern" with a flat-topped elongated oval rib pattern.

The "guiding pattern" comprises raised bars (also commonly referred to as: elongated bars, directional blocks, elongated oval bars, elongated oval ribs, elongated rectangle bars, thin linear protrusions, raised ovals, sinusoidal ribs, sinusoidal, ribbed tile, guiding pattern), and is used to guide visually impaired pedestrians to particular places such as pedestrian crossings, entrances to buildings, lifts and other amenities. Different designs have been developed for "guiding patterns" although flat-topped elongated bars are the most common. FIG. 2A is a "guiding pattern" substrate 113 with elongated oval bars. The elongated oval bars have a rounded top edge 115 and a flat-top 117. FIG. 2B shows a "guiding pattern" substrate 113 with elongated rectangle bars. The elongated rectangle bars have a rounded top edge 121 and a flat-top 117. FIG. 2C is a "guiding pattern" substrate 113 with a sinusoidal ribs design. The sinusoidal rib has a high ridge 125 and a low valley point 123. Sinusoidal patterns are less easily damaged by snow plows than flat-topped bars. FIG. 2D is a "guiding pattern" substrate 113 with an elongated oval ribs design. The elongated oval ribs have a rounded top edge 129 and a flat-top 131. These raised bars in most cases run parallel to the direction of pedestrian travel. The spacing and size of the raised bars varies depending on specific country, government or local municipality specifications. As an example, the International Standards (ISO 23599) state that the height of the flat-topped elongated bars is preferably 4 mm to 5 mm. The top width of flat-topped elongated bars preferably range from 17 mm to 30 mm. The bottom width is preferably (10±1) mm wider that the top. The spacing refers to the distance between the axes of adjacent flat-topped elongated bars. The distance is preferably in relation to the top width, as shown in Table 2—Top width and corresponding spacing of axes of flat-topped elongated bars. The tolerance of the top width is preferably ±1 mm.

TABLE 2

| Top Width of flat-Topped Elongated Bars Mm | Spacing Mm |
|---|---|
| 17 | 57 to 78 |
| 20 | 60 to 80 |

TABLE 2-continued

| Top Width of flat-Topped Elongated Bars Mm | Spacing Mm |
|---|---|
| 25 | 65 to 83 |
| 30 | 70 to 85 |

The top length of flat-topped elongated bars is preferably more than 270 mm and the bottom length is preferably (10±1) mm longer than the top. The distance between the ends of flat-topped elongated bars should be no more than 30 mm. The International Standards (ISO 23599) state that the difference in level between the wave crest and the wave trough of sinusoidal rib patterns is preferably 4 mm to 5 mm. The distance between the axes of two adjacent wave crests of sinusoidal rib patterns is preferably 40 mm to 52 mm. The length of the sinusoidal ribs should be at least 270 mm. The flat-elongated bars or sinusoidal ribs can be any color as long as the color contrasts to the surrounding concrete or pavement.

"Guiding patterns" may be used alone or in combination with "attention patterns" in order to indicate the walking route from one place to another. Truncated domes or cones and elongated bars or sinusoidal ribs preferably have beveled or rounded edges to decrease the likelihood of tripping and to enhance safety and negotiability for people with mobility impairments.

In the United States these TWSI products for the visually impaired are called detectable warnings or truncated domes (detectable warning surfaces/panels). Detectable warnings were required in 1991 by the Americans with Disabilities Act (ADA). The ADA recognizes and protects the civil rights of people with disabilities and is modeled after earlier landmark laws prohibiting discrimination on the basis of race and gender. The ADA mandated that many municipalities, governmental bodies, commercial/public buildings, shopping centers, transit platforms, loading docks, etc. utilize detectable warning panels. The detectable warning panel is a distinctive surface pattern of domes (three-dimensional substrate) detectable by cane or underfoot and is used to alert people with visual impairments of their approach to streets and hazardous drop-offs. The visually impaired rely on a combination of visual cues (color contrast), tactile cues (sweeping cane, sole of shoes, wheelchairs and walker wheels) and audio cues (sound) in order to identify these hazardous areas. Table 3 shows some of the significant ADA Guideline documents for public right-of-way, state and local government facilities and commercial facilities.

TABLE 3

| Description | Date | Section | Subject |
|---|---|---|---|
| U.S. Access Board - Proposed Accessibility Guidelines for Pedestrian Facilities in the Public Right-of-Way | Jul. 26, 2011 | 36 CFR Part 1190 Sections R208 & R305 - Detectable Warning Surfaces | Where They are Required, General, Truncated Domes, Dome Size, Dome Spacing and Color Contrast |
| Department of Justice - 2010 ADA Standards for State and Local Government Facilities: Title II | Sep. 15, 2010 | Regulations at 28 CFR 35.151 & the 2004 ADAAG at 36 CFR part 1191, appendices B and D | Where They are Required, General, Dome Size, Dome Spacing, Color Contrast and Platform Edges |
| Department of Justice - 2010 Standards for Public Accommodations and Commercial Facilities: Title III | Sep. 15, 2010 | Regulations at 28 CFR part 36, subpart D; and the 2004 ADAAG at 36 CFR part 1191, appendices B and D | Where They are Required, General, Dome Size, Dome Spacing, Color Contrast and Platform Edges |
| Department of Transportation | Nov. 29, 2006 | Regulations at 49 CFR part 37 | Detectable Warning Requirements |

To ensure that buildings and facilities are accessible to and usable by people with disabilities, the ADA also establishes accessibility requirements for state and local government facilities, places of accommodation, and commercial facilities. Under the ADA, the U.S. Access Board has developed and continues to maintain design guidelines for accessible buildings and facilities known as The Americans with Disabilities Accessibility Guidelines (ADAAG). The ADAAG develops/defines certain types of rules/applications for detectable warnings where pedestrian ways blend with vehicular ways (hazardous vehicular areas) including curb ramps, pedestrian crossings, transit facilities, commercial applications (hotels, restaurants and retail stores), parking lots/structures, stairways, escalator approaches and accessible building routes.

Figure 3A:
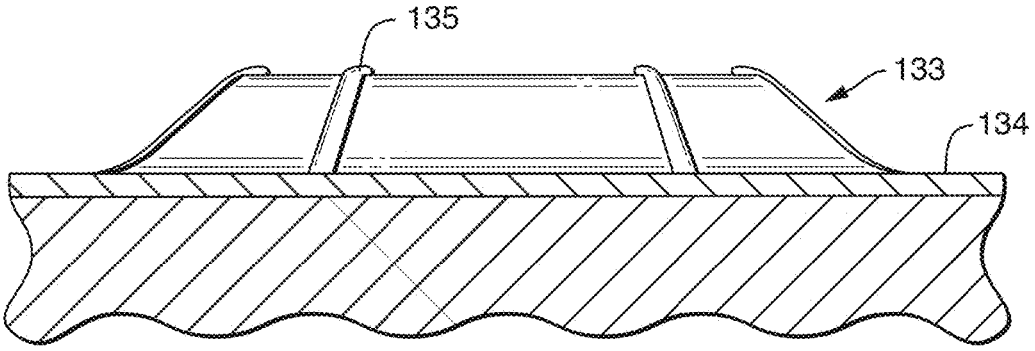
FIG. 3A shows a side view of a truncated dome with ridges manufactured by MetaDome.
Figure 3B:
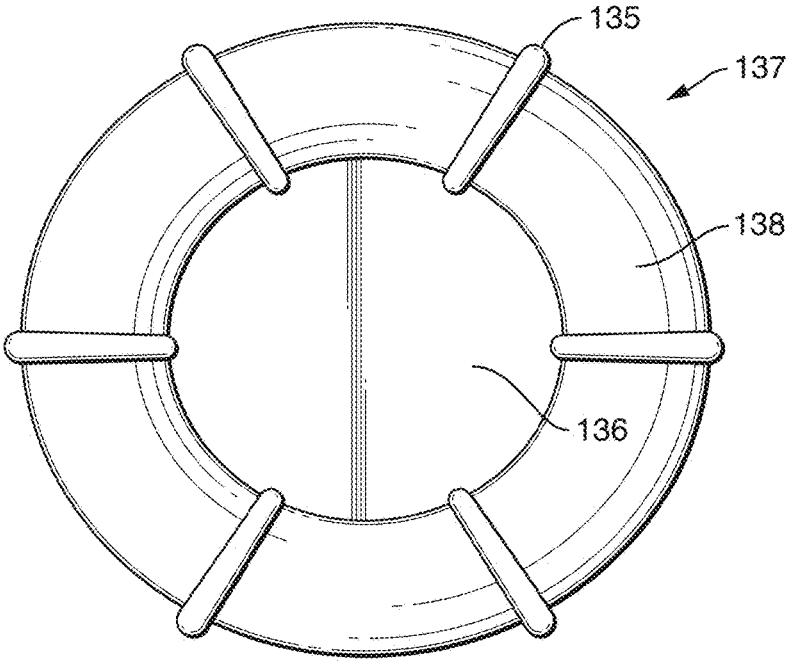
FIG. 3B shows a top view of a truncated dome with ridges manufactured by MetaDome.

The ADAAG 2010 ADA Standards for Accessible Design state that detectable warnings preferably consist of a surface of truncated domes. The ADA standards for these truncated domes in a detectable warning surface preferably have a base diameter of 0.9 inch minimum and 1.4 inches maximum, a top diameter of 50 percent of the base diameter minimum to 65 percent of the base diameter maximum, and a height of 0.2 inch. Truncated domes in a detectable warning surface preferably have a center-to-center spacing of 1.6 inches minimum and 2.4 inches maximum, and a base to base spacing of 0.65 inch minimum, measured between the most adjacent domes on a square grid. FIG. 3A shows a side view of the truncated dome 133 design on a flat surface mount substrate 134 manufactured by MetaDome. This truncated dome 133 design is unique due to the reinforced ridges 135 on the dome which function to strengthen the dome and also provide additional wear protection for the surface coatings. FIG. 3B is a top view of the MetaDome truncated dome 137. The truncated dome has a flat top 136 and a sloped side 138 that projects down to the substrate. In addition, detectable warning surfaces preferably contrast visually with adjacent walking surfaces either light-on-dark, or dark-on-light.

The need for a detectable warning panel solution that is cost effective is essential to enable municipalities, governments and the private sector to comply with the ADA unfunded mandates. There is a need to provide a creative way to provide funding assistance/cost sharing, for both public and private entities, for the purchase, installation, maintenance and replacement of detectable warning panels.

Figure 4B:
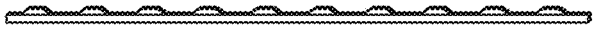
FIG. 4B shows an end view of an ADA compliant 24"×48" surface mount/overlay/retrofit detectable warning panel with an inline dome attention pattern.
Figure 4A:
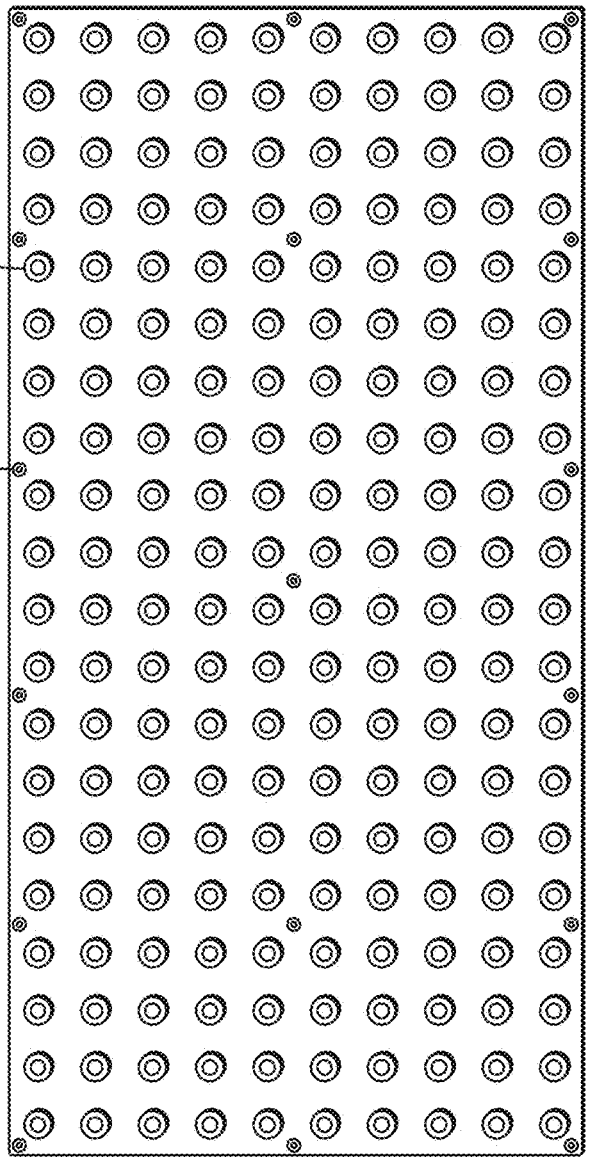
FIG. 4A shows a top view of an ADA compliant 24"×48" surface mount/overlay/retrofit detectable warning panel with an inline dome attention pattern.
Figure 4C:
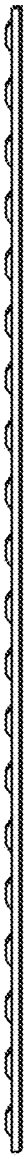
FIG. 4C shows a side view of an ADA compliant 24"×48" surface mount/overlay/retrofit detectable warning panel with an inline dome attention pattern.
Figure 5B:
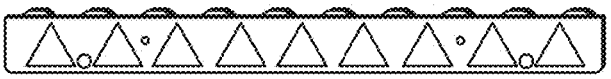
FIG. 5B shows an end view of an ADA compliant 24"×48" cast in place detectable warning panel with an inline dome attention pattern.
Figure 5A:
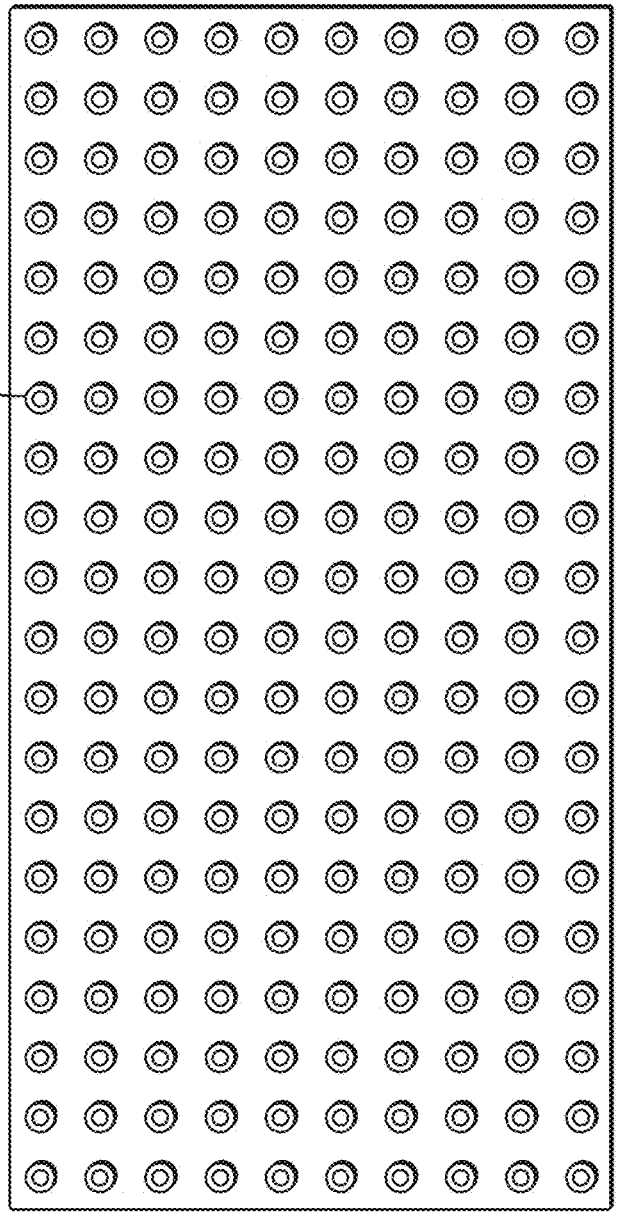
FIG. 5A shows a top view of an ADA compliant 24"×48" cast in place detectable warning panel with an inline dome attention pattern.
Figure 5C:
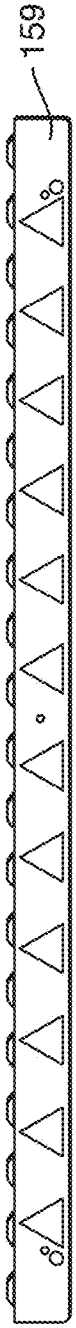
FIG. 5C shows a side view of an ADA compliant 24"×48" cast in place detectable warning panel with an inline dome attention pattern.
Figure 7:
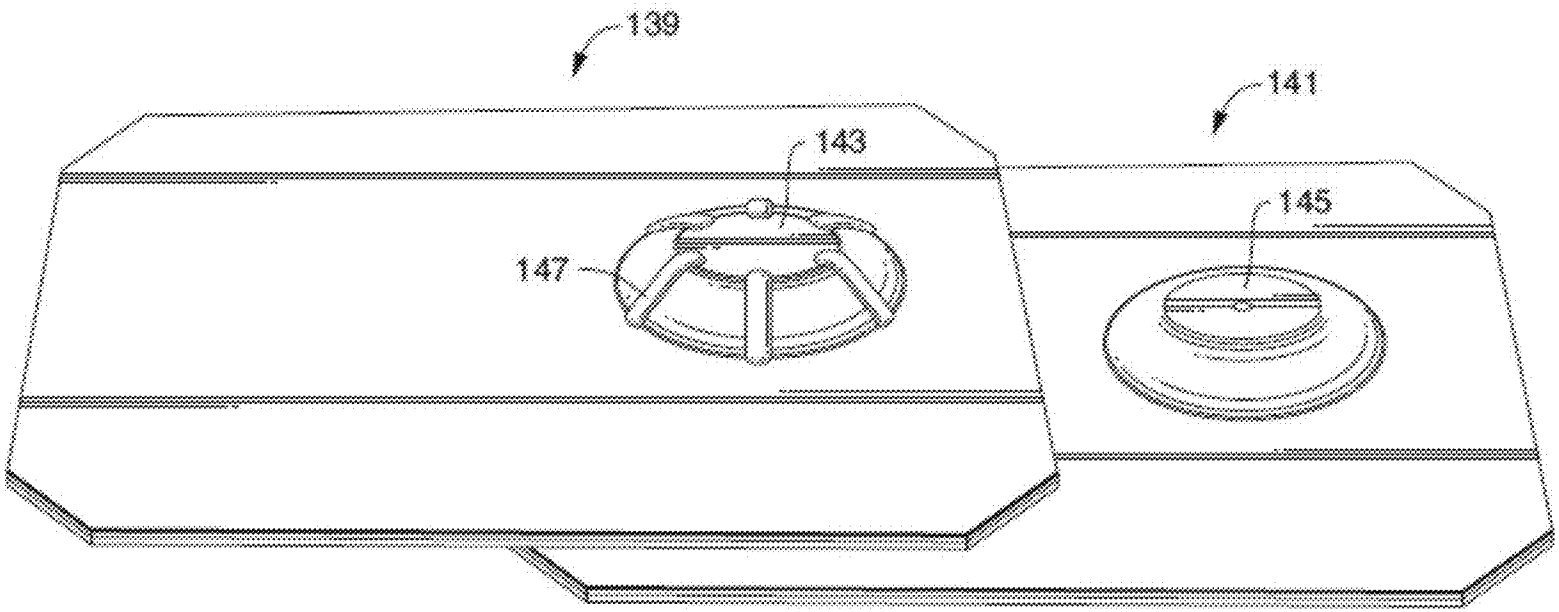
FIG. 7 shows a three-dimensional view of a truncated dome on a cutaway view of an upgradeable panel.
Figure 8A:
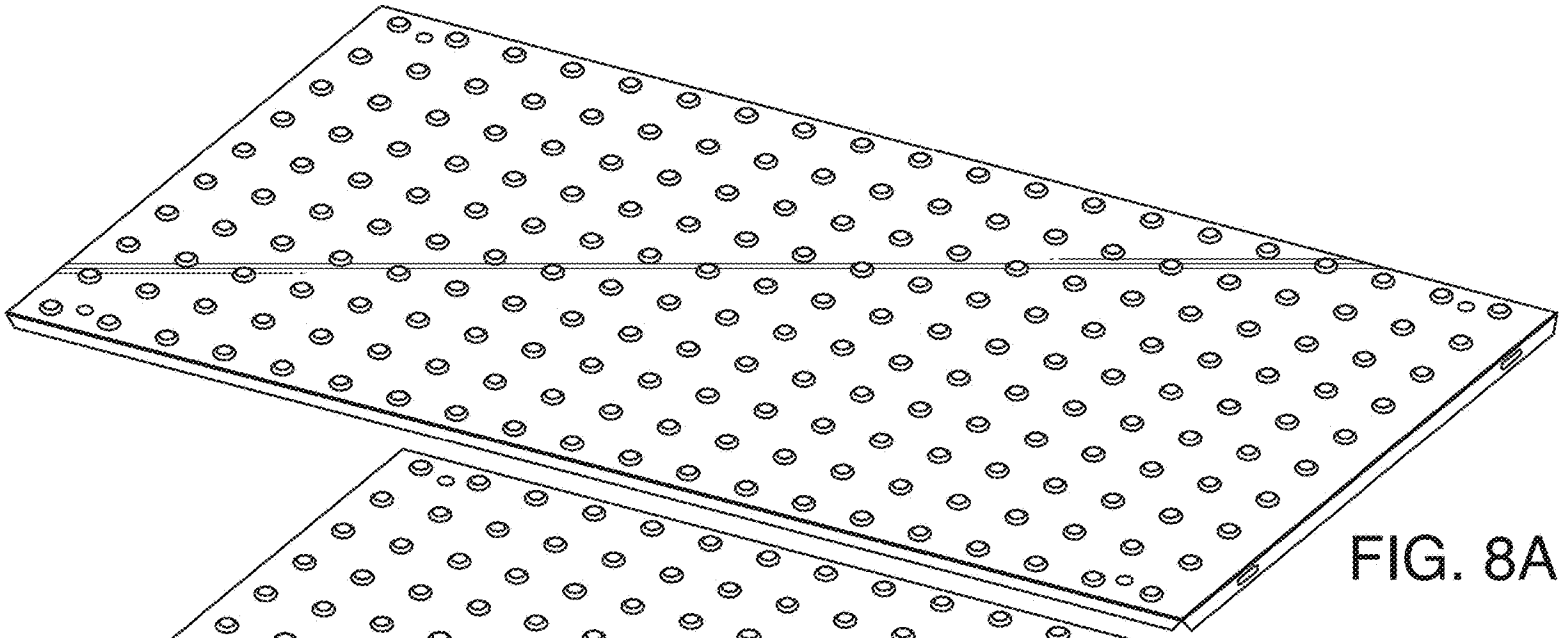
FIG. 8A shows a three-dimensional top view of an upgradeable detectable warning panel with an inline dome attention pattern showing the top section of the panel.
Figure 8B:
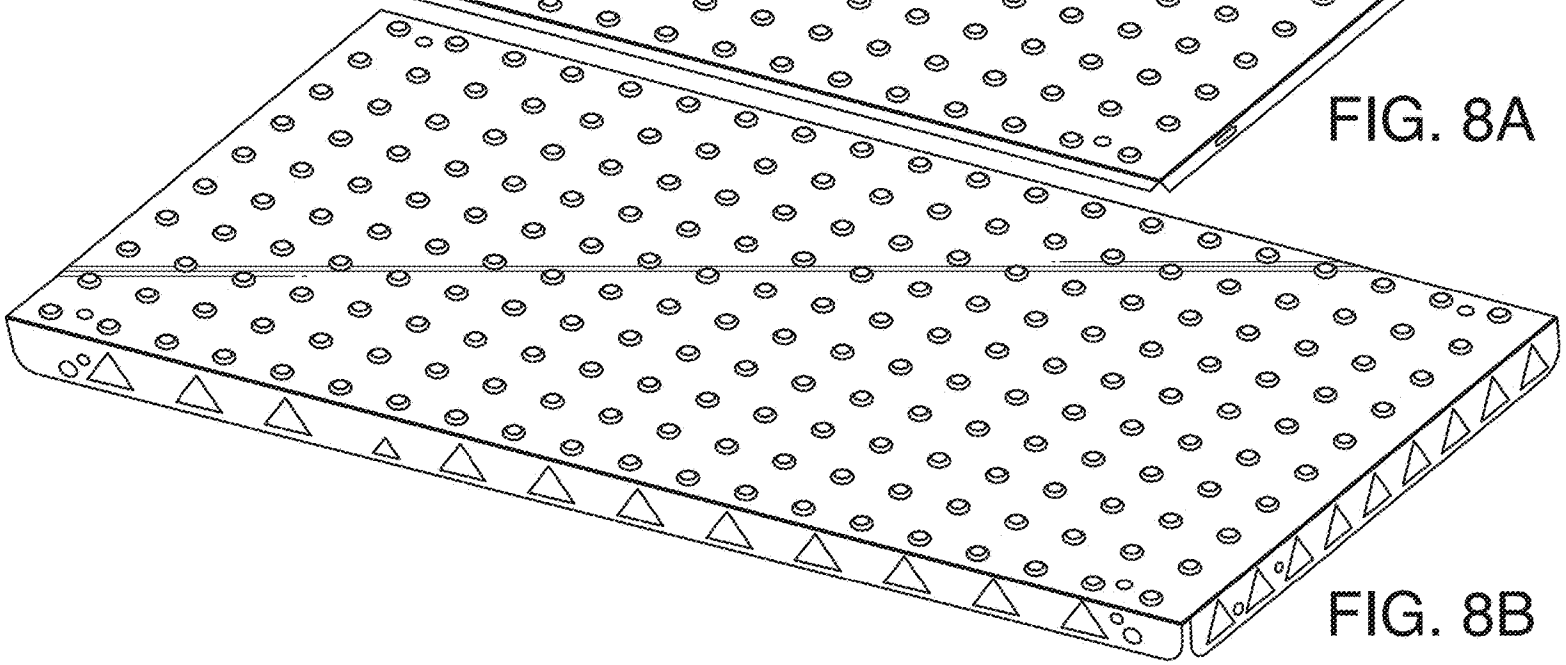
FIG. 8B shows a three-dimensional top view of an upgradeable detectable warning panel with an inline dome attention pattern showing the bottom section of the panel.
Figure 9A:
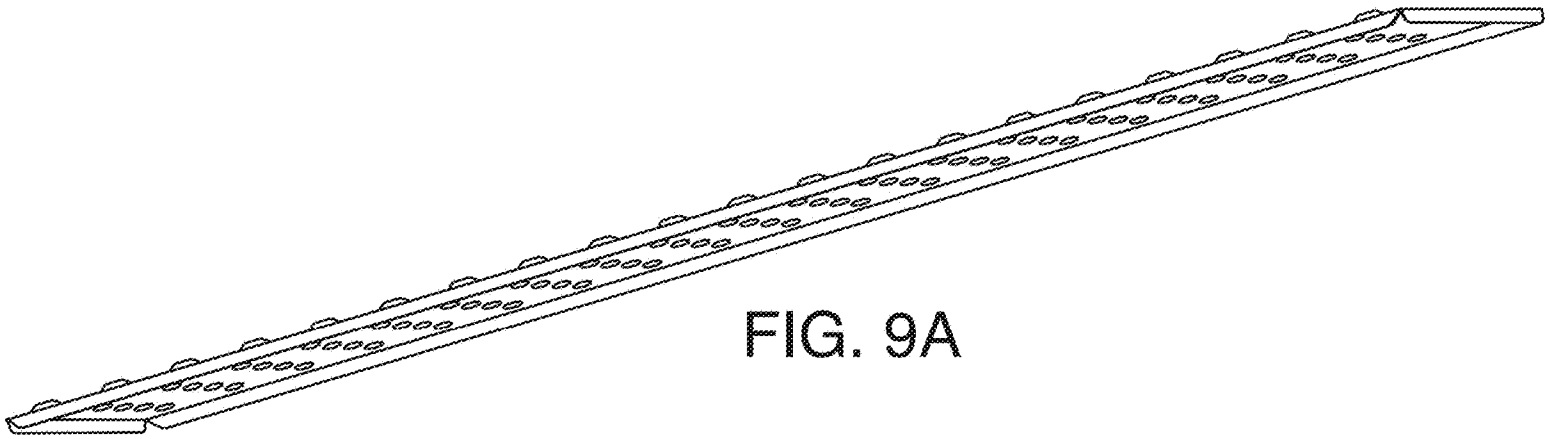
FIG. 9A shows a three-dimensional bottom view of an upgradeable detectable warning panel with an inline dome attention pattern showing the top section of the panel.
Figure 9B:
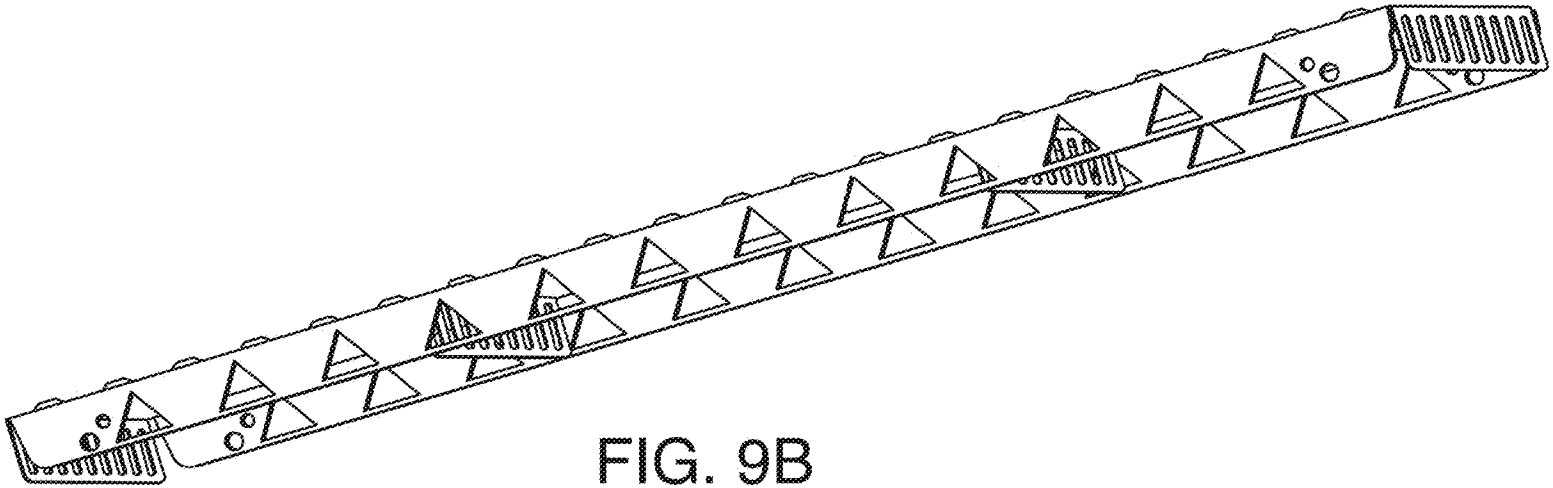
FIG. 9B shows a three-dimensional bottom view of an upgradeable detectable warning panel with an inline dome attention pattern showing the bottom section of the panel.
Figure 10A:
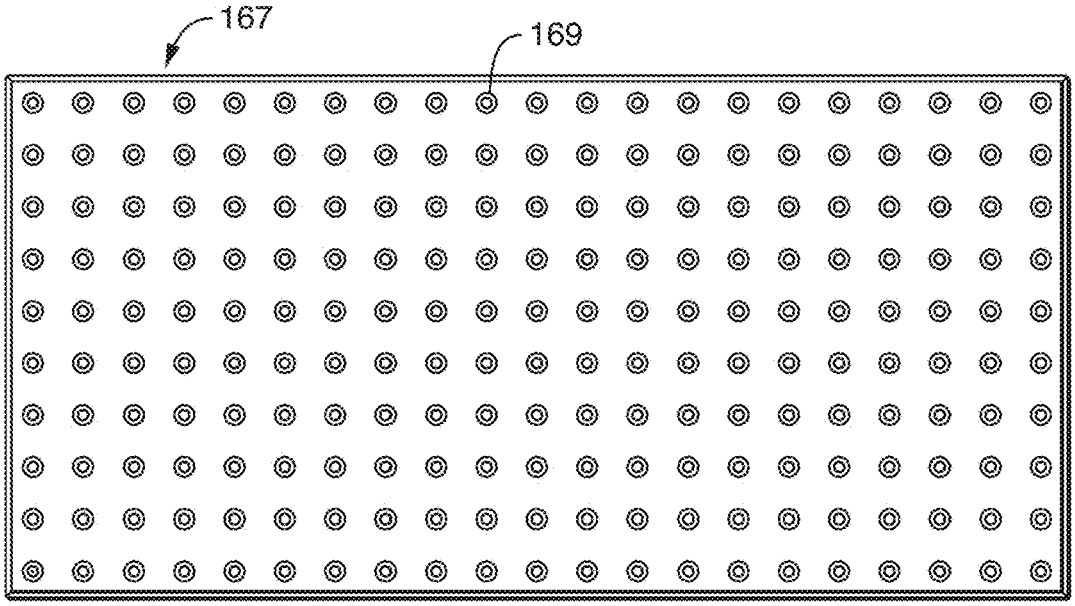
FIG. 10A shows a top view of a plastic composite surface mount detectable warning panel with an inline dome attention pattern.
Figure 10B:
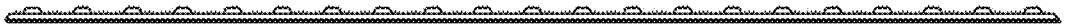
FIG. 10B shows a side view of a plastic composite surface mount detectable warning panel with an inline dome attention pattern.
Figure 10C:
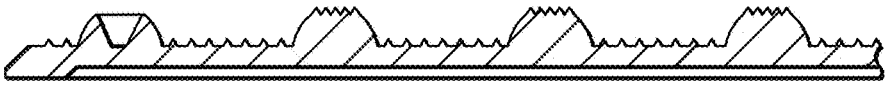
FIG. 10C shows a close up detailed side view showing the molded textured pattern of a plastic composite surface mount detectable warning panel with an inline dome attention pattern.
Figure 10D:
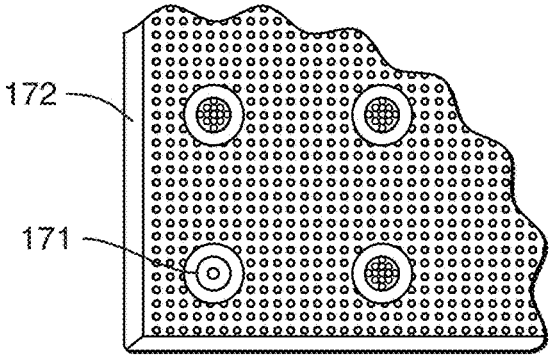
FIG. 10D shows a close up view of a plastic composite detectable warning panel.

Multiple companies manufacture and sell ADA compliant TWSIs in the United States. The detectable warning panel substrate material types include steel, stainless steel, aluminum, metal, cast iron, ductile iron, ceramic, concrete, HDPE, plastic, plastic composite, vitrified polymer composite, herculite polymer composite, nylon 6, nylon 6/6, fiberglass, rubber, FRP, PVC, Poly, sheet molding compound, thermoset plastics, thermoplastics, rubber, other fibrous materials and the like. In addition the panel substrates come in different panel designs depending on the TWSI specifications, as well as, installation requirements in the field. These designs include cast in place, upgradeable, replaceable, overlay, surface mount, surface applied, retrofit, radius sections and the like. FIG. 4A shows a top view 149 of an ADA compliant 24"×48" surface mount/overlay/retrofit detectable warning panel manufactured by MetaDome with an inline dome attention pattern. The drawing shows both the truncated domes or cones 151 and the round holes 153 in the detectable warning panel where it is securely fastened to the concrete or pavement. FIG. 4B is an end view and FIG. 4C is a side view of this surface mount/overlay/retrofit detectable warning panel. FIG. 5A shows a top view 155 of an ADA compliant 24"×48" cast-in-place detectable warning panel manufactured by MetaDome with an inline dome attention pattern. This type of panel is embedded at the time of construction directly into the concrete or pavement. The drawing shows the truncated domes or cones 151 on the detectable warning panel. FIG. 5B is an end view of this panel type. FIG. 5C is a side view of this cast-in-place detectable warning panel which also shows the frame 159 which gets embedded into the concrete or pavement surface material. FIG. 6A shows a top view 161 of an ADA compliant 24"×48" upgradeable detectable warning panel manufactured by MetaDome with an inline dome attention pattern. This type of detectable warning panel has a bottom section which is embedded permanently into the concrete or pavement and a removable top section which can be replaced. The bottom panel section of this panel is embedded directly into the concrete or pavement when the surface is poured. The top section is attached with fasteners utilizing the multiple holes 165 provided in the panel. The drawing shows the truncated domes or cones 151 on the detectable warning panel. FIGS. 6B and 6C are the end views of this panel type. FIGS. 6D and 6E are the side views of this upgradeable detectable warning panel which also shows the frame 159 which gets embedded into the concrete or pavement surface material. FIG. 7 shows a three-dimensional drawing of the truncated domes on both the top section 139 and bottom section 141 of an upgradeable detectable warning panel manufactured by MetaDome. This drawing shows two different styles of truncated domes. The top panel has a truncated dome with a flat top 143 along with raised ridges 147 around the dome. The bottom panel cut away has a truncated dome with a flat top 145 and no raised ridges. FIG. 8A shows a top view of a three-dimensional ADA compliant upgradeable detectable warning panel with an inline dome attention pattern manufactured by MetaDome showing the top section of the panel. FIG. 8B shows a top view of the bottom section of this type of panel. FIG. 9A shows a bottom view of a three-dimensional ADA compliant upgradeable detectable warning panel with an inline dome attention pattern manufactured by MetaDome showing the top section of this type of panel. FIG. 9B shows a bottom view of the bottom section of this type of panel. FIG. 10A shows a top view 167 of a plastic composite ADA compliant surface mount detectable warning panel with an inline dome attention pattern. FIG. 10B is a side view of this panel. FIG. 10C is a cut-away view of this panel which shows the truncated domes and the microtexturing which are molded into the panel to provide the necessary slip resistance. FIG. 10D shows the holes 171 in the panel for the fasteners in order to secure the panel to the concrete or pavement. This surface mount panel also has a sloped angle 172 on the edge of the panel so that it does not create a trip hazard and to provide the necessary strength to the plastic substrate. The manufacturer companies also provide the detectable warning panels in a variety of solid colors as specified by their customers (states, municipalities, transit companies, engineers, architects and corporate). The most popular colors used in the United States are federal yellow and brick red. Typically these panels come in various sizes with the most widely used sizes being 2'×2', 2'×3', 2'×4' or 2'×5' (small radius sections are also used in some locations).

B. TWSI's Comprising Graphic Designs

The present invention provides TWSIs that display text and/or other graphic information such as commercial messages, trademarks, logos, directions, slogans, pictures, names, product illustrations, emblems, promotional information related to a product or service, Quick Response Codes, matrix code, two-dimensional bar code, optical machine-readable labels, and combinations thereof. In some embodiments, the graphic design displays or comprises at least two, three, four, five, six, seven, eight, nine or ten colors, and preferably from 2 to 10, 3 to 10, 4 to 10, 5 to 10, 2 to 20, 3 to 20, 4 to 20, or 5 to 20 colors. In some embodiments, the colors are different primary colors, most preferably at least three different primary colors, for example: red, green and blue; cyan, magenta and yellow; red, yellow and blue; cyan, magenta, yellow and black; and red, yellow, blue, white and black. In some embodiments, the colors are different shades of the same color. In some embodiments, the graphic design has a resolution of 300×300 dots per inch (DPI), and preferably has a resolution of at least about or equal to 720×720 DPI, and up to about 1440×720 DPI or 1440×1440 DPI. In some embodiments, the graphic design is a high resolution sublimated graphic design comprising sublimation dyes, preferably at least two, three, four, five, six, seven, eight, nine or ten sublimation dyes, and preferably from 2 to 10, 3 to 10, 4 to 10, 5 to 10, 2 to 20, 3 to 20, 4 to 20, or 5 to 20 sublimation dyes. In some embodiments, the sublimation dyes penetrate the upper surface to about 10 to 200 micrometers, preferably to about 20 to 100 micrometers, and most preferably to about 40-80 micrometers, preferably providing a high resolution graphic design that is scratch and/or scuff-resistant. In some embodiments, the graphic design conveys information about a product, business, or service. In some embodiments, the graphic design is an image, for example a picture of a product, person, or place or provides a replicated image of a material such as wood, wood grain, marble, granite, stone, etc. The present invention further provides methods for producing graphic designs on TWSIs.

In preferred embodiments, direct sublimation decoration into the TWSI substrate, as well as, multilayers of powder coat paint and then decoration are applied to various substrates. Preferably, the substrate materials from which the panel is formed are selected from steel, cast iron, sheet molding compound, thermoset plastic, thermoplastics, and other plastic composite TWSI substrates. The decorated steel detectable warning panels are preferably manufactured by MetaDome, a patented and patent pending detectable warning panel. The patents and/or patent applications related to the substrate design and manufacturing process, hereby incorporated by reference in their entirety, are U.S. Pat. No. 7,001,103 (Feb. 21, 2006), U.S. Pat. No. 7,845,122 (Dec. 4, 2010), U.S. Pat. No. 8,146,302 (Apr. 3, 2012), U.S. Pat. No. 8,261,497 (Sep. 11, 2012), Patent Application No. 20050031415 (Feb. 10, 2005), Patent Application No. 20050066623 (Mar. 31, 2005), Patent Application No. 20060174567 (Aug. 10, 2006), Patent Application No. 20080236064 (Oct. 2, 2008), Patent Application No. 20100129150 (May 27, 2010), Patent Application No. 20120207543 (Aug. 16, 2012).

Other manufacturer's steel panels are also useful with this invention. The cast iron, sheet molding compound and other plastic composite substrate types can be selected from numerous competing manufacturing companies.

The multi-step manufacturing process may include a pre-treatment and preparation of the substrate surface, a possible electrocoating step to protect labile elements from rust such as cast iron, a primer painting step, one or two coat powder coating step, a dye/ink sublimation step (which consists in the wrapping up or tightly covering of the substrate with a transfer support usually by a vacuum bagging technique, and the subsequent application of the decoration/graphic design in the substrate surface material) and a topcoat protective shield step.

The present invention utilizes a graphic design/print media/decoration system which is used for displaying visual images/graphic articles on conventional TWSI compliant substrate panels. The graphic design/print media/decoration system of the invention includes a plurality of individual three dimensional (preformed, complex shaped objects) substrates, each of which carries a graphic image within the surface material thereof. This decoration process is a multi-step manufacturing process which varies depending on the substrate material type and method of sublimation utilized. This invention includes manufacturing processes which utilizes texture powder coat paint, liquid paint, special dyes/inks, sublimation equipment and decoration methods on different material substrates.

In the present invention the need for painting the substrate and the method of decoration onto the substrate surface may vary depending on the substrate material type. The first method includes decorating both conductive and non-conductive TWSI substrates that are powder coat painted. This powder paint may include one or multiple layers of clear/transparent or colored powder paint. One or more of the powder coat paint layers will include textured powder coat paint. After the substrate is painted the ink/dye sublimation process will transfer the decoration/graphic design into the top powder coat layer of the substrate. The second method includes decorating both non-conductive TWSI substrates that have no powder coat paint or liquid paint on the substrate. In this case, the ink/dye sublimation process will transfer the decoration/graphic design directly into the substrate (for example—plastic composite substrates like sheet molding compound or vitrified polymer composite). In addition, in both of the above methods the substrate may then have applied a clear/transparent coating (protective shield) to protect the substrate and the graphic carried thereby. Such coatings can, for example, impart increased weather-ability, UV protection, abrasion resistance, slip resistance, chemical corrosion resistance, anti-graffiti and the like.

The decoration of a TWSI with a graphic design is a multi-step manufacturing process. This process generally comprises multiple steps depending on substrate material type and product usage factors.

The first step in the manufacturing process (powder coat paint and dye/ink sublimation process) for the present invention is to prepare the substrate for the powder coat and dye/ink sublimation processes. Both mechanical and chemical cleaning methods may be used depending on the material type of the substrate. In some embodiments, the substrate is pre-treated by submitting it to at least one step (selected from a list of both mechanical and chemical treatments) of surface preparation selected from the group consisting of degreasing, cleaning, anodic oxidation, neutralization, chromate treatment, phosphochromate treatment, phosphating, nitro cobalt treatment, treatment with chrome-free products and mechanical polishing or sandblasting. After the cleaning is completed, the substrate is dried prior to the painting and/or sublimation process.

The next step is a primer electrocoat process preferably used prior to the powder coat paint process for cast iron, ductile iron and in some cases steel substrates. This primer electrocoat process prevents aging/rusting of the iron or steel material if the installed substrate panel is scraped/scratched all the way through the powder coat paint layer(s) and down to the material surface. Once scraped/scratched on the material surface the iron or steel product will rust or take on a natural patina tone. The electrocoat process prevents this initial scratch from migrating out from the initial scratch location and further damaging the look of the panel. The finish applied is preferably a cathodic epoxy electrocoat product. PPG POWERCRON 6000CX—black cathodic epoxy finish is an example of a product that can be used in this process. Cathodic epoxy coatings offer the corrosion and chemical resistance and serve as a benchmark for primer performance. Applying E-coat is a generally a four step process. (1) In the electrocoat process substrates are cleaned and pretreated with a phosphate conversion coating to prepare the part for electrocoating. (2) Parts are then dipped into an electrocoat paint bath where direct current is applied between the parts and a "counter" electrode. Paint is attracted by the electric field and is deposited on the substrate.—(3) The coated substrate is removed from the bath, and rinsed to reclaim undeposited paint solids (2-3 counter-flowing rinses located after the bath).—(4) The substrate is then baked to cure the paint (standard bake is 20 minutes at 350 degree Fahrenheit metal temperature. The cast iron, ductile iron and steel panels are then ready to be powder coat painted.

The next step of the manufacturing process is used with non-conductive substrates such as plastic, nylon, fiberglass, concrete and plastic composites and the like which require an additional paint process in order to be powder coat painted. This is due to the non-conductive nature of these types of materials (unless conductive additives have been included in the plastic raw material prior to molding thus making it a conductive substrate) and the need to apply powder coat paints utilizing electrostatic methods. Non-conductive plastic substrates are selected from the group consisting of polyamide material, polypropylene material, polycarbonate-acrylonitrile-butadiene-styrene material, acrylonitrile-butadiene-styrene material and blends thereof. There are numerous industry known methods to make a non-conductive substrate conductive enough to powder coat paint. For example, a metal conductive dummy plate can be positioned behind the non-conductive plastic composite at the time the substrate is powder coat painted. Another method is to apply a liquid paint adhesive/primer which then makes the substrate conductive. This liquid paint process comprises the steps of cleaning the substrate, applying a water-based adhesive/primer, curing the adhesive/primer and then applying the desired coats of thermosetting powder and then curing. One such adhesive/primer that is available commercially is Spraylat's conductive coating technology.

The next steps of the manufacturing process relate to powder coat painting for certain substrate material types. Conductive substrates are preferably powder coat painted in order to use sublimation methods to decorate, as well as, meet the necessary slip resistance specifications for a product placed on the ground and used for wayfinding. The first decision to make in the powder coating selection process is to define the finish product requirements. The present invention for both conductive and non-conductive substrates preferably provides a super durable, maximum adhesion, anti-slip (textured), ultra-violet (UV) protection, highly chemical/corrosion resistant and excellent weather ability detectable warning panel. This invention preferably uses a specific powder paint described in more detail below and in the examples since in most cases it will be exposed to the harsh outdoor environment and be located on the surface of the ground (concrete or bituminous pavement). In addition, in most cases the panels will be on the ground and will have to withstand extensive foot traffic and weather related conditions (rain, ice, snow, salt, UV rays, hot and cold temperature fluctuations, substrate shrink and swell). The powder coat paint top layer will include a texturing agent in order to provide the slip resistance required for the TWSI product. In addition, this top layer textured powder coat paint preferably accepts the sublimation dyes/inks for the decoration and/or graphic art on the TWSI substrate.

The powder coat paint may be a thermoplastic or a thermoset polymer. The present invention will use thermoset powder paint. The thermoset powder coat paint is a type of coating that is applied as a free-flowing, dry powder. The coating is applied electrostatically and is then cured under heat to allow it to flow and form a "skin". When a thermoset powder is exposed to elevated temperature, it begins to melt, flows out, and then chemically reacts to form a higher molecular weight polymer in a network-like structure. This cure process, called crosslinking, requires a certain temperature for a certain length of time in order to reach full cure and establish the full film properties for which the powder coat paint material was designed.

The most common way of applying the powder coating on conductive substrates is to spray the powder using an electrostatic gun. The gun imparts a positive electric charge on the powder, which is then sprayed towards the grounded object by mechanical or compressed air spraying and then accelerated toward the work piece by the powerful electrostatic charge. The object is then heated, and the powder melts into a uniform film, and is then cooled to form a hard paint coating. In the present invention, the conductive substrate may be heated first and then sprayed with the powder paint onto the hot substrate.

As with any paint coating, formulation variables are critical to the processing and performance characteristics. The powder coat formulation is much like a liquid coat formulation except for that most of the components are in solid, melt processable form. The main raw material components used in powder coatings are resins, curing agents, accelerators, pigments, fillers, extenders, degassing agents, dry flow agents, flow agents, matting agents, texturing agents, rheological additives and waxes.

The primary resins used in the formulation of thermosetting powders are: epoxy, polyester and acrylic. These primary resins are used with different crosslinkers to produce a variety of powder materials. Many crosslinkers, or curing agents, are used in powder coatings including amines, anhydrides, melamines, and blocked or non-blocked isocyanates. Some materials also use more than one resin in hybrid formulas. The chemical reaction in the cure cycle creates a polymer network that provides excellent resistance to coating breakdown. A thermoset powder that has cured and crosslinked will not melt and flow again if subjected to heat a second time.

Epoxy powders were the first commercially available thermoset materials and they are the most commonly used of the thermoset powders. The primary drawback with epoxy powders for this invention is that they will chalk when subjected to UV radiation. For this reason, this powder paint formulation is not applicable for this invention which is in the outdoor environment and continuously exposed to UV radiation.

Hydroxyl terminated polyester resins are used to formulate urethane polyesters and carboxyl terminated polyester resins can be typically cured by triglycidyl isocyanurate (TGIC) or HAA, hydroxyalkyl amide materials. Urethane polyesters have excellent resistance to outdoor environments, toughness and very good appearance characteristics. A smooth, thin film that resists weathering and physical abuse makes the urethane polyesters a good choice for the outdoor environment. It is common to block the crosslinker in urethane polyesters with e-caprolactam. To begin the crosslinking process, the material preferably reaches a temperature above the blocking agent threshold. With e-caprolactam, unblocking occurs at approximately 182 degrees C. Other curative options include uretdione, self-blocked polyisocyanates for curing/crosslinking hydroxyl functional polyesters. Polyester TGIC coatings use the epoxy functional crosslinker triglycidyl isocyanurate (TGIC). In these coatings a low molecular weight glycidyl, epoxy functional curing agent is used to co-react with the polyester. In this way, the polyester constitutes a very high percentage of the resin and provides weather and corrosion resistance incomparable to the urethane cured polyesters. TGIC's have very good adhesion characteristics, corrosion resistance and exterior durability. They typically can be cured at lower temperatures than urethanes and/or have shorter cure cycles. All of the above powder coatings can be cured at lower temperatures when suitable resins are selected along with appropriate catalysts. Even cures at or below 212 F are possible with UV cure powder coatings.

Acrylic powders also give excellent exterior durability. Common acrylic-based materials include urethane acrylics (hydroxyl functional resins), acrylic hybrids (acid functional resins) and glycidyl methacrylate acrylics (GMA) (epoxy functional resins) which can be cured with diacids and/or anhydrides for example.

The present invention for TWSIs may be powder coat painted with either one or two coats. A third topcoat or protective shield coat layer may also be painted on the panel with either a powder or liquid coat paint. The specific type and number of powder coats and the possible topcoat or protective shield paint layer applied to the TWSI will depend on what is required for the end panel product application. The number and type (non-texture vs. texture) of powder paint coats needed in the first two layers will depend on a number of factors such as, the environment (inside or outdoors), base color in a first layer, and additional colors in successive powder coat layers, desired textures and durability for intended use.

In some embodiments of the present invention, the powder coat paint top layer preferably accepts sublimation of inks/dyes. This process has the advantage in that dyes penetrate 1-2 mils (about 40-80 micrometers) into the surface of the powder coated substrate making them scuff resistant in a walk-over surface. The preferred chemistry for dye sublimation heat transfer powder coatings is the polyester/urethane blend. The difference in the hydroxyl, OH functionality of competing resins can be used to produce gloss controlled thermosetting powder coatings suitable for dye sublimation heat transfer. Use of a medium hydroxyl, OH functional, and a very high OH functional resin in a one shot through the extruder formulation yields a gloss controlled powder coating. The medium hydroxyl functional polyester resin has hydroxyl value in the range of 30-50. The high functionality hydroxyl resin typically has hydroxyl value in the range of 200-300. When the above two polyesters compete for the isocyanate curing agent to cure, an incompatibility is created which results in a controlled lowering of gloss. The number of average molecular weights for the medium hydroxyl value polyester are typically 2200-3200. The number of average molecular weights for the high hydroxyl polyester are typically in the range of 1500-2500. A specially designed resin system for use with Uretdione (self-blocked) as a cross-linker can eliminate the blocking agent, e-caprolactam, evolution. Evaluations carried out with different ratios of medium OH and high OH number resins vary the gloss achieved. Table 5 shows the typical powder coat formulations for dye sublimation heat transfer.

TABLE 5

| Ingredients (b) | 1 | 2 | 3 | 4 | 5 |
|---|---|---|---|---|---|
| Albester 3225 | 500 | 500 | 500 | 500 | 500 |
| Albester 3115 | 166 | 166 | 166 | 166 | 166 |
| Albester 6520 | — | 20 | 40 | 60 | 80 |
| Crelan LS 2147 | 285 | 285 | 285 | 285 | 285 |
| Benzoine | 3 | 3 | 3 | 3 | 3 |
| Resiflow PV 88 | 20 | 20 | 20 | 20 | 20 |
| Bayferrox Yellow 420 (a) | 23 | 23 | 23 | 23 | 23 |
| Bayferrox Red 130 M (a) | 1 | 1 | 1 | 1 | 1 |
| Bayferrox Black 306 T (a) | 2 | 2 | 2 | 2 | 2 |
| Total (b) | 1000 | 1020 | 1040 | 1060 | 1080 |
| Gloss @ 60 Degrees | 16 | 19 | 21 | 24 | 27 |
| LS 2147 Stoich % | 78.10% | 77.71% | 77.40% | 76.90% | 76.50% |

(a) Pigments added to powder coat paint
(b) Units - grams/lbs./tons

Figure 41:
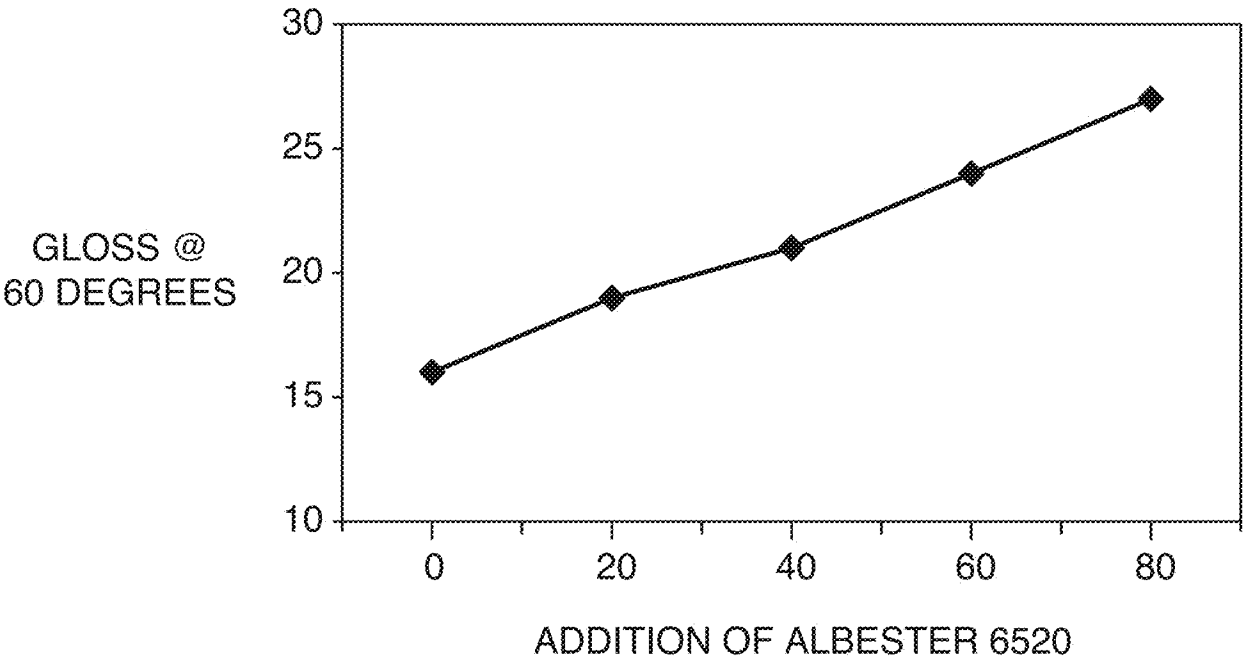
FIG. 41 shows the gloss modification relationship for Albester 6520.

Two polyester resins, Albester 3115 and Albester 3225 are specially designed for the use with Uretdione curing agents. Albester 6520 is designed as the gloss control resin and Albester 6320 is designed as a high durability, high Isophthaic Acid content, resin to improve the weatherability of the system. For the low gloss to properly develop, cure is preferably achieved. Minimum temperature for thermoset cure is determined by the isocyanates curing agent used as well as the choice/concentration of urethane catalysts. By using a medium hydroxyl value polyester, Albester 3225, a high hydroxyl value polyester, Albester 3115 and Crelan LS 2147 in powder coating formulations very low gloss coatings can be achieved. The excellent chemical resistance of the Albester 3115 and Albester 3225 system makes it suitable for exterior applications where high chemical resistance and durability are required. The low gloss polyester/urethane powder coating for dye sublimation heat transfer technology works as follows. In order for the process to yield high resolution full-color graphic design results the first layer base coat should be a white powder coat paint with a second layer topcoat of low gloss textured clear/transparent powder coat paint. Gloss modification is required to obtain the low gloss in the textured clear/transparent powder coat paint top layer. FIG. 41 shows how the additive Albester 6520 can be used to modify the gloss level of the powder coat paint.

The need for an additional powder coat or liquid paint topcoat or protective shield depends on the required durability, weather ability, and UV protection required for the end product. The main purpose for the additional topcoat or protective shield is for additional protection for the panel from UV rays and thus fading of the decoration or graphic art. In addition, the topcoat or protective shield can add additional slip resistance and anti-graffiti protection.

The powder coat paint process requires an electrostatic environment in order for the powder paint to adhere to the substrate prior to the baking/curing process. Certain types of substrate materials such as steel and cast iron can conduct the electrostatic charge needed for the powder paint process. These types of substrate materials are conductive. It is more challenging to paint non-conductive substrate materials such as plastics, sheet molding compound, plastic composites, nylon, nylon6, nylon66, fiberglass, concrete, and the like. Thus, both conductive and non-conductive substrate materials have their own set of rules for applying powder coat paints. The non-conductive substrate types preferably have a liquid adhesive primer paint applied to the substrate prior to the powder coat paint process. This adhesive primer serves many purposes such as, it increases the electrical surface conductivity, it allows the powder to bond properly during the powder curing stage, and it protects the surface of the non-conductive substrate from any undue chemical reaction with the thermosetting powder and it increases and enhances the transfer efficiency of the powder to the substrate.

Different clear/transparent textured topcoat powder coat paint formulations were developed and field tested for this invention. These powder coat paint texture formulations had to provide many different physical characteristics. These textured powder coatings had to impart durability, weatherability, UV protection, abrasion resistance, slip resistance, chemical corrosion resistance, anti-graffiti and the like. In addition, the inks/dyes from the sublimation process had to penetrate into this clear/transparent texture and provide a good graphic image quality. Super durable which are charged with UV inhibitors resins have been developed to give extended durability compared with conventional exterior coatings. A definition in terms of performance as to what is required from a super durable resin can be found in the Qualicoat Standard (super durable resins are called class 2 powders in this standard). A super durable powder preferably retains at least 90 percent of its original gloss level after one year in Florida and at least 50 percent of its gloss after three years' Florida weathering. Some raw materials used in resin manufacture give extended durability but do not give good mechanical results. Thus, various methods are being looked at to improve this situation. Resin manufacturers continue to develop super durable resins for curing with alternative crosslinkers.

The present invention includes several different textured powder coat paint formulations. Two of these textures were found to consistently provide the best results regarding the required criteria for the top layer of the TWSI. These two textured top layer powder coat paints have been labeled DS707 and ADA 1104/06. The non-abrasive gripping surface of the various textured powder coat paints function to provide the required slip resistance for this product. In addition, this texture also increases the durability of the powder coat paints.

Figure 11:
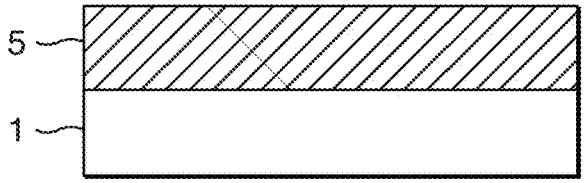
FIG. 11 shows a conductive substrate 1 painted with one layer of powder coat paint 5. Powder coat paint layer 5 is a white textured powder coat paint (ADA 1104/06-W chemical texture)
Figure 12:
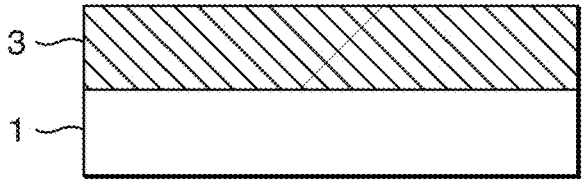
FIG. 12 shows a conductive substrate 1 painted with one layer of powder coat paint 3. Powder coat paint layer 3 is a white textured powder coat paint (ADA 1104/04-W rubber texture)
Figure 13:
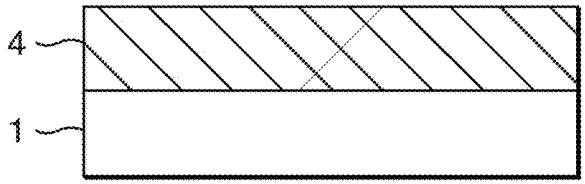
FIG. 13 shows a conductive substrate 1 painted with one layer of powder coat paint 4. Powder coat paint layer 4 is a white textured powder coat paint (ADA 1104/05-W rubber texture)
Figure 14:
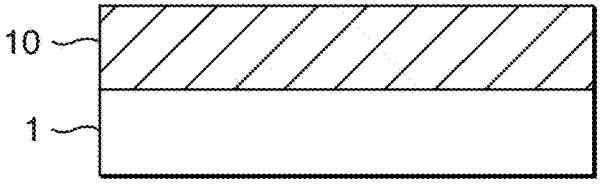
FIG. 14 shows a conductive substrate 1 painted with one layer of powder coat paint 10. Powder coat paint layer 10 is a clear/transparent matte textured polyurethane powder coat paint (DS707 texture)
Figure 15:
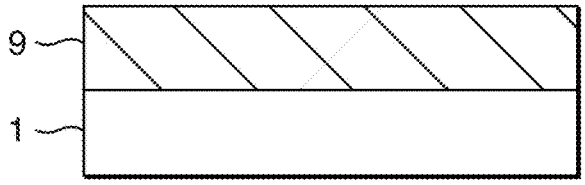
FIG. 15 shows a conductive substrate 1 painted with one layer of powder coat paint 9. Powder coat paint layer 9 is a clear/transparent matte textured polyurethane superdurable powder coat paint (ADA 1104/06 chemical texture)
Figure 16:
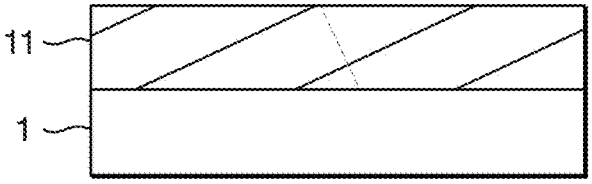
FIG. 16 shows a conductive substrate 1 painted with one layer of powder coat paint 11. Powder coat paint layer 11 is a clear/transparent powder coat paint (no texture)
Figure 17:
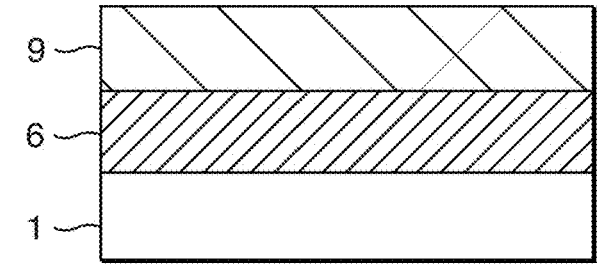
FIG. 17 shows a conductive substrate 1 painted with two layers of powder coat paint. The first layer 6 is a white polyester powder coat paint (no texture) and the second layer 9 is a clear/transparent matte textured polyurethane superdurable powder coat paint (ADA 1104/06 chemical texture)
Figure 18:
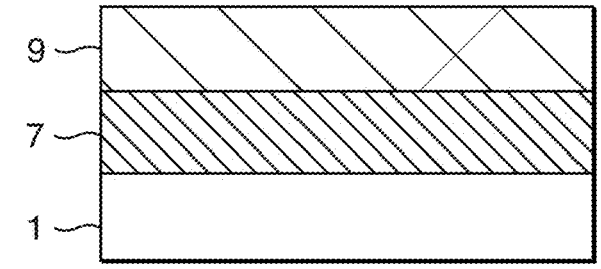
FIG. 18 shows a conductive substrate 1 painted with two layers of powder coat paint. The first layer 7 is a white textured powder coat paint (MDPC90 texture) and the second layer 9 is a clear/transparent matte textured polyurethane superdurable powder coat paint (ADA 1104/06 chemical texture)
Figure 19:
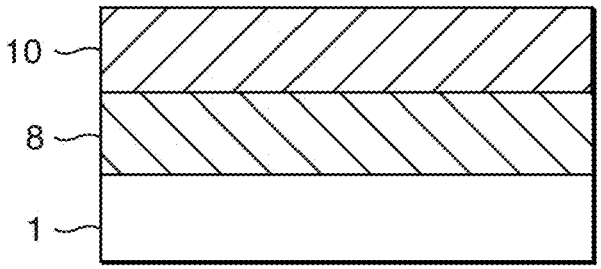
FIG. 19 shows a conductive substrate 1 painted with two layers of powder coat paint. The first layer 8 is a white textured powder coat paint (MDPC60A chemical texture) and the second layer 10 is a clear/transparent matte textured polyurethane powder coat paint (DS707 texture)
Figure 20:
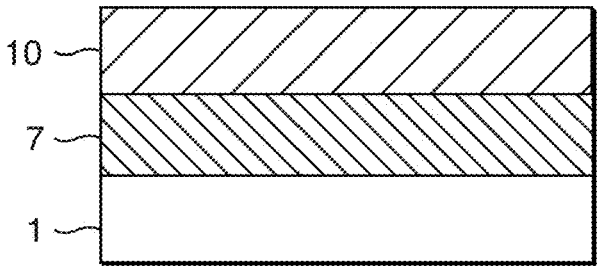
FIG. 20 shows a conductive substrate 1 painted with two layers of powder coat paint. The first layer 7 is a white textured powder coat paint (MDPC90 texture) and the second layer 10 is a clear/transparent matte textured polyurethane powder coat paint (DS707 texture)
Figure 21:
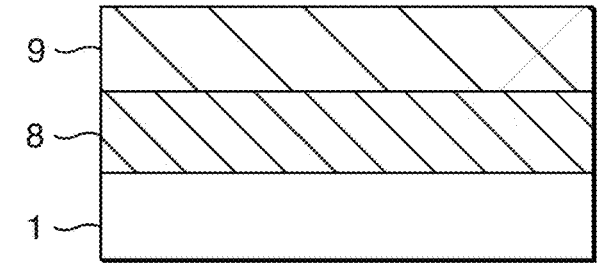
FIG. 21 shows a conductive substrate 1 painted with two layers of powder coat paint. The first layer 8 is a white textured powder coat paint (MDPC60A chemical texture) and the second layer 9 is a clear/transparent matte textured polyurethane superdurable powder coat paint (ADA 1104/06 chemical texture)
Figure 22:
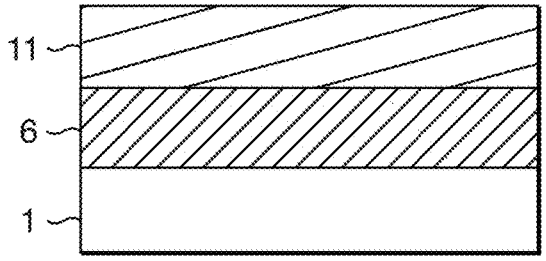
FIG. 22 shows a conductive substrate 1 painted with two layers of powder coat paint. The first layer 6 is a white polyester powder coat paint (no texture) and the second layer 11 is a clear/transparent powder coat paint (no texture)
Figure 23:
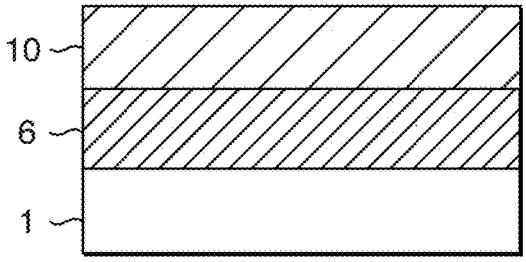
FIG. 23 shows a conductive substrate 1 painted with two layers of powder coat paint. The first layer 6 is a white polyester powder coat paint (no texture) and the second layer 10 is a clear/transparent matte textured polyurethane powder coat paint (DS707 texture)
Figure 24:
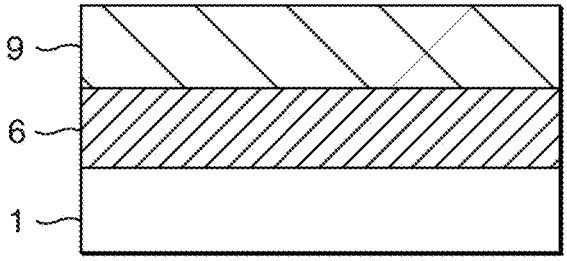
FIG. 24 shows a conductive substrate 1 painted with two layers of powder coat paint. The first layer 6 is a white polyester powder coat paint (no texture) and the second layer 9 is a clear/transparent matte textured polyurethane superdurable powder coat paint (ADA 1104/06 chemical texture)

The present invention includes the painting of conductive substrates with different combinations of powder coat paint. This can be either one or multiple coats of powder coat paint. The overriding requirement is that the top layer of powder coat paint has to be able to both receive sublimated dyes for the graphic design and provide the necessary slip resistance required for the detectable warning panel. Many different paint combinations were tried and tested. FIGS. 11-24 detail the powder coat paint types and combinations that met all the necessary criteria. FIG. 11 shows a conductive substrate 1 painted with one layer of powder coat paint 5. Powder coat paint layer 5 is a white textured powder coat paint (ADA 1104/06-W chemical texture). FIG. 12 shows a conductive substrate 1 painted with one layer of powder coat paint 3. Powder coat paint layer 3 is a white textured powder coat paint (ADA 1104/04-W rubber texture). FIG. 13 shows a conductive substrate 1 painted with one layer of powder coat paint 4. Powder coat paint layer 4 is a white textured powder coat paint (ADA 1104/05-W rubber texture). FIG. 14 shows a conductive substrate 1 painted with one layer of powder coat paint 10. Powder coat paint layer 10 is a clear/transparent matte textured polyurethane powder coat paint (DS707 texture). FIG. 15 shows a conductive substrate 1 painted with one layer of powder coat paint 9. Powder coat paint layer 9 is a clear/transparent matte textured polyurethane superdurable powder coat paint (ADA 1104/06 chemical texture). FIG. 16 shows a conductive substrate 1 painted with one layer of powder coat paint 11. Powder coat paint layer 11 is a clear/transparent powder coat paint (no texture). FIG. 17 shows a conductive substrate 1 painted with two layers of powder coat paint. The first layer 6 is a white polyester powder coat paint (no texture) and the second layer 9 is a clear/transparent matte textured polyurethane superdurable powder coat paint (ADA 1104/06 chemical texture). The powder paint combination on FIG. 17 is the preferred method based on slip resistance, other durability tests, as well as, the quality of the graphic design image on the detectable warning panel. FIG. 18 shows a conductive substrate 1 painted with two layers of powder coat paint. The first layer 7 is a white textured powder coat paint (MDPC90 texture) and the second layer 9 is a clear/transparent matte textured polyurethane superdurable powder coat paint (ADA 1104/06 chemical texture). FIG. 19 shows a conductive substrate 1 painted with two layers of powder coat paint. The first layer 8 is a white textured powder coat paint (MDPC60A chemical texture) and the second layer 10 is a clear/transparent matte textured polyurethane powder coat paint (DS707 texture). FIG. 20 shows a conductive substrate 1 painted with two layers of powder coat paint. The first layer 7 is a white textured powder coat paint (MDPC90 texture) and the second layer 10 is a clear/transparent matte textured polyurethane powder coat paint (DS707 texture). FIG. 21 shows a conductive substrate 1 painted with two layers of powder coat paint. The first layer 8 is a white textured powder coat paint (MDPC60A chemical texture) and the second layer 9 is a clear/transparent matte textured polyurethane superdurable powder coat paint (ADA 1104/06 chemical texture). FIG. 22 shows a conductive substrate 1 painted with two layers of powder coat paint. The first layer 6 is a white polyester powder coat paint (no texture) and the second layer 11 is a clear/transparent powder coat paint (no texture). FIG. 23 shows a conductive substrate 1 painted with two layers of powder coat paint. The first layer 6 is a white polyester powder coat paint (no texture) and the second layer 10 is a clear/transparent matte textured polyurethane powder coat paint (DS707 texture). FIG. 24 shows a conductive substrate 1 painted with two layers of powder coat paint. The first layer 6 is a white polyester powder coat paint (no texture) and the second layer 9 is a clear/transparent matte textured polyurethane superdurable powder coat paint (ADA 1104/06 chemical texture).

The powder coat paint industry (QUALICOAT) has developed criteria in order to describe the different physical characteristics of powder coat paint texture types. Textured finishes can be split into three families according to their appearance. The three families of textured finishes area as follows:

1. Leathered (or Orange Peel) effect is generally produced by taking advantage of the phenomenon of incompatibility between some components in the coating product formulation. The surface has an orange peel appearance. Texture type DS707 is classified in this category.

2. Sandpaper effect is generally produced by adding particular substances, such as rubber, Teflon based waxes, fillers with a high oil content, etc. to the formulation of coating products. This gives the surface an appearance resembling sandpaper. Texture types ADA 1104/04, ADA 1104/05 and ADA 1104/06 are classified in this category.

3. Wrinkled effect is obtained using a technology generally derived from the reactivity between hydroxylated resins and melamine resins.

Once the substrate is powder coat painted and cured, the next step is to use dye/ink sublimation techniques to put a decoration/printed media/graphic art/corporate logo/advertising in the first layer (various colors/no texture/with texture) or second layer (clear/transparent texture layer) of the substrate depending on the number of layers of powder coat paint. It will be recognized by those of skill in the art that other methods may also be used to decorate the substrate with a desired graphic design. The dye/ink sublimated decoration will go in the top layer of powder coat paint. This patented dye/ink sublimation process and related equipment is detailed in six different patents. These Patents and Patent Applications are hereby incorporated by reference in their entirety and include U.S. Pat. No. 6,015,469 (Jan. 18, 2000), U.S. Pat. No. 6,136,126 (Oct. 24, 2000), U.S. Pat. No. 6,335,749 (Jan. 1, 2002), U.S. Pat. No. 6,676,792 (Jan. 13, 2004), U.S. Pat. No. 7,033,973 (Apr. 25, 2006), U.S. Pat. No. 7,077,926 (Jul. 18, 2006), U.S. Pat. No. 7,302,981 (Dec. 4, 2007).

Dye/Ink sublimation is a direct transformation of the inks from a solid state to a vapor/gas state (without turning into a liquid). Sublimation decoration has many advantages compared with other decoration means. The ink vapors penetrate the powder coat top layer of the substrate and generate bright, colorful, vivid, resistant and no-thickness decorations. The dyes/inks sublimate into the top powder coat layer and take on the characteristics of this layer of powder coat. Thus, the decoration can support even heavy wear, abrasive and outdoor environments/conditions, including a high resistance to many chemicals.

After the substrate is powder coat painted and cured, preferably with the appropriate super durable (outdoor environment) types/layers of paint (colored powder paint, colored textured powder coat paint, clear/transparent textured powder coated paint), the substrate is then ready for the patented dye/ink sublimation process. This patented dye/ink sublimation process is designed for any three-dimensional, complex shaped, nonplanar object or substrate.

In preferred embodiments, graphics software is utilized to format and refine the digital decoration or graphic image that is to be sublimated onto the substrate. The graphics software generally accepts graphic images in file formats such as TIFF or PSD. Once the digital image has been formatted and aligned properly in the software program, including picking the appropriate pantone colors and letter fonts, the image is then printed on transfer film. A customized wide printer/plotter is used to print the decoration/graphic art image onto the clear transfer film/fabric with organic photosensitive pigments (dyes/inks) and cellulose resin. This clear transfer film/fabric may include alignment aids on the film. These alignment aids are useful for installing the decoration/graphic image on the three-dimensional, nonplanar or complex shaped substrates either in the center and/or straight. It will be important with the same decoration/graphic image to align the transfer film on the substrates exactly the same every time especially in a high production environment.

The powder coated substrate is placed on a specially designed table, rack or membrane system. This table top, rack, or membrane system may preferably have alignment aids built into it. These alignment aids may include on the table top or rack system marked notations, a saddle, mold or jig. The alignment aids will guarantee that the substrate is aligned properly for the sublimation process. In addition, the alignment aids will keep the substrate steady during the sublimation process. The transfer film/fabric is then placed on and wrapped over and/or around the substrate. The transfer film/fabric is then slightly warmed with IR technology, blown up slightly and then utilizing a pressure vacuum (around 200 Millibar) seal system the film is then sucked down and around the three-dimensional, nonplanar, complex shaped substrate (Decoral equipment using vacuum and heat combined). The substrate with the transfer film/fabric sucked tightly to it is then placed in an IR (infrared) technology oven, non-IR oven or other heat oven. Alternatively, the substrate may be wrapped with the transfer film/fabric and placed on or between a membrane(s). The membrane may preferably be made of high temperature silicon or other high temperature elastomeric material that will provide a sufficient pressure when vacuum is applied to conform to the shape of the substrate. Utilizing a pressure vacuum (e.g., around 200 millibar) seal system, the membrane is then compressed down and around the substrate using vacuum equipment (e.g., from Decoral). The dye/ink sublimation normal cure process takes place at around 300-400 F for 30 seconds to 30 minutes (depending on product) in order to obtain sublimation. This dye/ink sublimation transfer system makes the dyes/inks go from a solid state becoming gas and again back to solid without going into a liquid state. At the correct temperature and pressure, the pigment dyes/inks transfer from the film support and move into the synthetic layer of the textured powder coat paint, fixing both the color and graphic image position into it. Factors affecting the best quality and results are: right temperature, time and mechanical pressure. Since the full penetration of the pigment dyes/inks into the coating layer is the basic condition to get the highest quality result the Decoral System has adapted a microscope control system that allows an immediate quality check of the decorated pieces. Another reason for using this test is that it is an easy way to check how the pigments melt with the paint molecular structure of the coating layer.

Figure 25:
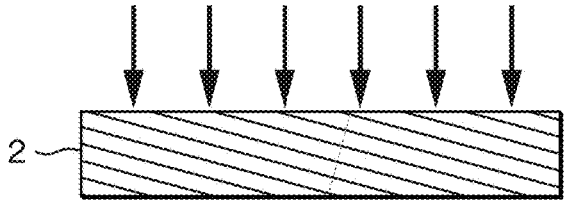
FIG. 25 shows the decoration using dye sublimation methods for a non-conductive substrate 2 (sheet molding compound)
Figure 26:
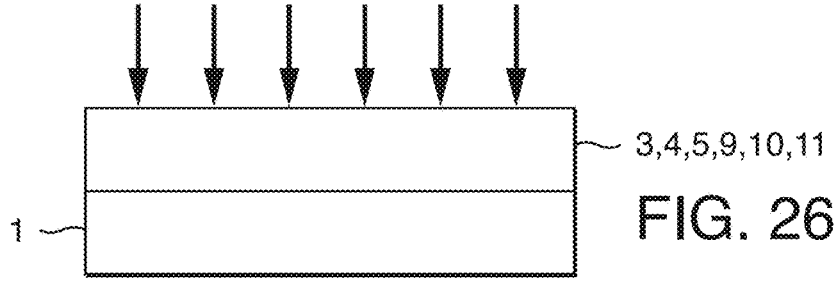
FIG. 26 shows the decoration using dye sublimation methods for a conductive substrate 1 with one layer of powder coat paint chosen from the following 3, 4, 5, 9, 10, and 11. The drawing shows the heat transfer of the dyes into the one layer of powder coat paint.
Figure 27:
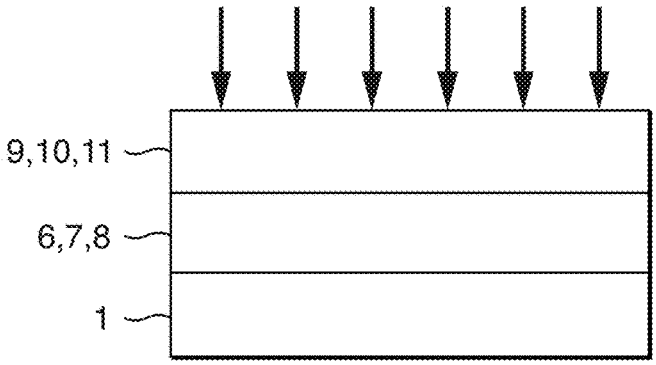
FIG. 27 shows the decoration using dye sublimation methods for a conductive substrate 1 with two layers of powder coat paint. The first layer of powder coat paint chosen from the following 6, 7, 8. The second layer of powder coat paint being chosen from the following 9, 10, and 11. The drawing shows the heat transfer of the dyes into the second top layer of powder coat paint.

The substrate is then removed from the curing oven or IR technology and allowed to cool. Once the substrate has cooled the transfer film/fabric is removed from the substrate. The decoration or graphic image is now in the top layer of powder coat paint (not on the surface but actually in the powder paint). This provides the decoration or graphic image the same durability as that of the powder coat paint (required for the outdoor environment). FIG. 25 shows the decoration using dye sublimation methods for a non-conductive substrate 2 (sheet molding compound). The drawing shows the heat transfer of the dyes, at the right pressure and temperature, directly into the sheet molding compound substrate. FIG. 26 shows the decoration using dye sublimation methods for a conductive substrate 1 with one layer of powder coat paint chosen from the following 3, 4, 5, 9, 10, and 11. The drawing shows the heat transfer of the dyes into the one layer of powder coat paint. FIG. 27 shows the decoration using dye sublimation methods for a conductive substrate 1 with two layers of powder coat paint. The first layer of powder coat paint chosen from the following 6, 7, 8. The second layer of powder coat paint being chosen from the following 9, 10, and 11. The drawing shows the heat transfer of the dyes into the second top layer of powder coat paint.

This sublimation process includes powder coat paint, textured powder coat paint, textured powder paints that can except sublimated dyes/inks, transfer film/fabric, dyes/inks and sublimation equipment. This patent includes the option of putting a bar code, QR code, manufacturer name, date manufactured or other pertinent informational as part of the decoration or graphic art on the three-dimensional, nonplanar or complex shaped substrate.

At the present time many different types of metal objects have been painted in both solid colors and multi-colors. In addition, these metal objects have been decorated using silk printing, dye/ink sublimation and other methods. Typically, these metal objects are flat and have been used for indoor and/or outdoor sign applications such as the ubiquitous stop sign. For instance, U.S. Pat. No. 8,017,297 B1 discloses a method wherein a substantially planar (planar substrate that is flat or lying in a single geometric plane or a two dimensional substrate having only two dimensions) metal electrically conductive powder coated substrate is sublimated with an image on the surface. After the application and curing of both the powder coat paint and the dye/ink sublimation process, this substantially planar substrate is then shaped into a nonplanar article. This technique has significant drawbacks. The first drawback is that because it is difficult to apply an image to a complex three-dimensional shaped nonplanar article, the substantially planar substrate is first powder coat painted, the sublimated image applied and then it is stated that the painted and decorated planar substrate is formed into the desired shape.

U.S. Pat. No. 8,017,297 does not explain in any detail how both the powder coat paint and the sublimated image will need to stretch and bend in order to achieve the desired nonplanar substrate. The surface paint and sublimated image that is later shaped into a three-dimensional substrate may crack or get paint stretch marks (lighter color paint in the stretched or bend areas of the substrate). Thus, a quality image on a painted and dye sublimated planar substrate which is then shaped into a nonplanar object is very difficult to achieve using this process. No reference in the patent is made to the amount of physical stress (stretching and bending) the paint and dye/ink can handle before it fails and the image quality is compromised. Without unique stretchable/elastic powder paint and sublimation inks there can be significant loss of image quality or image degradation using this process. The second drawback is that it is difficult to provide a consistent quality painted substrate product using this method. Depending on the type and extent of post forming, different types of powder coat paint and dye/inks will be needed to handle the stress induced by the bending and stretching process. How much bending/stretching/forming can be achieved and the particular powder paint and dyes/inks needed to accomplish different types of bending/forming is not addressed in this patent. The third drawback is that this method does not address the paint and dyes/inks needed for outdoor environmental challenges such as UV radiation damage and weather related issues (temperatures both hot and cold, ice, salt, acid rain, etc.). There is a significant difference in the powder coat paints and dyes/inks needed to withstand the harsh outdoor environment. The fourth drawback of this patent is that it does not address the painting and dye/ink sublimation process for non-conductive substrates.

U.S. Pat. No. 6,987,081 B2 discloses a method for painting a metal sheet on which a printed design full of variety is given with a sublimation dye. The patent discusses the thermosetting powder paint and dye/ink sublimation process needed for a metal substrate. In addition, the patent claims textured glass flakes or silica topcoat powder paint that can be used for transfer-printing with a sublimation dye. The topcoat paint layer contains a component selected from a group of UV absorbing agents. The patent has many drawbacks. The first drawback is that the patent provides a paint process for only metal sheets. The second drawback is that the patent does not provide a means or method to paint and apply the sublimated decoration/graphic art to a three-dimensional shaped substrate. The third drawback is that the process to paint and sublimate dyes/inks does not include non-conductive substrates. The fourth drawback is that the patent does not provide the durable paint and/or sublimated dyes/inks needed for a substrate that is designed to be installed flat on the ground. This type of substrate will be required to withstand a very harsh outdoor environment including UV rays, snow, ice, hot, cold, frost, chemicals, graffiti, etc. In addition, the substrate needs to have the durability to withstand extensive foot traffic, motor vehicles, construction vehicles, snow plows, etc.

The final step in the decoration process is once the dye/ink sublimation is completed and the decoration or graphic image is in the top layer of powder coat paint an optional topcoat or protective shield layer may be applied to the substrate. This topcoat or protective shield could be either a liquid or powder coat paint product. The purpose of this final layer of paint is to provide additional protection for the decoration/graphic image from the harsh outdoor environment. This additional paint layer of protection may not be needed due to the durability of the powder coat paint layers. But certain outdoor environments may require additional protection and in those cases this topcoat may be applied. This protective shield coating could be a nano-coating technology paint product. This protective shield coating protection could add additional UV resistance, anti-graffiti, slip resistance, corrosion resistance, wear resistance and non-wetting or dirt repellant protection.

Sheet molding compound (SMC) or sheet molding composite is a ready to mold fiber-reinforced polyester material primarily used in compression molding. Molded products can be molded in various sizes and include flat panels or complex multidimensional shapes. SMC is both a process and reinforced composite material. The SMC is manufactured by dispersing strands of chopped glass fibers on a bath of polyester resin. SMC is commonly manufactured as a sheet. This manufacturing process allows glass percentages from 15% to 65% to be incorporated into the matrix. The resin system of the SMC may be either polyester or vinyl ester chemistry to meet specific physical performance characteristics which may include chemical resistance, hardness, flexibility or other properties required in the final product. In addition to glass and resin SMC contains other additives. The glass length can be increased up to 2". SMC offers the possibility of continuous strand or matte. SMC's come in a wide range of colors. SMC's have excellent physical, thermal, flame and chemical resistance properties.

As with other thermosets, SMC is a mixture of polymer resin, inert fillers, fiber reinforcement, catalysts, pigments, stabilizers, release agents, and thickeners. Manufacturing of SMC is a continuous in-line process. The base components of liquids and solids (paste) are bulk mixed and continuously metered onto the surface of a carrier/barrier film, coating the film surface. Two mirror imaged metering stations operate simultaneously. One of the paste-coated films are then layered with chopped fibers. The two carrier webs, paste and fiber are then brought together in the compaction section, where the sandwich-like layered components are combined into one compound sheet. The sheet is then stored in a controlled environment where maturation takes place, on its way to specified viscosity.

Compared to similar materials, SMC benefits from very high volume production ability, excellent part reproducibility, high strength-to-weight ratio and low labor requirements per production levels.

The present invention includes a system of decoration by heat transfer whereby the desired decoration is sublimated directly into the SMC substrate. Currently metal substrates require one or multiple layers of powder coat paint prior to apply a decoration into this powder coat paint. The SMC substrate with glass content in the range of 15% to 60%, within the polyester resin base, can be decorated using sublimation methods without any powder coat paint. In addition, the SMC substrate does not have to be a conductive substrate. With the right combination of heat, time and vacuum pressure the decoration printed with sublimation dyes/inks are able to penetrate into the SMC surface. In preferred embodiments, manufacturing a quality graphic design on the SMC substrate, and making it consistently reproducible, involves adjusting the temperature, time and vacuum pressure for the type of SMC substrate (glass content and resin fillers). The penetration of sublimation of the dyes/inks is several mils of thickness directly into the SMC substrate. The decoration embedded in the surface of the SMC substrate takes on all the protective qualities of the underlying SMC substrate (i.e. UV resistance, chemical resistance, durability, etc).

This direct sublimation decorating into SMC substrates provides the opportunity to use the substrate for a multitude of consumer products including advertising, promotion applications, as well as, any products that require an aesthetically pleasing decorated surface.

The SMC substrates or articles of the present invention preferably comprise from ≤15%-65% glass, or from 5% to 65% glass, 10% to 65% glass, or 15% to 65% glass. In preferred embodiments, substrates or articles preferably exhibit a smooth resin rich surface; low profile SMC provides such a surface wherein the formulation of the SMC material allows for very low or no shrinkage and a concentration of resin on the surface to be decorated. Such SMC materials are sometimes referred to as "appliance grade".

Alternatively, a more resin rich surface of less than or equal to 15% glass can be attained by utilizing a dual laminate structure whereby the layer where the sublimation dyes are applied (described in more detail below) is comprised of an SMC material consisting of less than or equal to 15% glass and additional or underlying structural layers can be included that contain greater amounts of glass up to 65% glass. SMC formulations may contain other materials besides glass and resin such as filler materials or other additives. Such filler materials may include calcium carbonate, aluminum trihydrate, glass microspheres or other additives such as stabilizers, release agents, catalysts, and other proprietary ingredients to improve moldability of the SMC and thereby laminate image quality. Such ingredients also allow for varying physical properties for structural purposes, chemical resistance, moldability and appearance. In addition to filler materials pigments can also be added to the SMC materials. These pigments can work in conjunction with one or more sublimation dyes for color and image enhancement.

Like sublimation on other non SMC surfaces such as powder coating, it has been determined that pigmentation of the SMC materials and the selection of sublimation dyes must be determined together when attaining a decorative image.

Ultra Violet inhibitors may preferably be added to the SMC materials to provide color fastness to the finished product for outdoor use. These inhibitors do not affect the image quality of the sublimation dyes which also may contain their own U-V resistant properties for such use. Both the use of U-V inhibitors in the SMC and U-V resistant sublimation dyes are necessary to attain proper color, retention and image quality just as with U-V resistant powder coat and U-V resistant sublimation dyes.

As described in more detail below, the process whereby SMC molded products can be decorated using sublimation dyes requires the application of preprinted film/fabric containing sublimation dyes to be placed in contact with the surfaces of the SMC molded substrate. Through the application of vacuum/pressure and specified heat for a specified time the preprinted images are sublimated into the resin rich layer of the SMC. Being a nonconductive material the time required for processing SMC substrates can vary significantly from that of steel or other conductive products. The length of time is determined by the product density and size of the SMC molded product. During this process, the SMC is preferably of suitable density to preclude the potential for rupturing of the SMC due to expansion of air pockets in the SMC. This can cause cosmetic defects in the sublimated image or delamination of the substrate. While this condition may be somewhat controlled by the temperature and duration of the process generally speaking SMC molded parts that are of such a quality resulting in air entrapment in the SMC molded product are not suitable for dye sublimation with this process.

In preferred embodiments, the SMC substrates are decorated essentially as described above for metal powder coated substrates. Accordingly, in preferred embodiments, graphics software is utilized to format and refine the digital decoration or graphic image that is to be sublimated onto the substrate. The graphics software generally accepts graphic images in file formats such as TIFF or PSD. Once the digital image has been formatted and aligned properly in the software program, including picking the appropriate pantone colors and letter fonts, the image is then printed on transfer film. A customized wide printer/plotter is used to print the decoration/graphic art image onto the clear transfer film/fabric with organic photosensitive pigments (dyes/inks) and cellulose resin. This clear transfer film/fabric may include alignment aids on the film. These alignment aids are useful for installing the decoration/graphic image on the three-dimensional, nonplanar or complex shaped substrates either in the center and/or straight. It will be important with the same decoration/graphic image to align the transfer film on the substrates exactly the same every time especially in a high production environment.

In further preferred embodiments, the SMC substrate is placed on a specially designed table, rack or membrane system. This table top, rack, or membrane system may preferably have alignment aids built into it. These alignment aids may include on the table top or rack system marked notations, a saddle, mold or jig. The alignment aids preferably guarantee that the substrate is aligned properly for the sublimation process. In addition, the alignment aids will keep the substrate steady during the sublimation process. A transfer film/fabric is then placed on and wrapped over and/or around the substrate. The transfer film/fabric is then slightly warmed with IR technology, blown up slightly and then utilizing a pressure vacuum (around 200 Millibar) seal system the film is then sucked down and around the three-dimensional, nonplanar, complex shaped substrate (e.g., using Decoral equipment using vacuum and heat combined). The substrate with the transfer film/fabric sucked tightly to it is then placed in an IR (infrared) technology oven, non-IR oven or other heat oven. Alternatively, the substrate may be wrapped with the transfer film/fabric and placed on or between a membrane(s). The membrane may preferably be made of high temperature silicon or other high temperature elastomeric material that will provide a sufficient pressure when vacuum is applied to conform to the shape of the substrate. Utilizing a pressure vacuum (e.g., around 200 millibar) seal system, the membrane is then compressed down and around the substrate using vacuum equipment (e.g., from Decoral). The dye/ink sublimation normal cure process takes place at around 300-400 F for 30 seconds to 30 minutes (depending on product) in order to obtain sublimation. This dye/ink sublimation transfer system makes the dyes/inks go from a solid state becoming gas and again back to solid without going into a liquid state. At the correct temperature and pressure, the pigment dyes/inks transfer from the film support and move into the synthetic layer of the textured powder coat paint, fixing both the color and graphic image position into it. The temperature, time and mechanical pressure are adjusted to provide the highest quality graphic design. Since the full penetration of the pigment dyes/inks into the coating layer is the basic condition to get the highest quality result the Decoral System has adapted a microscope control system that allows an immediate quality check of the decorated pieces. Another reason for using this test is that it is an easy way to check how the pigments melt with the paint molecular structure of the coating layer.

The substrate is then removed from the curing oven or IR technology and allowed to cool. Once the substrate has cooled the transfer film/fabric is removed from the substrate. The decoration or graphic image is now in the top layer of powder coat paint (not on the surface but actually in the powder paint). This provides the decoration or graphic image the same durability as that of the powder coat paint (required for the outdoor environment). FIG. 25 shows the decoration using dye sublimation methods for a non-conductive substrate 2 (sheet molding compound). The drawing shows the heat transfer of the dyes, at the right pressure and temperature, directly into the sheet molding compound substrate.

C. Systems and Methods Utilizing TWSI's

Numerous types of media are used to advertise/promote products and services in various settings. The type of advertising media used can vary depending upon the environment in which it is placed. The present invention, TWSI panel with a graphic design and advertising system, may be categorized in what is called the Out of Home (OOH) advertising space. This advertising media is in contrast to print, internet and TV. OOH advertising is focused on advertising to people when they are "on the go", outside the home in public places, in transit, as well as, in specific commercial locations such as retailers. OOH advertising is essentially any type of advertising that reaches consumers while they our outside their home. In 2011, OOH advertising spending worldwide was approximately $31 billion, or approximately 7% of worldwide advertising spending. OOH advertising spending in the United States in 2011 was approximately $6 billion.

OOH formats fall into four major categories. These categories are:

Billboards—Standardized large format advertising displays intended for viewing from extended distances. Examples include, bulletins, digital billboards, posters, junior posters and wall murals.

Street Furniture—Advertising displays, many that provide a public service, positioned in close proximity to pedestrians and shoppers for eye-level viewing, or curbside to influence vehicular traffic. Examples include, bus shelters, newsstands and newsracks, kiosks, bicycles, bicycle racks, public restrooms, in store advertising and shopping malls.

Transit—Advertising displays affixed to moving vehicles or positioned in the common areas of transit stations, terminals or airports. Examples include, mobile billboards, bus wraps, taxicabs, bus interiors, truckside & fleet displays and in-flight advertising.

Alternative media—This category covers just about anything you can imagine. New products are constantly being developed and marketed. Examples include, arena & stadium advertising, cinema ads, projection ads, gas pump toppers, ice machine wraps, etc.

Local jurisdictions typically regulate the amount and type of OOH advertising. For example, in the United States, the states of Vermont, Hawaii, Maine, and Alaska prohibit billboard advertising. Scenic America estimates the nationwide total of cities and communities prohibiting the construction of billboards to be at least 1,500.

There has been significant growth in OOH in part due to structural changes in populations, which are increasingly moving to urban environments. This has created situations where a greater amount of time is spent in cars going to work, as well as, people spending more time outside their homes. Based on industry studies, people spend approximately 70% of their waking hours out of their homes. The proliferation of smartphones and computers allow people to access communication and the internet while "on the move". Today's OOH industry offers new technologies, new formats, and more creative thinking to help advertisers take their message further. The industry is embracing innovative ideas across all of its business categories in order to keep pace with advertisers and the mobile consumer. Many advertisers today are trying to promote their products at point of sale.

Figure 28:
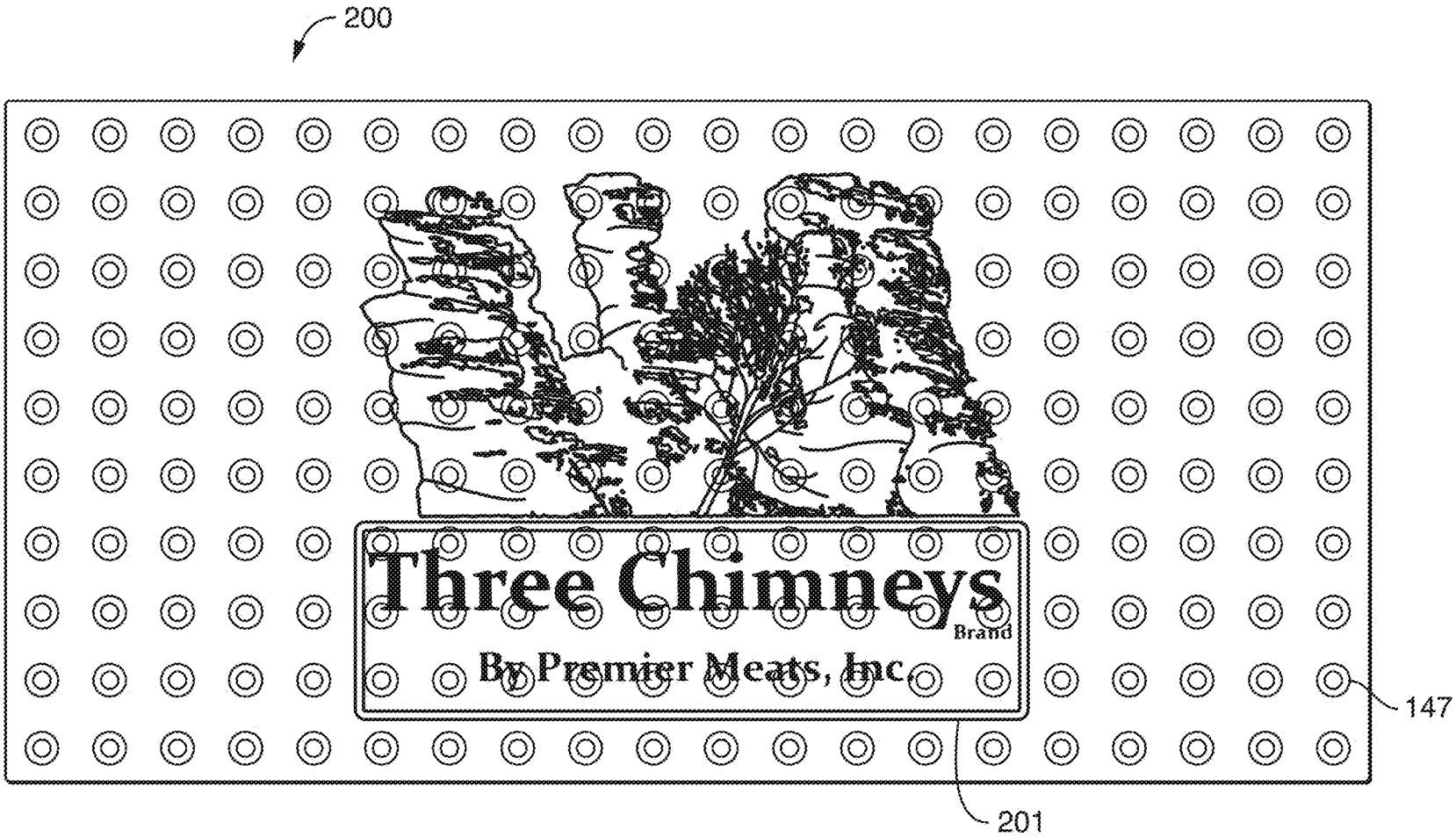
FIG. 28 shows an attention pattern TWSI with a company logo or graphic design on the substrate.

The TWSIs of the present invention are useful for conveying advertising, promotional and branding information. For example, at the entrances of corporate offices, the use of the company name or symbol on a TWSI located outside the front entrance door going into the parking lot serves to identify the building with the company and is beneficial from the standpoint of public relations and advertising. At retail locations, it is contemplated that the TWSIs of the present invention are useful for providing branding and promotion opportunities right outside the retailer's front door. FIG. 28 shows truncated domes 203 on an attention pattern 24"×48" TWSI 200 with a company logo or graphic design 201 embedded in the surface of the substrate. In public rights-of-way, the detectable warning panel may preferably comprise a Quick Response (QR) code which, for example, serves to provide city directory information or commercial advertising/promotion information to pedestrians.

Figure 29:
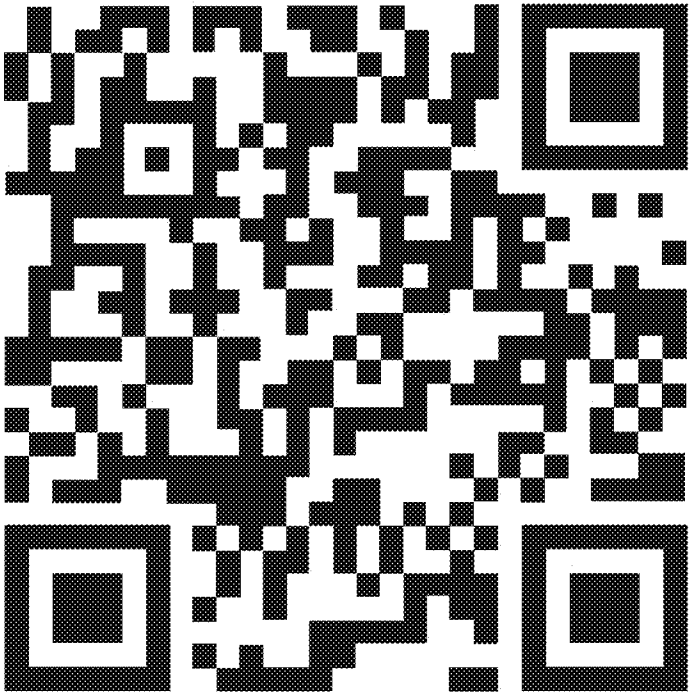
FIG. 29 shows an example of a quick response code (QR Code).

QR code is the trademark for a type of matrix barcode or two-dimensional bar code first designed for the automotive industry in Japan in 1994. It was designed to allow high-speed component scanning. It has become one of the most popular types of two-dimensional barcodes. Bar codes are optical machine-readable labels attached to items that transmit information related to the item. The QR code system has become popular outside the automotive industry due to its fast readability and greater storage capacity compared to standard UPC barcodes. Unlike the older one-dimensional barcode that was designed to be mechanically scanned by a narrow beam of light the QR code is detected as a two-dimensional digital image by a semiconductor image sensor and is then digitally analyzed by a programmed processor. The QR code consists of black modules (square dots) arranged in a square pattern on a white background. FIG. 29 shows an example of a quick response code (QR Code).

Figure 30:
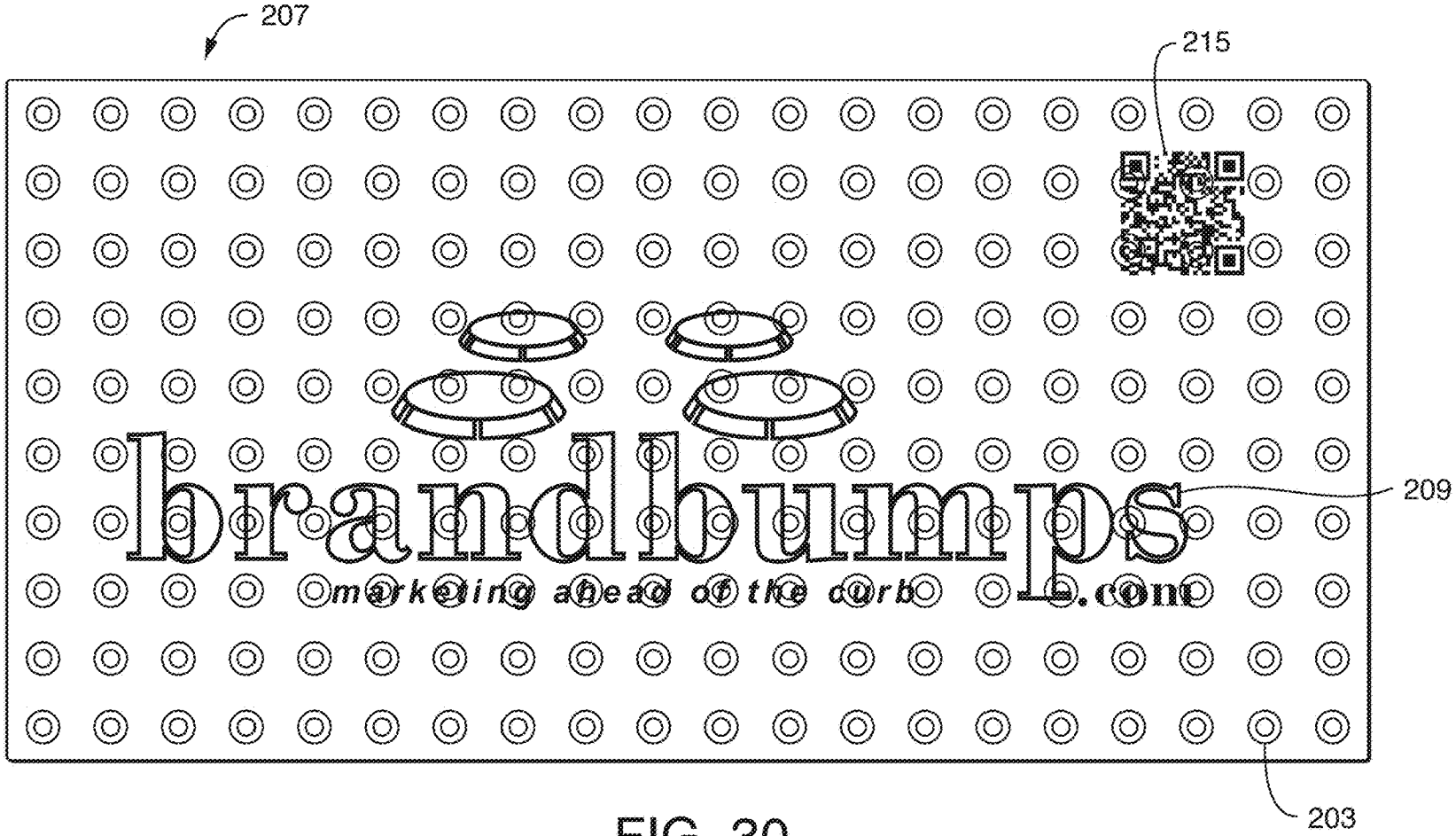
FIG. 30 shows an attention pattern TWSI with a company logo or graphic design and a QR code on the substrate.

QR codes have become common in consumer advertising. Smartphone users can install an app with a QR code scanner that can read a displayed code and convert it to a URL directing the smartphone's browser to the website of a company, store, or product associated with that code providing specific information. In the shopping industry, knowing what causes the consumers to be motivated when approaching products by the use of QR codes, advertisers and marketers can use behavior of scanning to get consumers to buy, causing it to be the best impact on ad and marketing design. As a result, the QR code has become a focus of advertising strategy, since it provides quick and effortless access to the brand's website. FIG. 30 shows truncated domes 203 on an attention pattern 24"×48" TWSI 207 with a company logo or graphic design 209 and a QR code 215 embedded in the surface of the substrate.

Figure 31:
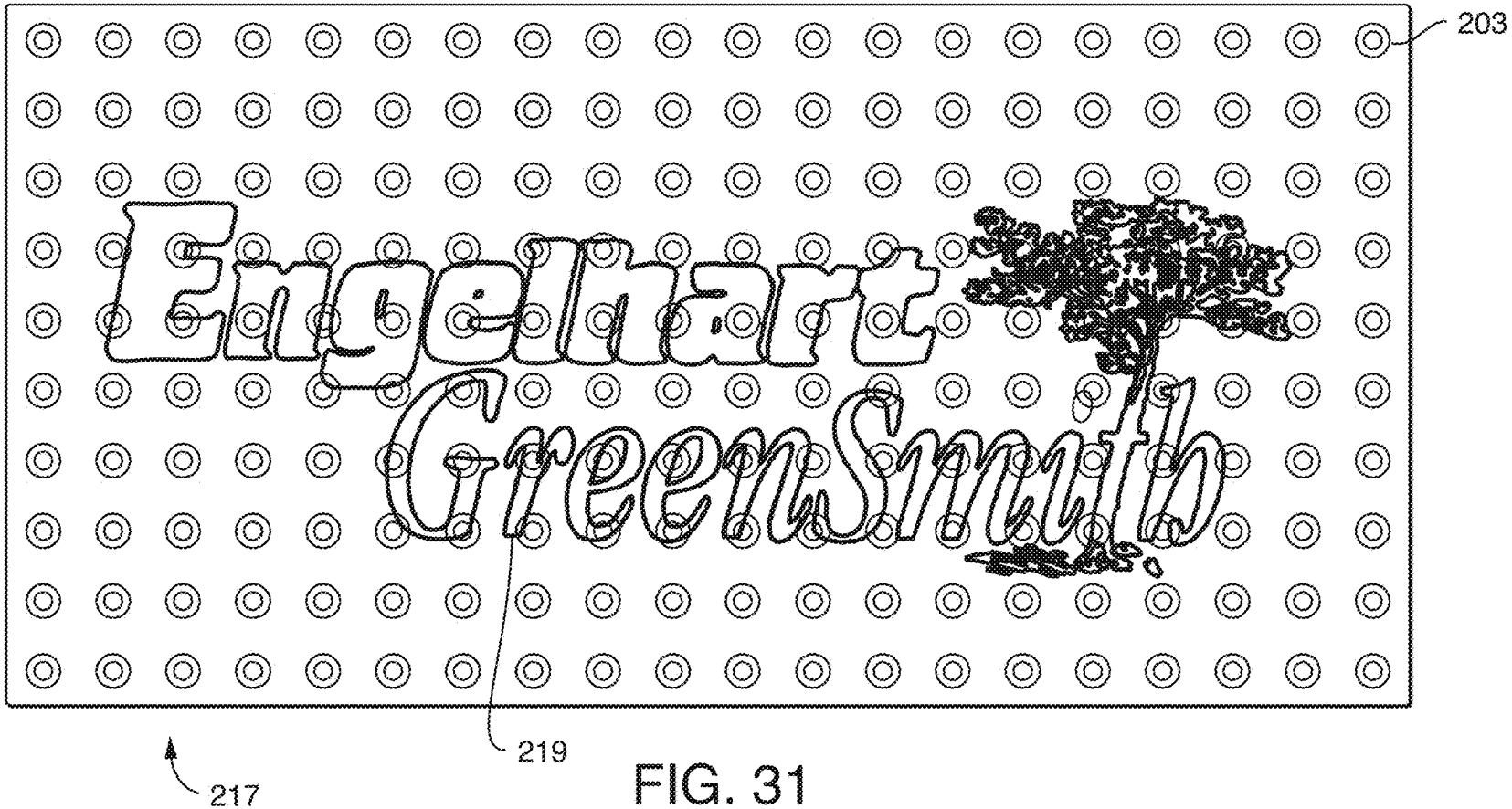
FIG. 31 shows an attention pattern TWSI with a company logo or graphic design on the substrate.
Figure 32:
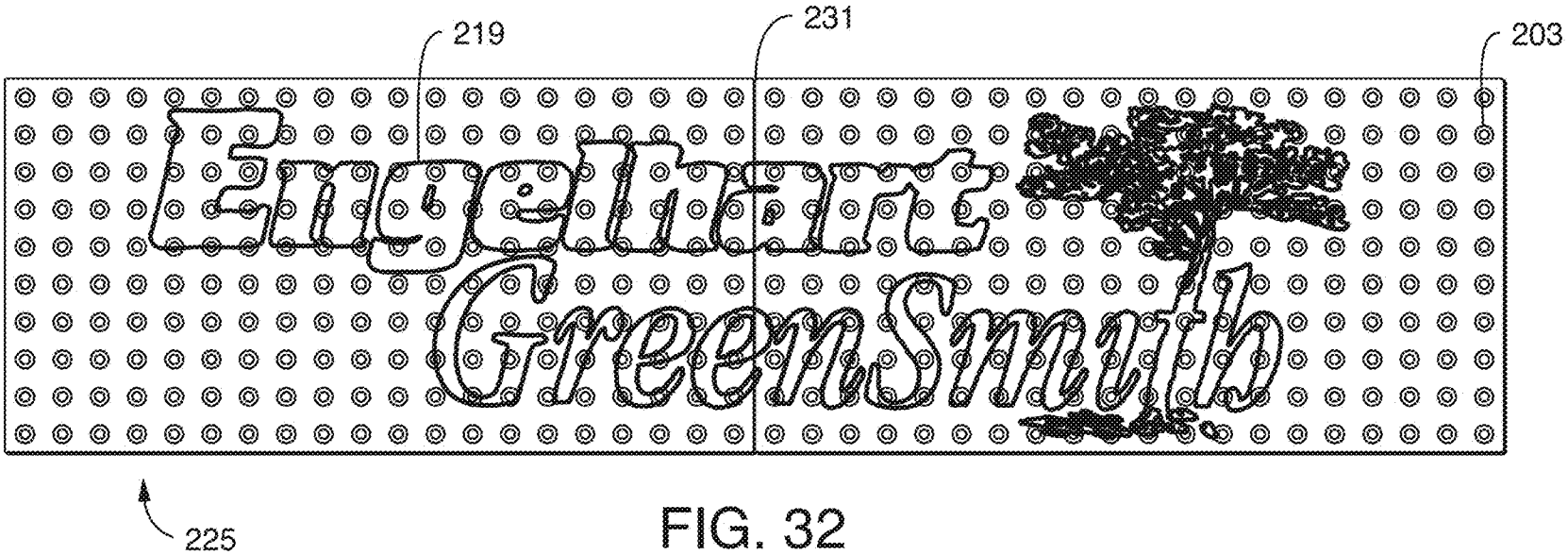
FIG. 32 shows two side by side attention pattern TWSIs with a company logo flowing from the first TWSI to the second TWSI
Figure 33:
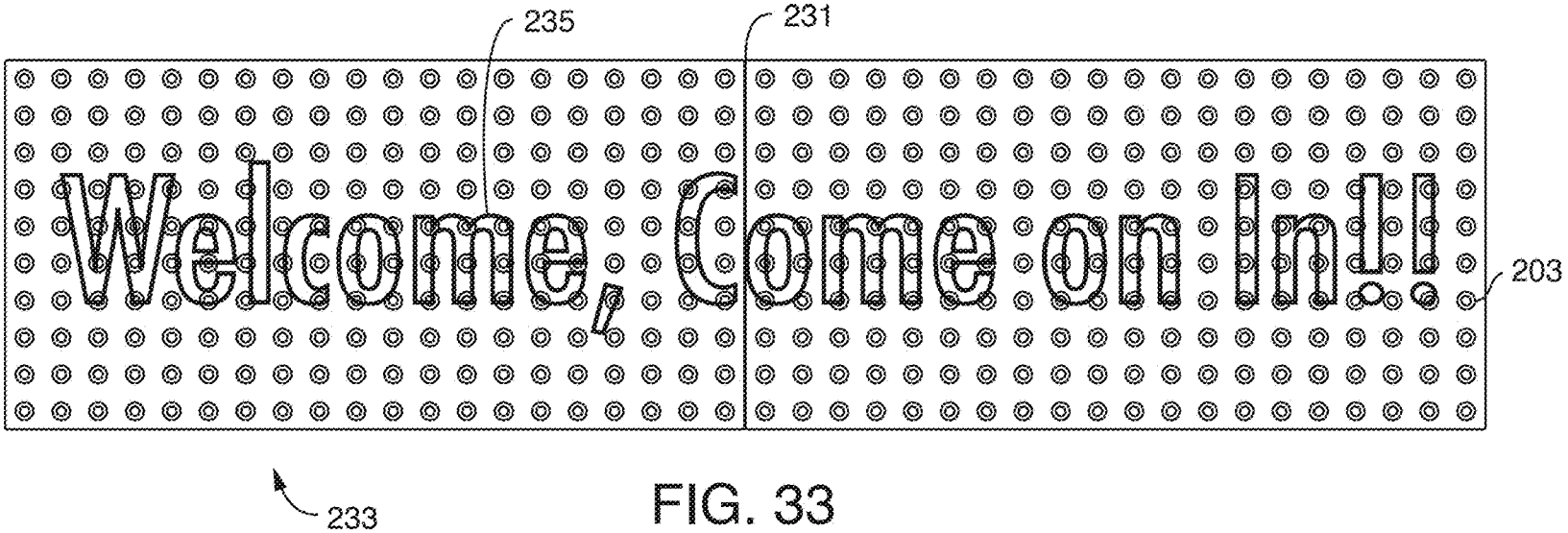
FIG. 33 shows two side by side attention pattern TWSI with a promotional welcoming message flowing from the first TWSI to the second TWSI.
Figure 34:
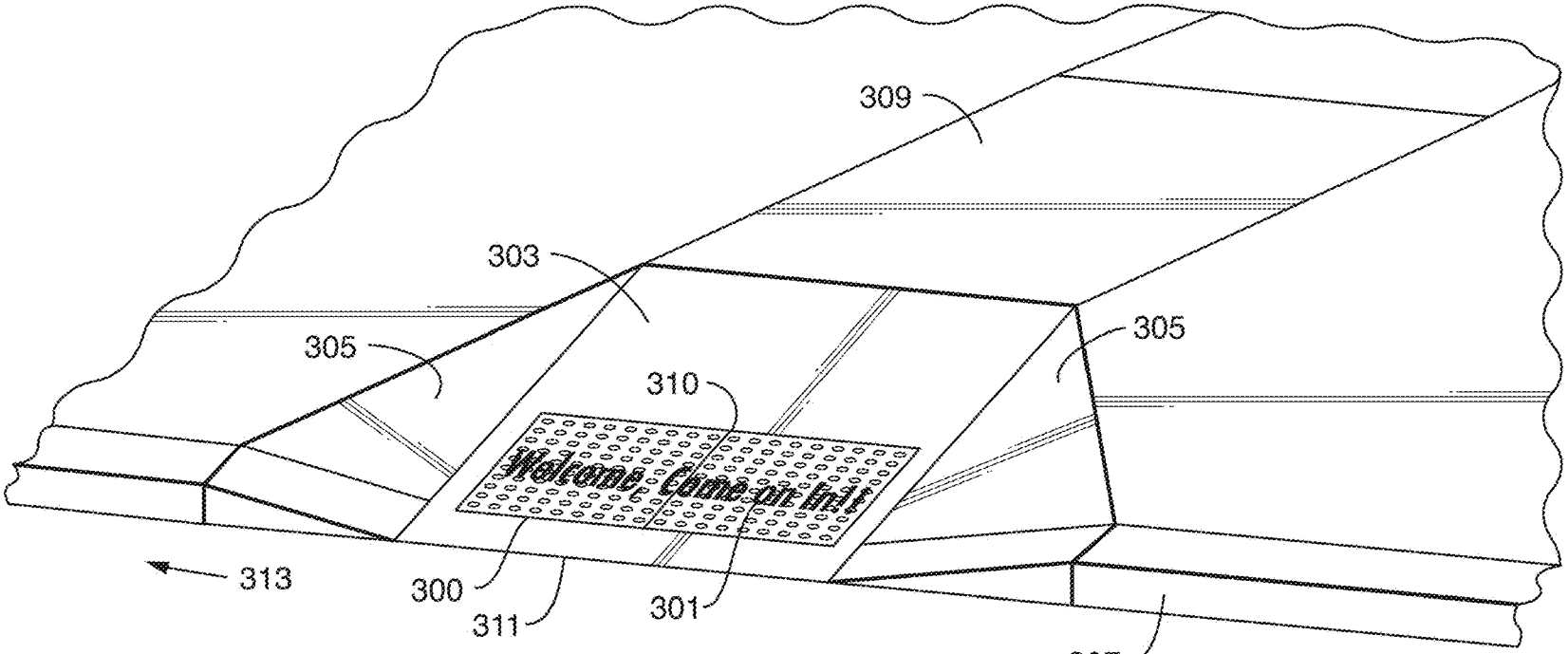
FIG. 34 shows two attention pattern TWSIs placed at the curb with a promotional welcoming message flowing from the first TWSI to the second TWSI.
Figure 35:
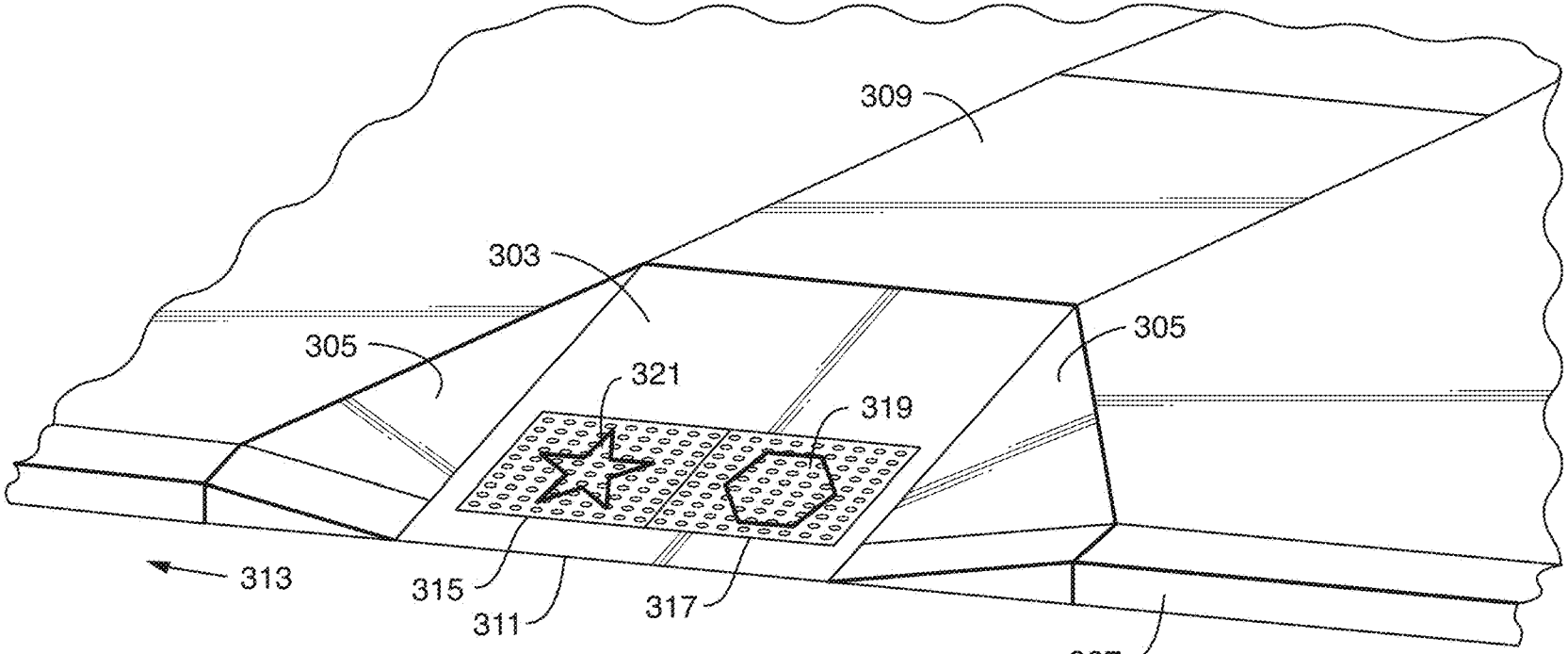
FIG. 35 shows a generic example of two attention pattern TWSIs with different graphic designs on each of the TWSIs which are positioned next to each other or in the same visual area.
Figure 36:
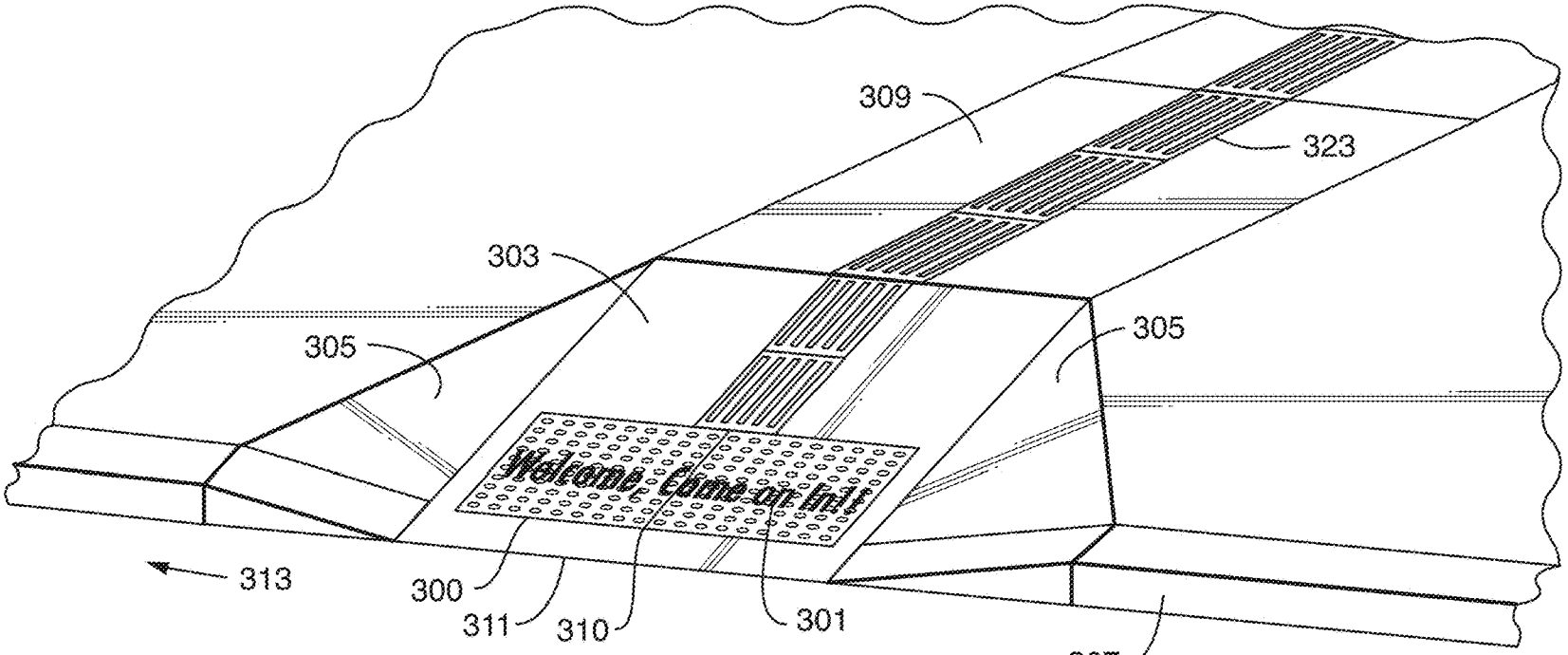
FIG. 36 shows two attention pattern TWSIs placed at the curb with a graphic design (promotional welcoming message) flowing from the first TWSI to the second TWSI, as well as, a guiding pattern TWSI with no graphic design on it.
Figure 37:
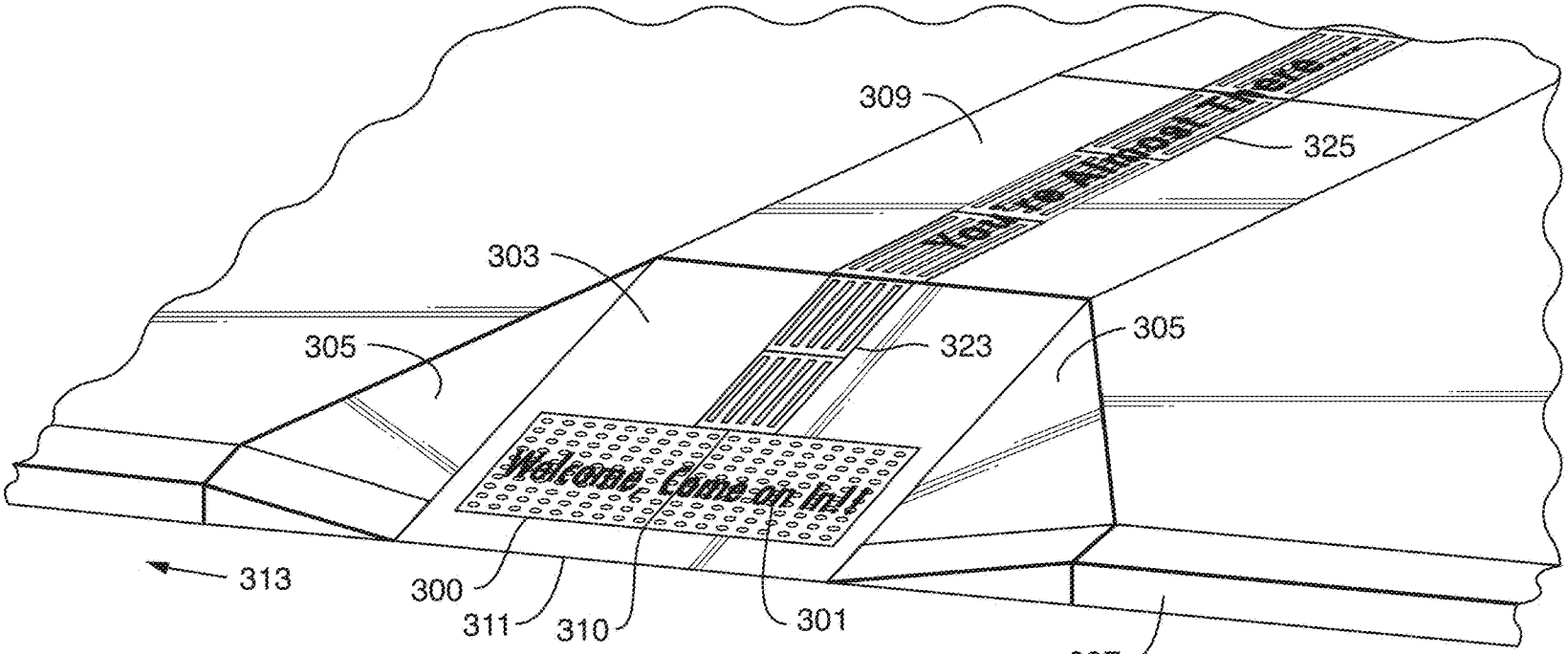
FIG. 37 shows two attention pattern TWSIs placed at the curb with a graphic design (promotional welcoming message) flowing from the first TWSI to the second TWSI, as well as, a guiding pattern TWSI with a graphic design on it.
Figure 38:
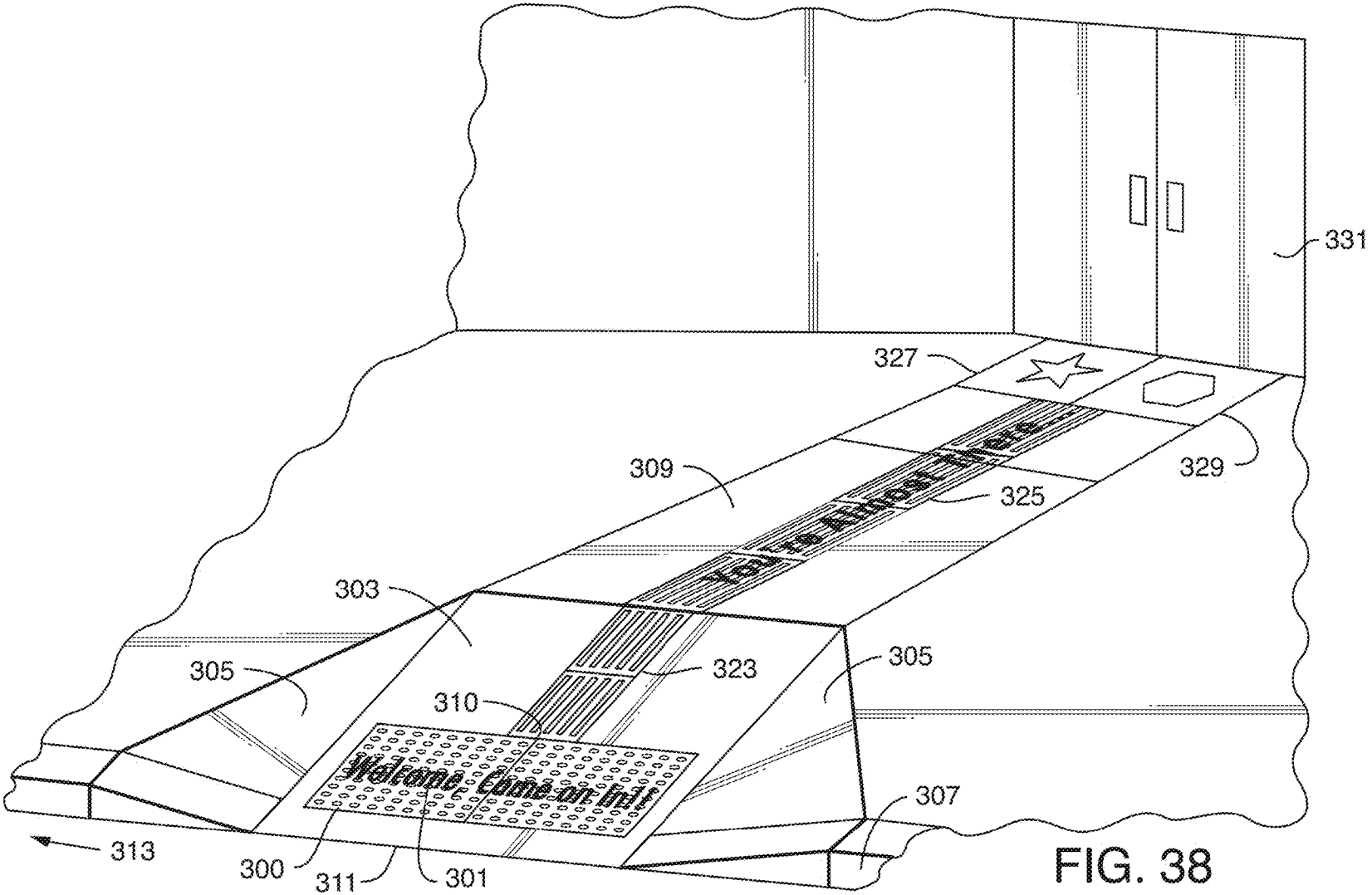
FIG. 38 shows an example of an advertising system which includes, two attention pattern TWSIs placed at the curb with a graphic design (promotional welcoming message) flowing from the first TWSI to the second TWSI, a guiding pattern TWSI with a graphic design on it and flat panels within the visual proximity of the TWSIs.
Figure 39:
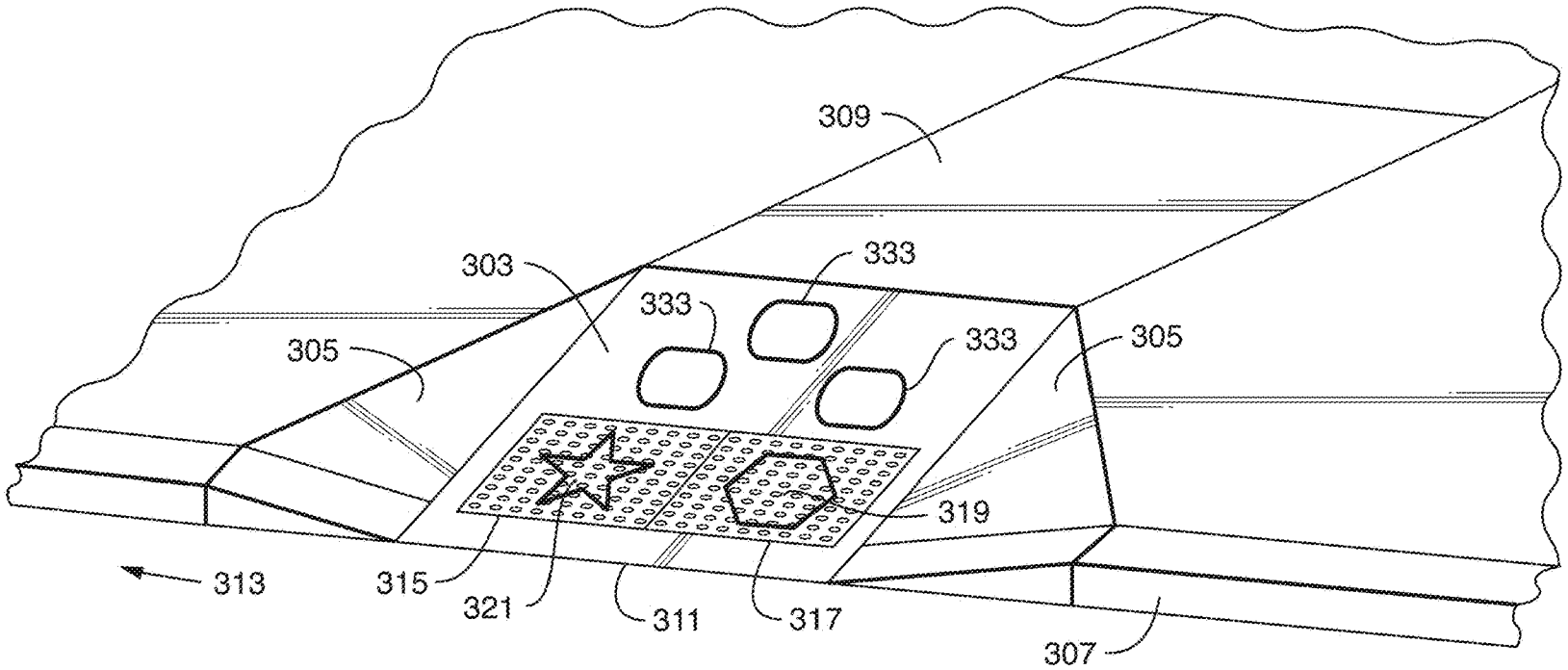
FIG. 39 shows an example of an advertising system which includes, two attention pattern TWSIs placed at the curb with graphic designs and three flat substrate panels placed within the visual proximity of the TWSIs.
Figure 40:
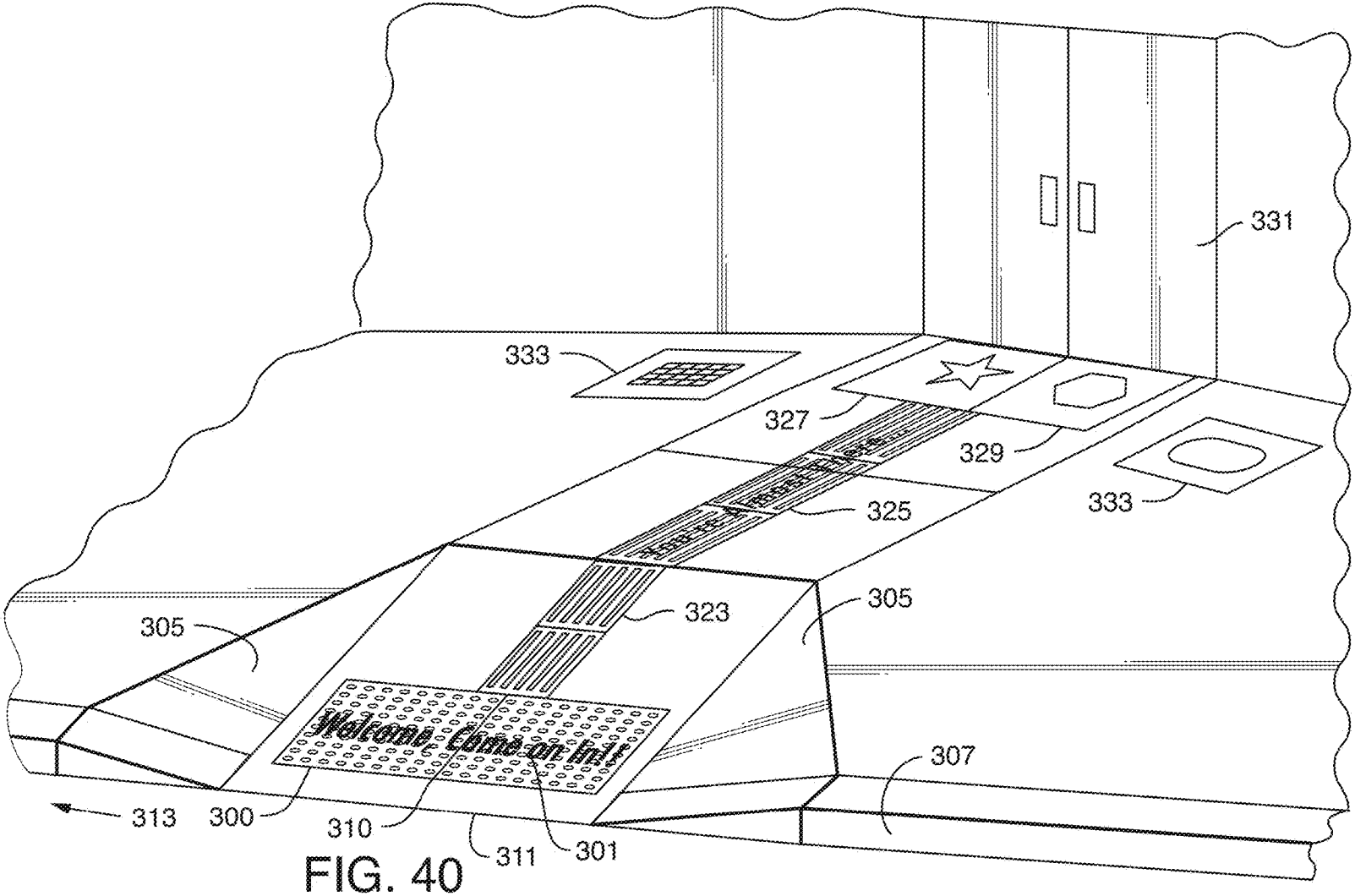
FIG. 40 shows an example of an advertising system which includes, two attention pattern TWSIs placed at the curb with graphic design (promotional welcoming message) flowing from the first TWSI to the second TWSI, a guiding pattern TWSI with graphic design and four flat substrate panels placed within the visual proximity of the TWSIs.

The present invention includes using one or more TWSI and/or related satellite panels as an advertising system. FIG. 31 shows truncated domes 203 on an attention pattern 24"×48" TWSI 217 with a company logo or graphic design 219 on the substrate. As an advertising system this graphic design could also bridge across multiple detectable warning panels. FIG. 32 shows truncated domes 203 on two 24"×48" attention pattern TWSIs 225 placed side by side with a company logo 219 flowing from the first TWSI to the second TWSI. The middle line 231 is the separation between the two side by side detectable warning panels. FIG. 33 shows truncated domes 203 on two side by side 24"×48" attention pattern TWSIs 233 with a promotional welcoming message 235 flowing from the first TWSI to the second TWSI. The middle line 231 is the separation between the two side by side detectable warning panels. FIGS. 34-40 show three-dimensional views of different types of advertising systems utilizing the TWSI. In each drawing there are common features such as the handicap ramp slope 303 to the at-grade curb 311, the handicap ramp side slope 305, the curb line 307, the pedestrian walkway 30 and the direction of vehicular traffic flow 313. FIG. 34 shows two attention pattern TWSIs 300 placed at the curb with a promotional welcoming message 301 flowing from the first TWSI to the second TWSI. FIG. 35 shows a generic example of two attention pattern TWSIs, 315 and 317, with different graphic designs on each of the TWSIs, 319 and 321, which are positioned next to each other or in the same visual area. FIG. 36 shows two attention pattern TWSIs 300 placed at the curb with a graphic design (promotional welcoming message) 301 flowing from the first TWSI to the second TWSI with the separation of the panels shown as 310, as well as, a guiding pattern TWSI 323 with no graphic design on it. FIG. 37 shows two attention pattern TWSIs 300 placed at the curb with a graphic design (promotional welcoming message) 301 flowing from the first TWSI to the second TWSI, as well as, a guiding pattern TWSI with a graphic design 325 on it and a guiding pattern without a graphic design 323. FIG. 38 shows an example of an advertising system which includes, two attention pattern TWSIs 300 placed at the curb with a graphic design (promotional welcoming message) 301 flowing from the first TWSI to the second TWSI with the separation between the panels being 310, a guiding pattern TWSI with a graphic design 325 on it and a guiding pattern without any graphic design 323, and flat panels, 327 and 329, within the visual proximity of the TWSIs. FIG. 38 also shows an entrance 331 to a building or retailer. FIG. 39 shows an example of an advertising system which includes, two attention pattern TWSIs, 315 and 317, placed at the curb with graphic designs, 319 and 321, and three flat substrate panels 333 placed within the visual proximity of the TWSIs. FIG. 40 shows an example of an advertising system which includes, two attention pattern TWSIs, 300 placed at the curb with graphic design (promotional welcoming message) 301 flowing from the first TWSI to the second TWSI, a guiding pattern TWSI both with 325 and without 323 a graphic design and four flat substrate panels, 327, 329, 333 and 333, placed by the entrance 331 to a building or retailer all within the visual proximity of the TWSIs.

Accordingly, in some preferred embodiments, the present invention provides systems and methods that utilize one or more TWSIs, optionally in association with one or more satellite panels. The TWSIs and/or panels preferably comprise a graphic design. In some embodiments, the graphic design displays or comprises at least two, three, four, five, six, seven, eight, nine or ten colors, and preferably from 2 to 10, 3 to 10, 4 to 10, 5 to 10, 2 to 20, 3 to 20, 4 to 20, or 5 to 20 colors. In some embodiments, the colors are different primary colors. In some embodiments, the colors are different shades of the same color. In some embodiments, the graphic design has a resolution of 300×300 dots per inch (DPI), and preferably has a resolution of at least about or equal to 720×720 DPI, and up to about 1440×720 DPI or 1440×1440 DPI. In some embodiments, the graphic design conveys information about a product, business, or service. In some preferred embodiments, the graphic design is an advertisement for a business, product or service and/or contains promotional information related to a business, product, service, political campaign, public information campaign, or the like. The promotional information may thus be related to a promotion for a particular product which may be specially featured (such as a new product) or on sale, or promote a business, service, person or organization. The systems and methods of the present invention further encompass use of the TWSIs and/or satellite panels of the present invention in conjunction with a coordinated advertising or information campaign in one or more media in addition to the TWSI and/or satellite panel. In some preferred embodiments, the TWSIs and/or satellite panels are displayed in conjunction with a coordinated advertisement campaign comprising providing the information on the product, business or service in a different advertising media selected from the group consisting of print media such as magazines and paper, electronic media such as the internet (world wide web), radio advertisements, televisions commercials, in-store advertising media and outdoor advertising media such as billboards, posters, kiosks, placards, street furniture such as bus shelters, newsstands, newsracks, bicycle racks, transit media such as displays in bus stations, train stations and airports, mobile billboards, bus wraps, taxicabs, bus interiors, and alternative media as described above.

In further preferred embodiments, the present invention provides methods and systems of providing advertising for a business, product, organization or service comprising obtaining rights to spaces on pedestrian walkways suitable for display of a TWSI and/or satellite panels as described above and then selling, renting, leasing, or providing advertising on the spaces to a customer for the purpose of advertising or providing information about a product, business, organization or service. In some embodiments, the rights to the spaces are obtained from a private entity owning the pedestrian walking comprising the space. In some embodiments, the rights to spaces are obtained from a public entity (such as a state or local government entity) that either owns, has a right of way, or has an easement on which the pedestrian walkway is located. In some preferred embodiments, the systems and methods further comprise providing TWSIs and/or satellite panels to the customer that comprise one or more desired graphic designs that provide advertising or information about the product, business, organization or service. In some embodiments, the systems and methods comprise installing and displaying the TWSIs and/or satellite panels on behalf of a business or organization that desires display of the information or advertising. In some embodiments, the installation and display further comprises determining locations at which the advertising or information should be displayed. In some embodiments, the display of advertising or information on the TWSIs and/or panels is offered in conjunction with (e.g., as part of an advertising or informational package or campaign) other media, for example, print media such as magazines and paper, electronic media such as the internet (world wide web), radio advertisements, televisions commercials, in-store advertising media and outdoor advertising media such as billboards, posters, kiosks, placards, street furniture such as bus shelters, newsstands, newsracks, bicycle racks, transit media such as displays in bus stations, train stations and airports, mobile billboards, bus wraps, taxicabs, bus interiors, and alternative media as described above.

EXAMPLES

Numerous tests were performed on the textured powder coat paint. Test methods are designed for two purposes; performance reliability (i.e., to determine the suitability of a coating for a given use) and quality control (i.e., to maintain uniform quality in coating application and raw materials applied). There are numerous laboratory tests that are designed to simulate real world outdoor conditions. Laboratory tests are set up to evaluate coatings under controlled conditions. If a given material performs well in carefully selected laboratory tests, the formulator is generally confident that the material will also perform well in actual service and will therefore approach field tests with considerable optimism.

Testing procedures are set up according to American Society for Testing and Materials (ASTM) standards to establish nationally accepted guidelines. The present inventions powder coat paint will be tested utilizing the following ten ASTM tests:

1. Slip Resistance Test (ASTM C1028)—Standard test method for determining the static coefficient of friction of ceramic tile and other like surfaces. The horizontal dynamometer pull meter and heel assemblies are designed to determine the static coefficient of friction (SCOF) of the panel. The target is for a dry SCOF of 0.80-1.0 and a wet SCOF of no less than 0.60.

2. Salt Spray Corrosion Test (ASTM B117)—Use a 5% salt solution at 92-97 degrees Fahrenheit in a sealed weather cabinet. Scribe X in test panel to bare substrate. Inspect every 24 hours. End test and total hours after ¼" creepage from scribed area. Creepage shall not exceed ¼" in either direction from scribe line after 500 hours exposure.

3. Impact Test (ASTM D2794)—Coating on panel shall withstand impact with ½" Gardener impact tester ball at 26 inch pounds direct and reverse. No grazing or loss of adhesion. Finish shall not be able to be removed at impact area with pressure sensitive tape. Recommend using either 3M 250 Masking Tape or Permacel #99 Adhesion Test Tape.

4. Cross Hatch Adhesion Test (ASTM D3359)—Scribe parallel lines through coating to substrate, ¼" apart over a distance of one inch. Scribe another set of parallel lines ¼" apart and perpendicular to the first set. Apply pressure sensitive tape such as 3M 250 Masking Tape or Permacel #99 Adhesion Test Tape then remove slowly. Results should be no lifting of film between scribe lines.

5. Hardness Test (ASTM D3363)—Faber Castell wood pencils are used in hardness 1, 2, 3, 4. Coating shall show no marks from 2H pencil.

Example 1

One of the requirements in the specifications for TWSIs is that they meet certain slip resistance standards. Numerous textured powder coat paints and paint combinations on the panel substrate were tested for slip resistance. Table 6 shows the ASTM C1028 wet/dry average slip resistance test results (no truncated domes) for the different combinations of both no texture and textured powder coated paints used in in both layer #1 and layer #2. ASTM C1028 is a standard test method for determining the static coefficient of friction (COF) of ceramic tile and other like surfaces by the horizontal dynamometer pull-meter method (Slip resistance test). In the United States the individual states have requirements for the slip resistance on the TWSI products. This varies somewhat by state but a good rule of thumb is the average wet/dry COF should be greater than 0.65. The higher the number the better the slip resistance.

TABLE 6

| Powder Coat Paint Type | | | |
|---|---|---|---|
| | Layer #2 | | |
| Layer #1 | PE 411M | MD PC90 | MD PC60A |
| No Texture - | | | |
| DS407 | 0.750 | N/A | N/A |
| Texture - | | | |
| DS707 | 0.680 | 0.734 | 0.744 |
| ADA 1104/04 | N/A | N/A | N/A |
| ADA 1104/05 | 0.957 | 0.880 | 0.888 |
| ADA 1104/06 | 0.858 | 0.756 | 0.715 |

Table 7 shows the rankings based on the Table 6 ASTM C1028 wet/dry average slip resistance test results (no truncated domes) for the top five powder coat paint combinations.

TABLE 7

| Ranking | ASTM C1028 | Layer #1 | Layer #2 |
|---|---|---|---|
| 1 | 0.858 | PE 411M | ADA 1104/06 |
| 2 | 0.756 | MD PC90 | ADA 1104/06 |
| 3 | 0.744 | MD PC60A | DS707 |
| 4 | 0.734 | MD PC90 | DS707 |
| 5 | 0.715 | MD PC60A | ADA 1104/06 |

Five other powder coat paint tests were performed on the different powder coat paint layers in addition to the ASTM C1028 slip resistance tests. Table 8 shows the ASTM powder coat paint test results for these five different ASTM paint tests.

TABLE 8

| Layer #1/ Layer#2 | ASTM Test B 117-12 | D522-93 | D2794-93 | D3359-09 | D3363-05 |
|---|---|---|---|---|---|
| PE 411M/ ADA 1104/ 06 | No corrosion. No creepage from scribe | 100% adhesion loss | 120 lbs. | 5B No adhesion loss | 5H |
| MD PC90 | Evidence of slight red rust. No creepage from scribe | 100% adhesion loss | 40 lbs. | 5B No adhesion loss | >6H |

The conclusion reached after the tests performed in Example 1 was that the powder paint combination on FIG. 17 is the preferred method based on slip resistance, other durability tests, as well as, the quality of the graphic design image on the detectable warning panel. FIG. 17 shows a conductive substrate 1 painted with two layers of powder coat paint. The first layer 6 is a white polyester powder coat paint (no texture) and the second layer 9 is a clear/transparent matte textured polyurethane superdurable powder coat paint (ADA 1104/06 chemical texture).

Example 2

Two analytical methods were utilized to measure the physical characteristics of the textured powder coat paint that were developed for the TWSI product. The first method measured under a high powered microscope the physical properties of the surface texture. These measurements were made using a 50× power microscope manufactured by Bodelin, Model—ProScope HD2. The software was ProScope HR/LX-ProScope HR. The light source was a build in LED light with an additional LED side light. The physical properties measured included the size of the small texture spheres, the size of the large texture chunks and the distance in between these spheres/chunks.

Table 9 shows the measurements for texture powder coat paint ADA 1104/04, Class 2. This table shows the size of the small texture spheres, the size of the large chunks and the distance between these spheres/chunks of the rubber textured additive used to create the textured powder coat paint. The textures made of rubber spheres particles range in size from 0.2121 mm to 0.3111 mm in primary particle size.

TABLE 9

| | Texture ADA 1104/04 | | |
|---|---|---|---|
| | Particle Size | | Distance |
| Description | Small Spheres | Large Chunks | Between Small Spheres |
| Number of Measurements | 12 | 12 | 12 |
| Mean or Average | 0.2415 | 1.0793 | 0.1932 |
| Median (Middle Number) | 0.2404 | 1.0463 | 0.1838 |
| Mode (Most Frequently Occurring) | 0.2404 | N/A* | 0.2404 |
| Standard Deviation | 0.0229 | 0.2750 | 0.0567 |
| Standard Deviation (P Value) | 0.0219 | 0.2633 | 0.0543 |

*No duplicate reading in 12 samples

Table 10 shows the measurements for texture powder coat paint ADA 1104/05, Class 2. This table shows the size of the small texture spheres, the size of the large chunks and the distance between these spheres/chunks of the inert rubber textured additive used to create the textured powder coat paint.

TABLE 10

| | Texture ADA 1104/05 | | |
|---|---|---|---|
| | Particle Size | | Distance |
| Description | Small Spheres | Large Chunks | Between Small Spheres |
| Number of Measurements | 13 | 13 | 24 |
| Mean or Average | 0.2643 | 1.0060 | 0.1591 |
| Median (Middle Number) | 0.2686 | 1.0321 | 0.1555 |
| Mode (Most Frequently Occurring) | 0.2828 | 1.1170 | 0.1555 |
| Standard Deviation | 0.0248 | 0.1053 | 0.0334 |
| Standard Deviation (P Value) | 0.0238 | 0.1012 | 0.0327 |

Table 11 shows the measurements for texture powder coat paint ADA 1104/06, Class 2. This table shows the size of the small texture spheres, the size of the large chunks and the distance between these spheres/chunks of the chemical textured additive used to create the textured powder coat paint.

TABLE 11

| | Texture ADA 1104/06 | | |
|---|---|---|---|
| | Particle Size | | Distance |
| Description | Small Spheres | Large Chunks | Between Small Spheres |
| Number of Measurements | 2 | 2 | 2 |
| Mean or Average | 0.1710 | 0.2548 | 0.2129 |
| Median (Middle Number) | 0.1710 | 0.2548 | 0.2129 |
| Mode (Most Frequently Occurring) | N/A | N/A | N/A |
| Standard Deviation | 0.0148 | 0.0641 | 0.1135 |
| Standard Deviation (P Value) | 0.0105 | 0.0454 | 0.0803 |

The conclusion reached after the tests performed in Example 2 was that the ADA 1104/06 powder paint is the best choice for the texture for layer #2 on the conductive TWSI substrate. This conclusion was based on the slip resistance tests, the physical characteristics of the texture and the consistent clarity of the clear/transparent nature of the texture. Although the ADA 1104/04 and ADA 1104/05 textures provided good slip resistance, the textured paint had a yellow hue to it once cured. This did not provide for a high quality vibrant graphic image.

Example 3

Table 12 shows the surface profile measurements for the different powder coat paint coating types and combinations. A PosiTector SPG Surface Profile Gage manufactured by DeFelsko was used to take these measurements. The SPG measures and records peak to valley surface profile height. Two tests were completed on each of the powder coat paint types and combinations.

TABLE 12

| Powder Coat Paint Type | No. of Samples | Average | Standard Deviation | Low | High |
|---|---|---|---|---|---|
| DS707 - Test #1 | 177 | 2.98 | 2.09 | 1.50 | 24.80 |
| ADA 1104/04 - Test #1 | 112 | 8.91 | 1.49 | 3.40 | 14.80 |
| ADA 1104/04 - Test #2 | 172 | 8.79 | 1.89 | 3.40 | 23.60 |
| ADA 1104/05 - Test #1 | 202 | 11.02 | 1.92 | 5.20 | 18.90 |
| ADA 1104/05 - Test #2 | 200 | 11.01 | 2.27 | 6.30 | 28.70 |
| PE411M/ADA 1104/06 - Test #1 | 150 | 6.13 | 1.02 | 4.30 | 9.60 |

TABLE 12-continued

| Powder Coat Paint Type | No. of Samples | Average | Standard Deviation | Low | High |
|---|---|---|---|---|---|
| PE411M/ADA 1104/06 - Test #2 | 160 | 6.30 | 1.90 | 2.10 | 17.10 |
| MDPC90/ADA 1104/06 - Test #1 | 160 | 17.09 | 3.75 | 2.30 | 28.70 |
| MDPC90/ADA 1104/06 - Test #2 | 164 | 17.06 | 3.80 | 7.50 | 29.10 |
| MDPC60A/DS707 - Test #1 | 160 | 4.29 | 1.40 | 0.90 | 15.90 |
| MDPC60A/DS707 - Test #2 | 160 | 4.26 | 0.98 | 2.20 | 7.00 |
| MDPC90/DS707 - Test #1 | 162 | 12.01 | 3.77 | 5.80 | 26.30 |
| MDPC90/DS707 - Test #2 | 164 | 11.51 | 3.04 | 4.40 | 28.80 |
| MDPC60A/ADA 1104/06 - Test #1 | 160 | 4.12 | 1.47 | 1.90 | 20.30 |
| MDPC60A/ADA 1104/06 - Test #2 | 160 | 4.02 | 0.99 | 2.00 | 11.00 |

TABLE 13

| PE 411M | RIF Standard | Minimum Tolerance Limit | Result |
|---|---|---|---|
| Gloss (Gardner 60°) | ISO 2813 | 85 ± 10 gloss | OK |
| Buchholz Hardness | ISO 2815 | Minimum 80 | OK |
| Adhesion | ISO 2409 | No Loss of Adhesion | OK |
| Thickness (Min. Thickness) | ISO 2360 | 60 microns | OK |
| Direct Impact Test* | ASTM D2794 | 2.5 N * m | No Coating Detaching |
| Reverse Impact Test | ASTM D2794 | 2.5 N * m | No Coating Detaching |
| Erichsen Identation* | ISO 1520 | 5 mm | No Coating Detaching |
| Bending* | ISO 1519 | 5 mm diameter | No Coating Detaching |

*Tests carried out on 1 mm thickness alloy AA5005 H24 chromate aluminum sheets and 60 microns coating layer

TABLE 14

| DS707 | RIF Standard | Minimum Tolerance Limit | Result |
|---|---|---|---|
| Gloss (Gardner 60°) | ISO 2813 | 8 ± 3 gloss | OK |
| Buchholz Hardness | ISO 2815 | Minimum 80 | OK |
| Adhesion | ISO 2409 | No Loss of Adhesion | OK |
| Thickness (Min. Thickness) | ISO 2360 | 60 microns | OK |
| Direct Impact Test* | ASTM D2794 | 2.5 N/m | No Coating Detaching |
| Reverse Impact Test | ASTM D2794 | 2.5 N/m | No Coating Detaching |
| Erichsen Identation* | ISO 1520 | 5 mm | No Coating Detaching |
| Bending* | ISO 1519 | 5 mm diameter | No Coating Detaching |
| Kesternich Test | ISO 3231 | No Coating Detaching or Penetration Higher Than 1 mm | OK |
| Humidity Test** | DIN 50017 | No Blistering/Coating Detaching | OK |
| Acetic Acid - Salt Spray Test** | ISO 9227 | Corrosion Lower Than 4 mm | OK |
| Pressure Cooker Test | Cap. Qualicoat | No Blistering/Coating Detaching | OK |
| Lime Resistance | Cap. Qualicoat | No Blistering/Coating Detaching | OK |

*Tests carried out on 1 mm thickness alloy AA5005 H24 chromate aluminum sheets and 60 microns coating layer

**Tests carried out on AA6060 extruded alloy

TABLE 15

| ADA 1104/06 | RIF Standard | Minimum Tolerance Limit | Result |
|---|---|---|---|
| Gloss (Gardner 60°e) | ISO 2813 | 8 ± 3 gloss | OK |
| Buchholz Hardness | ISO 2815 | Minimum 80 | OK |
| Adhesion | ISO 2409 | No Loss of Adhesion | OK |
| Thickness (Min. Thickness) | ISO 2360 | 60 microns | OK |
| Direct Impact Test* | ASTM D2794 | 2.5 N * m | No Coating Detaching |
| Reverse Impact Test | ASTM D2794 | 2.5 N * m | No Coating Detaching |
| Erichsen Identation* | ISO 1520 | 5 mm | No Coating Detaching |
| Bending* | ISO 1519 | 5 mm diameter | No Coating Detaching |
| Kesternich Test | ISO 3231 | No Coating Detaching or Penetration Higher Than 1 mm | OK |
| Humidity Test** | DIN 50017 | No Blistering/Coating Detaching | OK |
| Acetic Acid - Salt Spray Test** | ISO 9227 | Corrosion Lower Than 4 mm | OK |
| Accelerated Weathering Test | ISO 11341 | Rit. Di Brill. >90% $\Delta E < 2$ | OK |

TABLE 15-continued

| ADA 1104/06 | RIF Standard | Minimum Tolerance Limit | Result |
|---|---|---|---|
| Pressure Cooker Test | Cap. Qualicoat | No Blistering/Coating Detaching | OK |
| Lime Resistence | Cap. Qualicoat | No Blistering/Coating Detaching | OK |

*Tests carried out on 1 mm thickness alloy AA5005 H24 chromate aluminum sheets and 60 microns coating layer
**Tests carried out on AA6060 extruded alloy The conclusion reached after the tests performed in Example 3 once again supported the ADA 1104/06 powder paint as the best choice for the texture for layer #2 on the conductive TWSI substrate. This conclusion was based on the slip resistance tests, the physical characteristics of the texture and the consistent clarity of the clear/transparent nature of the texture.

Numerous other powder coat paint combinations were tried and tested. Some of the texture formulations were not successful in meeting the required criteria. For example, two of texture formulations developed and tested included an organic rubber additive. The problem encountered with these textures was the inability to consistently get the texture to cure clear/transparent. The finished product would have a yellow tone to it. This yellow hue was not conclusive to a sharp and clear graphic image. Other textured paints could not be sublimated into and provide a consistent quality image. Some of these textured formulations actually performed extremely well in the slip resistance tests. They even outperformed the textures that are part of this invention. The textured topcoat powder coat paints that did not work consistently are shown in FIGS. 12 and 13.

The substrate powder coat paint layer (layer #1 and layer #2) options are identical for both conductive and non-conductive substrates once the substrate has been through both the cleaning process in Step 1 and if needed gone through the primer layer process in Step 3 (E-coat or liquid primer paint).

Powder Coat Paint process for Layer #1 may or may not include texture additives. The first option for powder coat paint Layer #1 is no texture. After the substrate is cleaned (cleaning method and process will be determined by substrate material type) the first powder coat paint layer #1NT (no texture) is applied to the conductive substrate. The powder coat layer #1NT is a thermoset polymer. Refer to FIGS. 16, 17, 22, 23 and 24. The thermoset powder paint incorporates a cross-linker in the formulation. When the powder painted object is painted and then cured under heat, it reacts with other chemical groups in the powder to polymerize, improving the performance properties of the paint. The most common polymers used are polyester, polyurethane, polyester-epoxy (known as a hybrid), straight epoxy (fusion bonded epoxy) and acrylics.

The powder coat layer #1NT is not limited to a specific color but in most cases will be white in color (this is the best base layer color in order to provide the best background for the dye/ink sublimation process). This powder coat layer #1NT will be a Decoral, or similar type product, polyester powder coat paint product. The thickness of the first layer of powder is preferably in the range of 1.0-4.0 mils. This powder coat layer #1NT is preferably cured for 15 minutes with a temperature of 340 degrees Fahrenheit in such a way that this first layer is not completely cured, in order to help the adherence of the second layer.

The second option for powder coat paint Layer #1 is a textured paint finish. After the substrate is cleaned (cleaning method and process will be determined by substrate material type) the first powder coat paint layer #1WT (with texture) is applied to the conductive substrate. This powder coat layer #1WT is a textured thermoset polymer. Refer to FIGS. 11-15, 18-21. The textured thermoset powder paint incorporates a cross-linker in the formulation. When the powder painted object is painted and then cured under heat, it reacts with other chemical groups in the powder to polymerize, improving the performance properties of the paint. The most common polymers used are polyester, polyurethane, polyester-epoxy (known as a hybrid), straight epoxy (fusion bonded epoxy) and acrylics.

The powder coat layer #1WT is not limited to a specific color but in most cases will be white in color (this is the best base layer color in order to provide the best background for the ink/dye sublimation process). This powder coat layer #1WT will be Decoral, or similar type product, polyester powder coat paint with a textured additive(s). This texture additive(s) can be one texture additive (for example—rubber, glass flakes, glass fiber, barium sulfate, aluminum oxide, other non-polymeric or polymeric additive) or multiple types of texture additives (combination of texture additives) in the powder paint to add the desired texture and related durability, anti-scratching, slip resistance and wear resistance. If rubber is added to the powder coat paint it is added at a ratio of 10%-25% by weight of powder. This rubber is recycled re-engineered rubber. The rubber particle sizing can be from 40-200 microns. The purpose of the rubber texture is to increase the grip characteristics of the powder coat paint on the substrate. The glass flakes, glass fibers or other suitable fillers such as barium sulfate, (Barytes) used to create the desired texture will be added at a ratio of 5%-10% by weight of powder. The size of the glass spheres is 18-80 microns which are the typical size. The purpose of the glass flakes or glass fibers is to increase the wear resistance characteristics of the powder coat paint. The rubber, glass flakes and glass fibers are dry blended into the polyester powders. Depending upon the texture desired the texture agent may be extruded into the powder coating formulation. The thickness of the first layer of powder is preferably in the range of 1.0-4.0 mils. This powder coat layer #1BWT is preferably cured for 15 minutes with a temperature of 340 degrees Fahrenheit in such a way that this first layer is not completely cured, in order to help the adherence of the second layer.

After the first powder coat paint layer (layer #1NT or layer #1WT) is applied and partially cured a second powder coat paint layer is then sprayed on the substrate. This second layer can be applied with or without texture additives.

The powder coat second layer #2NT (no texture) is a polyurethane thermoset powder. Refer to FIG. 22. The thermoset powder paint also incorporates a cross-linker in the formulation. When the powder painted object is painted and then cured under heat, it reacts with other chemical groups in the powder to polymerize, improving the performance properties of the paint.

This second layer #2NT will preferably be a clear/transparent polyurethane powder coat paint product. This Decoral clear/transparent polyurethane powder paint (DS407) has the following characteristics; super durable, mar resistant, anti-graffiti, super ultraviolet ray resistant and chemical resistance.

The second layer of textured powder paint is specially formulated so that it will be able to accept dye/ink sublimation decorations/graphic media. The UV protection (resins with good light resistance) in this Decoral paint formulation suppresses the fading or discoloration of the inks/dyes of the sublimated decoration or graphic art. The thickness of the second layer #2NT of powder paint is suggested to be in the range of 1.5-6.0 mils. This second layer #2NT is preferably completely cured for 20 minutes with a temperature of from 300 to 400 degrees Fahrenheit on the substrate. Preferably the 20 minute time period is counted when the conductive substrate reaches 392 degrees Fahrenheit. New powder paint technology is being developed which allows for low cure temperature of between 60 C and 120 C for powder coat paint. This is in contrast to the current normal powder coat cure temperatures in the range of 325 F-400 F. The powder coat second layer #2WT (with texture) is a polyurethane textured thermoset powder. Refer to FIGS. 17-21, 23-24.

The texture added to this powder paint improves the anti-scratching, slip resistance and wear resistance of the paint layer. The thermoset powder paint also incorporates a cross-linker in the formulation. When the powder painted object is painted and then cured under heat, it reacts with other chemical groups in the powder to polymerize, improving the performance properties of the paint.

This second layer #2WT is preferably a clear/transparent polyurethane textured powder coat paint product. This Decoral clear/transparent textured polyurethane powder paint (DS707 or ADA 1104/06, class 2) has the following characteristics; super durable, mar resistant, antislip, super textured, anti-graffiti, super ultraviolet ray resistant and chemical resistance. FIGS. 17, 18, 21 and 24 show powder coat paint combinations that have the ADA 1104/06, class 2 textured powder coat paint. FIGS. 19, 20, and 23 show powder coat paint combinations that have the DS707 textured powder coat paint.

The second layer #2WT of Decoral clear/transparent powder paint will preferably include either a polymeric or non-polymeric texture additive. This texture additive will improve the slip resistance, wear resistance and durability of the painted substrate. This paint layer #2WT is formed from a Decoral polyurethane powder paint containing chemical additives or rubber particles. The chemical additives or rubber particles create the necessary surface roughness/texture that provides the required slip resistance that exceeds the specific industry requirements. The second layer of textured powder paint is specially formulated so that it will be able to except ink/dye sublimation decorations/graphic media. The UV protection (resins with good light resistance weatherability) in this Decoral paint formulation suppresses the fading or discoloration of the dyes/inks of the sublimated decoration or graphic art. The thickness of the second layer #2B of powder paint is preferably in the range of 1.5-6.0 mils. This second layer #2B is preferably completely cured for 20 minutes with a temperature of from 300 to 400 degrees Fahrenheit on the substrate. Preferably, the 20 minutes time is counted when the conductive substrate reaches 392 degrees Fahrenheit. Cure the thermosetting powder on the substrate with heat (heat oven and/or IR system). Curing temperature of between 300-400 degrees Fahrenheit for between 3-7 minutes. New powder paint technology is being developed which allows for low cure temperature of between 60 C and 120 C for powder coat paint. This is in contrast to the current normal powder coat cure temperatures in the range of 325 F-400 F.

All publications and patents mentioned in the above specification are herein incorporated by reference. Various modifications and variations of the described method and system of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention that are obvious to those skilled in the field of this invention are intended to be within the scope of the following claims.

What is claimed is:

1. An article for display on a pedestrian walkway comprising a panel having a substantially planar upper and lower surface, said upper surface having thereon a plurality of distinct spatially raised, three-dimensional features arranged in a pattern so as to be detectable by tactile sensation by a pedestrian, wherein said features are selected from the group consisting of a plurality of raised truncated domes or cones and a plurality of raised bars, said planar upper surface having thereon a graphic design displaying at least two colors and having a resolution of at least 300×300 DPI, wherein said graphic image extends across said plurality of distinct spatially raised three dimensional features.

2. The article of claim 1, wherein said graphic design displays at least three colors.

3. The article of claim 1, wherein said graphic design conveys information about a product, business, or service.

4. The article of claim 1 wherein said upper planar surface is textured to provide slip resistance and durability.

5. The article of claim 1 wherein said panel comprises a material selected from the group consisting of metal, thermoset plastic and thermoplastic.

6. The article of claim 5 wherein said metal is selected from the group consisting of cast iron, ductile iron, steel, aluminum, and alloys thereof.

7. The article of claim 1, wherein said graphic design includes a Quick Response Code, matrix code, two-dimensional bar code, optical machine-readable labels, or other readable code.

8. The article of claim 1, wherein said raised truncated domes or cones are circular.

9. The article of claim 1, wherein said truncated domes or cones are arranged in an array.

10. The article of claim 1, wherein said raised bars are parallel flat-topped elongated bars or sinusoidal ribs.

11. The article of claim 1, wherein said raised bars are arranged in an array.

12. The article of claim 1, wherein said graphic design is selected from the group consisting of a logo, slogan, lettering, pictures, names, product illustrations, emblems, promotional information related to a product or service, directions and symbols.

13. An advertising system comprising a detectable warning or guide panel comprising an upper planar surface having a plurality of distinct, three dimensional raised features detectable by a pedestrian and positioned horizontally on a pedestrian walkway, said planar upper surface having thereon a graphic design displaying at least two colors and having a resolution of at least 300×300 DPI wherein said features are selected from the group consisting of a plurality of raised truncated domes or cones and a plurality of raised bars and said graphic image extends across said plurality of distinct spatially raised three dimensional features; and one or more satellite panels decorated with graphic designs arranged spatially contiguous to or in viewable proximity to said warning or guide panel.

14. A method comprising:

horizontally displaying a first article at a predetermined position on a pedestrian walkway, said first article having a substantially planar upper and lower surface, having on said upper surface a plurality of distinct, three dimensional spatially raised features arranged in a pattern so as to be detectable by tactile sensation by a pedestrian, said planar upper surface further having thereon a graphic design displaying at least two colors and having a resolution of at least 300×300 DPI, wherein said features are selected from the group consisting of a plurality of raised truncated domes or cones and a plurality of raised bars and said graphic image extends across said plurality of distinct spatially raised three dimensional features.

15. An advertising method comprising:

horizontally displaying a plurality of panels at predetermined positions on pedestrian walkways, each panel having a substantially planar upper and lower surface, said upper surface of each panel having thereon a plurality of distinct, three-dimensional spatially raised features arranged in a pattern so as to be detectable by tactile sensation by a pedestrian, said planar upper surface of each panel having thereon a graphic design displaying at least two colors and having a resolution of at least 300×300 DPI wherein said features are selected from the group consisting of a plurality of raised truncated domes or cones and a plurality of raised bars and said graphic image extends across said plurality of distinct spatially raised three dimensional features, wherein said graphic designs on said plurality of panels provide a coordinated advertising campaign for a business, service, or product.

16. An advertising system comprising a plurality of horizontally positioned, panels mountable on a pedestrian walkway, each panel having a substantially planar upper and lower surface, said upper surface of each panel having thereon a plurality of distinct, three dimensional spatially raised features arranged in a pattern so as to be detectable by tactile sensation by a pedestrian, said planar upper surface of each panel having thereon a graphic design displaying at least two colors and having a resolution of at least 300×300 DPI, wherein said features are selected from the group consisting of a plurality of raised truncated domes or cones and a plurality of raised bars and said graphic image extends across said plurality of distinct spatially raised three dimensional features, wherein said graphic designs on said plurality of panels provide a coordinated advertising campaign related to a business, service, or product.

* * * * *